US010800584B2

(12) United States Patent
Giraud et al.

(10) Patent No.: US 10,800,584 B2
(45) Date of Patent: Oct. 13, 2020

(54) CAP AND CONTAINER ASSEMBLIES

(71) Applicant: CSP TECHNOLOGIES, INC., Auburn, AL (US)

(72) Inventors: Jean-Pierre Giraud, Auburn, AL (US); Herve Pichot, Chennevieres-sur-Marne (FR); John Belfance, Phenix City, AL (US); Mark Ostrowski, Greenville, SC (US); Michael Bucholtz, Blaston Spa, NY (US); Joseph W. Rogers, Lafayette Hill, PA (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 67 days.

(21) Appl. No.: 15/465,982

(22) Filed: Mar. 22, 2017

(65) Prior Publication Data

US 2017/0190483 A1 Jul. 6, 2017

Related U.S. Application Data

(63) Continuation of application No. 14/897,949, filed as application No. PCT/US2014/042620 on Jun. 17, 2014, now Pat. No. 9,834,341.
(Continued)

(51) Int. Cl.
*B65D 43/22* (2006.01)
*B65D 43/16* (2006.01)
(Continued)

(52) U.S. Cl.
CPC ..... *B65D 43/22* (2013.01); *A61J 1/03* (2013.01); *A61J 1/1425* (2015.05);
(Continued)

(58) Field of Classification Search
CPC .... B65D 43/22; B65D 2215/02; B65D 50/04; B65D 50/046; A61J 1/1425
See application file for complete search history.

(56) References Cited

U.S. PATENT DOCUMENTS 4,126,224 A 11/1978 Laauwe et al.
4,260,067 A 4/1981 Andruchiw
(Continued)

FOREIGN PATENT DOCUMENTS

EP 0609954 A1 8/1994
EP 1582476 A1 10/2005
(Continued)

*Primary Examiner* — Shawn M Braden
(74) *Attorney, Agent, or Firm* — Mark T. Vogelbacker; Eckert Seamans Cherin & Mellott, LLC

(57) ABSTRACT

A cap and container assembly includes a container having a base and a side wall extending upward from the base. The base and the side wall define an interior, and the side wall defines an opening leading to the interior. A cap moves with respect to the container between an opened position in which the opening is exposed, and a closed position in which the cap covers the opening. A tab projects outward from the cap and has a bottom surface. A spacer projects from the container side wall at a location beneath the tab when the assembly is in the closed position. The spacer bends inward towards the container in response to application of a sufficient force, to move from a locked position that blocks the bottom surface of the tab, to an unlocked position to expose at least a portion of the bottom surface of the tab.

20 Claims, 62 Drawing Sheets

Related U.S. Application Data

(60) Provisional application No. 61/836,748, filed on Jun. 19, 2013.

(51) Int. Cl.
*A61J 1/03* (2006.01)
*A61J 1/14* (2006.01)
*B65D 50/04* (2006.01)

(52) U.S. Cl.
CPC ..... *B65D 43/161* (2013.01); *B65D 43/162* (2013.01); *B65D 43/166* (2013.01); *B65D 50/046* (2013.01); *A61G 2200/14* (2013.01); *B65D 2251/105* (2013.01); *B65D 2251/1025* (2013.01); *B65D 2251/1091* (2013.01); *B65D 2543/00083* (2013.01); *B65D 2543/00092* (2013.01); *B65D 2543/00194* (2013.01); *B65D 2543/00296* (2013.01); *B65D 2543/00537* (2013.01)

(56) References Cited

U.S. PATENT DOCUMENTS

| | | | | |
|---|---|---|---|---|
| 4,344,646 | A | 8/1982 | Michel | |
| 4,809,874 | A * | 3/1989 | Pehr | B65D 43/164 215/235 |
| 5,911,937 | A | 6/1999 | Hekal | |
| 6,021,901 | A | 2/2000 | Wolfe | |
| 6,080,350 | A | 6/2000 | Hekal | |
| 6,082,572 | A | 7/2000 | Galton-Fenzi et al. | |
| 6,124,006 | A | 9/2000 | Hekal | |
| 6,130,263 | A | 10/2000 | Hekal | |
| 6,174,952 | B1 | 1/2001 | Hekal | |
| 6,214,255 | B1 | 4/2001 | Hekal | |
| 6,221,446 | B1 | 4/2001 | Hekal | |
| 6,412,634 | B1 | 7/2002 | Telesca et al. | |
| 7,000,792 | B2 | 2/2006 | Arai | |
| 7,213,720 | B2 | 5/2007 | Giraud | |
| 7,537,137 | B2 | 5/2009 | Giraud | |
| 7,798,348 | B2 * | 9/2010 | Sawyer | B65D 50/046 215/237 |
| 8,528,778 | B2 | 9/2013 | Giraud | |
| 8,596,493 | B2 | 12/2013 | Vollers et al. | |
| 9,045,263 | B2 * | 6/2015 | Fox | B65D 47/0838 |
| 2005/0133475 | A1 * | 6/2005 | Goto | B65D 47/0814 215/237 |
| 2006/0096984 | A1 | 5/2006 | Bandoh et al. | |
| 2007/0228042 | A1 | 10/2007 | Yeager | |
| 2009/0230177 | A1 | 9/2009 | Robertson | |
| 2011/0073610 | A1 | 3/2011 | Giraud et al. | |
| 2012/0211493 | A1 | 8/2012 | Daggett | |
| 2013/0112586 | A1 * | 5/2013 | Hawry | B65D 25/10 206/528 |
| 2014/0346172 | A1 | 11/2014 | Banerjee et al. | |

FOREIGN PATENT DOCUMENTS

| | | | |
|---|---|---|---|
| GB | 2082552 | A | 3/1982 |
| GB | 2166423 | A | 5/1986 |
| GB | 2449505 | A | 11/2008 |
| JP | 9315455 | A | 12/1997 |
| JP | 2004352324 | A | 12/2004 |

* cited by examiner

CAP AND CONTAINER ASSEMBLIES

BACKGROUND

There is an increasing awareness of the need to protect children from inadvertently gaining access to medications and other potentially harmful products. Ingestion of only one or two pills of a prescribed medication can prove fatal to a child. There is a further increasing awareness of the necessity to provide containers that are readily and easily opened by an adult, that is, any person having the cognitive ability to understand the instructions for opening a container, which requires certain manipulation and manual dexterity. Such persons are assumed to have the ability to understand that the act of opening such a container to gain access to the contents is a deliberate action, and is only undertaken when there is a necessity to attain access to such contents.

There are several conventional, so-called, "childproof" or "child-resistant" containers in the market, which are generally employed by dispensing pharmacists for use in filling prescriptions, where the prescription requires that the pharmacist dispense one or more of a plurality of pills, tablets, gel-caps, capsules, or the like. For example, the container may include a "push-and-turn" closure for pill containers, or an "arrow-alignment" closure for pill containers.

The "push-and-turn" system for containers conventionally refers to a system in which the closure or cap for the container must be pushed axially downwardly and rotated at the same time to open the container. The "arrow alignment" system for containers conventionally refers to a system in which an arrow on the closure or cap must be aligned with an arrow on the container, such as one which is embossed on the container, in order to open the container. However, these containers are often complicated for adults to use.

Conventional container assemblies of the type where the cap or closure is integral with the container may include a hinge that pivotally affixes the cap and the container, and in some cases have a fixed protrusion (also referred to as a "thumb tab") attached to the cap that is configured to assist in the opening of the cap. This fixed protrusion is typically opposite the hinge, and thus acts as a lever to allow the intended user to open the container when a sufficient force is applied under the fixed protrusion. Such containers can often easily be opened by children.

Therefore it is an object of the invention to provide an improved cap and container system that is child resistant, yet easily opened by an adult.

SUMMARY

The present invention relates to various embodiments of cap and container assemblies and methods for opening such assemblies. In one embodiment, the cap and container assembly includes a container having a base and a side wall extending upward from the base. The base and the side wall define an interior, and the side wall defines an opening leading to the interior. A cap moves with respect to the container between an opened position in which the opening is exposed, and a closed position in which the cap covers the opening. A tab projects outward from the cap and has a bottom surface. A spacer projects from the container side wall at a location beneath the tab when the assembly is in the closed position. The spacer bends inward towards the container in response to application of a sufficient force, to move from a locked position in which the spacer is outwardly oriented and blocks the bottom surface of the tab, to an unlocked position in which the spacer is inwardly bent to expose at least a portion of the bottom surface of the tab.

DETAILED DESCRIPTION OF THE PREFERRED EMBODIMENTS

Figure 1:
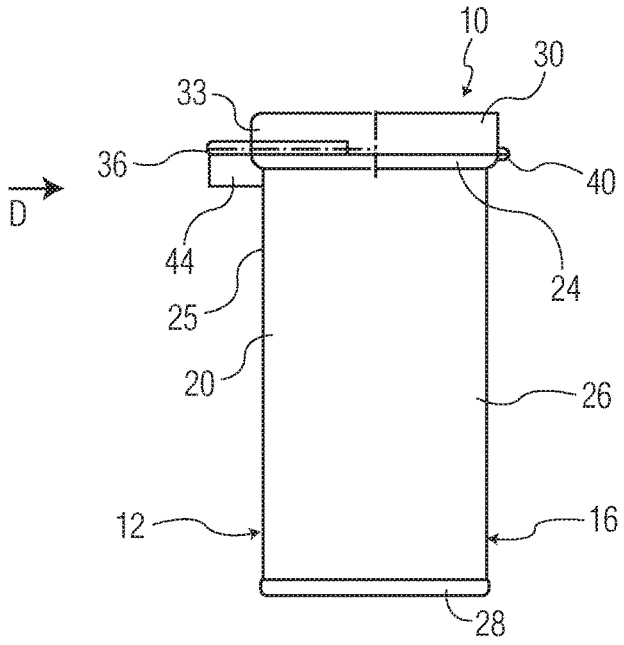
FIG. 1 is a side elevational view of a first embodiment of a cap and container assembly according to the invention, in a closed position.

Certain terminology is used in the foregoing description for convenience and is not intended to be limiting. Words such as "front," "back," "top," and "bottom" designate directions in the drawings to which reference is made. This terminology includes the words specifically noted above, derivatives thereof, and words of similar import. General references to the inventions disclosed herein, when using these or similar terms, shall be considered made with respect to the assemblies in the closed and locked position, unless otherwise specified. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

A first embodiment of a container assembly 10 according to the invention is shown in FIGS. 1-5. As shown, the assembly 10 includes a container 20 having a base 28 and a tubular side wall 26 extending upward from the base 28. The side wall 26 defines an opening 22 at an upper edge thereof, and the opening 22 leads to an interior 27 of the container 20. The assembly 10 has a front 12, a rear 16, and first and second sides 14A, 14B joining the front 12 and rear 16.

Figure 2:
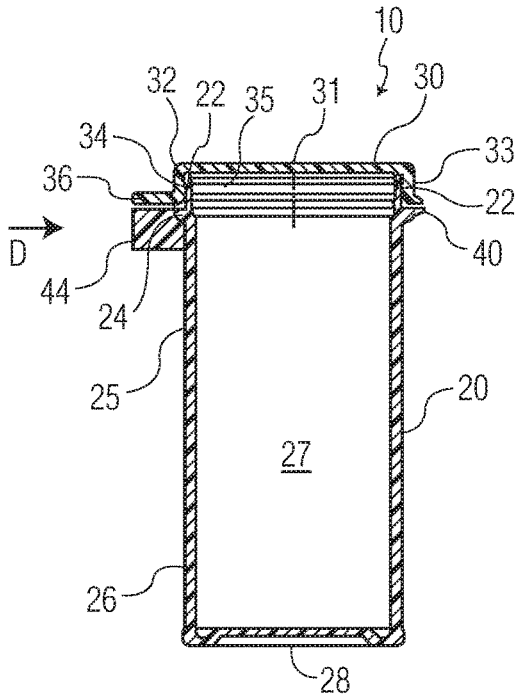
FIG. 2 is side a cross sectional view of the assembly of FIG. 1, in a closed position.
Figure 3:
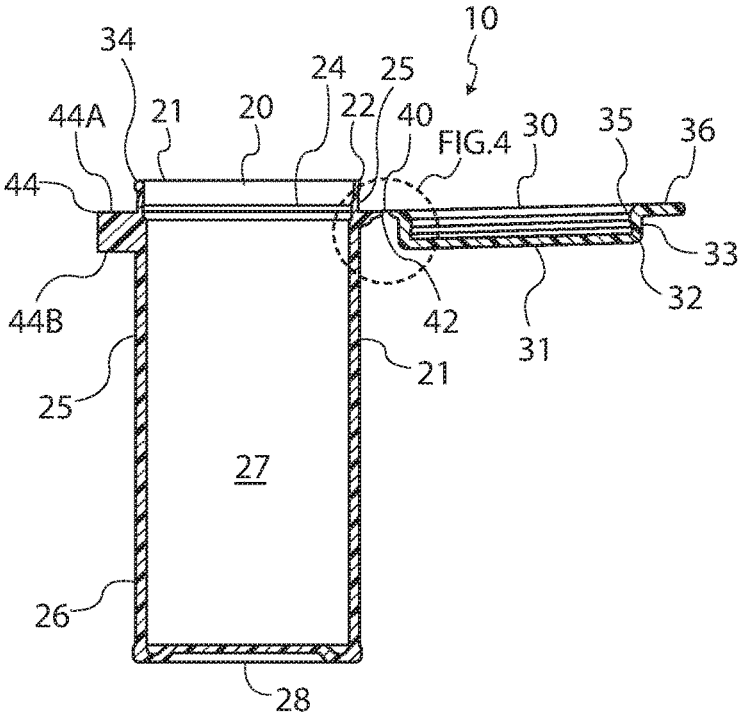
FIG. 3 is a side cross sectional view of the assembly of FIG. 1, in an opened position.
Figure 4:
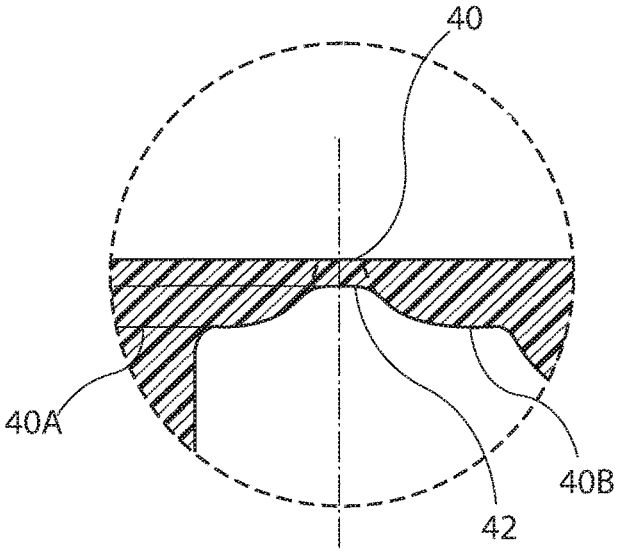
FIG. 4 is an enlarged detail of FIG. 3.
Figure 5:
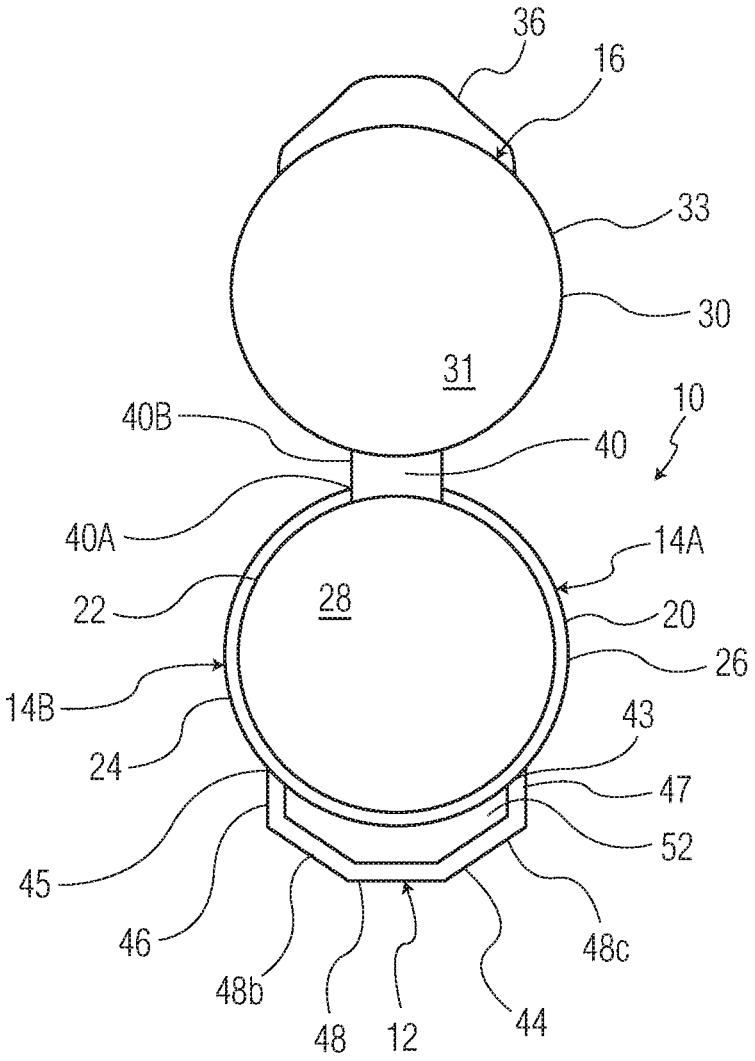
FIG. 5 is a top plan view of the assembly of FIG. 1, in an opened position.

Still referring to FIGS. 1-5, the assembly 10 further includes a cap 30. The cap 30 includes a top wall 31 and a skirt 33 that extends downward, substantially perpendicularly around the outer periphery of the top wall 31. The cap 30 moves between a closed position, in which the cap 30 covers the opening 22, as shown in FIGS. 1 and 2, and an opened position, in which the opening 22 is exposed, as shown in FIGS. 3 and 5. The cap 30 of the illustrated embodiment is pivotally affixed to the container by a hinge 40, which allows the cap 30 to pivot between the opened and closed positions. The cap 30 of the illustrated embodiment further includes a thumb tab 36 for facilitating the opening and closing of the container. The thumb tab 36 extends radially outward from the cap 30, and in particular from a lower edge of the skirt 33 in the embodiment shown, at a location directly opposite the hinge 40.

The container 20 may further include a radially outwardly projecting flange 24. As shown in FIGS. 2 and 3, the flange 24 is formed slightly below the upper edge of the side wall 26, such that the upper portion of side wall 26 located between the flange 26 and opening 22 forms an upper container rim 25. A bottom edge of the skirt 33 rests on an upper surface of the flange 24 when the assembly 10 is in the closed position, as shown in FIGS. 1 and 2.

The skirt 33 surrounds the rim 25 when the assembly 10 is in the closed position. In some embodiments, a moisture-tight seal may be formed between the skirt 33 and the rim 25. As used herein, the term "moisture-tight" is defined as indicating that the moisture ingress of the container (after three days) is less than about 1500 micrograms of water, in another embodiment, about 500 micrograms of water, in a further embodiment, about 300 micrograms of water, in yet another embodiment, about 150 micrograms of water, determined by the following test method: (a) place one gram plus or minus 0.25 grams of molecular sieve desiccant in the container and record the weight; (b) fully close the container; (c) place the closed container in an environmental chamber at conditions of 80% relative humidity and 72 F; (c) after one day, weigh the container containing the molecular sieve; (d) after four days, weigh the container containing the molecular sieve; and (e) subtract the first day sample from the fourth day sample to calculate the moisture ingress of the container in units of micrograms of water.

In the embodiment of FIGS. 1-5, a recess 32 is formed on an inner surface 35 of skirt 33, as shown in FIGS. 2 and 3, and the rim 25 includes a sealing projection 34 formed at an upper edge thereof. The sealing projection 34 is located within the recess 32 when the assembly 10 is in the closed position. An interference fit may be formed between the rim 22 and the skirt 33, and in some embodiments between the sealing projection 34 and the recess 32. Such an interference fit may result in a moisture-tight seal between the container 20 and the cap, as described above, and may also or alternatively function to retain the cap 30 on the container in a closed position. In some embodiments, the assembly 10 can be closed and sealed by applying, in a singular motion, downward pressure on the thumb tab 36 or the top wall 31 of the cap 30, to pivot the cap to the closed position on the container 20.

The hinge 40 may be attached to the container flange 24. As shown in FIG. 4, the hinge 40 includes a container hinge element 40A that is affixed to the container 20, and in particular to the flange 24 in this embodiment, and a hinge cap element 40B that is affixed to the cap 30, and in particular to the skirt 33 in this embodiment. A recess 42 is formed as a relatively thinner section of material joining the two hinge elements 40A, 40B and forms a bending point during the opening and closing of the container 20.

A spacer 44 is attached to an outer surface of the container side wall 26. The spacer 44 is positioned near the container opening 22, such that an upper surface thereof is level with an upper surface of the flange 26. When the cap 30 is in the closed position, the spacer 44 is located under the thumb tab 36, as shown in FIGS. 1 and 2. The spacer 44 may be substantially the same shape and size as the thumb tab, as shown in the embodiment of FIGS. 1-5, such that the spacer 44 covers the entire bottom surface of the thumb tab 36, making it inaccessible to a user without displacing the spacer 44 in the manner described below. In another embodiment, the spacer 40 may be larger than the thumb tab 36, which also results in the lower surface of the thumb tab 36 being inaccessible to a user without displacing the spacer 44.

Referring in particular to FIG. 5, the spacer 44 is an elongate body having a first end 43 and a second end 45, each affixed to the side wall 26 and defining spacer opening 52 between the spacer 44 and side wall 26. The spacer 44 may be constructed of first side segment 46, second side segment 47, and front segment 48. The first 46 and second 47 side segments extend outward from the side wall 26, away from the container 20. The front segment 48 extends between and joins the first 46 and second side segments 47. The spacer 44 may further include connecting segments 48*b*, 48*c*. First connecting segment 48*b* extends between and joins first side segment 46 with front segment 48, and second connecting segment 48*c* extends between and joins second side segment 47 with front segment 48. Accordingly, the spacer 44 of the illustrated embodiment has a substantially five-sided configuration. In other embodiments, the connecting segments 48*b*, 48*c* could be omitted and the spacer 44 could have a substantially three-sided configuration. In other embodiments, the number of segments could be increased or decreased, or the spacer 44 could be provided as a single, continuous curved strip. In each of the embodiments, an opening 52 is formed between the spacer 44 and the outer surface of the container side wall 26.

Each of the segments 46, 47, 48, 48*b*, 48*c* has a thickness and a height. The height of each segment extends between upper spacer end 44A to lower spacer end 44B, as shown in FIG. 3.

The spacer 44 or a portion thereof may be constructed of a material that bends when a sufficient force is applied thereto. As used in this application, "sufficient force" is defined as a degree of force above a preselected threshold that causes bending. In one embodiment, the entire spacer 44 bends when a sufficient force is applied thereto. In other embodiments, one or more portions or segments of the spacer 44 may bend when a sufficient force is applied thereto. In some embodiments, at least the front segment 48 bends when a sufficient force is applied thereto.

Children who are of an age at which they cannot comprehend the dangers of taking medicines unintended for them or large doses of medicines typically possess a lower degree of strength than adults. The sufficient force may be selected to be above the strength capabilities of such children.

The spacer or segments thereof that bend when a sufficient force is applied may be dimensioned and formed of a material selected to permit bending when the sufficient force is applied. For example, the spacer 44 or segment or segments thereof may be formed of a material having a lower degree of stiffness than the container or other segments of the spacer 44, such as a material containing a thermoplastic elastomer. Alternatively or additionally, the spacer 44 or segments thereof may be thickness configured to permit bending when the sufficient force is applied. A person of ordinary skill in the art would be capable of selecting a material and/or thickness to allow bending under application of the sufficient force.

As noted above, the spacer 44 is located below the thumb tab 36, and the thumb tab 36 may in turn rest on the spacer 44 when the assembly 10 is in the closed position. Accordingly, the spacer 44, when in a normal state, blocks access to the underside of the thumb tab 36, to substantially prevent access thereto. In such a state, the spacer 44 is in a locked position. As used herein, the term "substantially prevent" does not encompass instances of product misuse, such as by wedging a tool between the cap and spacer 44 in order to pry the cap 30 off of the container 20, or moving the spacer 44 inward by stepping on it. Furthermore, in the illustrated embodiment, the outer surface of the skirt 33 is substantially flush with that of the flange, substantially preventing access to the underside of flange 24. In this embodiment, the cap 30 has a greater area than the container 20. In other embodiments, the cap 30 and container 20 could have substantially equal surface areas. In either configuration, access to the underside of skirt 33 is substantially prevented, so that the assembly 10 can only be opened in the manner described below.

To open the assembly 10, a user applies sufficient force to the spacer 44 in an inward direction D of the assembly 10, towards the container side wall 26. The sufficient force may be applied to the entire spacer 44, or to just the portion designed to bend under application of a sufficient force, such as the front segment 48. Application of the sufficient force results in the spacer 44 or portion thereof moving inwards with respect to the container 20, moving the spacer 44 into an unlocked position, in which at least a portion of the underside of thumb tab 36 is exposed. An upward force can then be applied to the underside of thumb tab 36, driving the cap 30 in an upward direction to displace it from the container 20 and uncover the opening 22, in order to open the assembly 10.

The spacer 44 may be biased towards the locked position, for example, by being formed of a material having a degree of stiffness so as to cause the spacer 44 to unbend and return to the locked position upon release of the sufficient force.

In some embodiments, the cap 30, container 20 and hinge 40 may be integrally molded of a plastic material. The assembly 10 may be, for example, molded in accordance with the mold similar to that disclosed in U.S. Pat. Nos. 4,783,056 and 4,812,116, respectively or may be produced in accordance with U.S. Pat. No. 5,723,085. The disclosures of these patents are incorporated by reference herein as if fully set forth.

Figure 6:
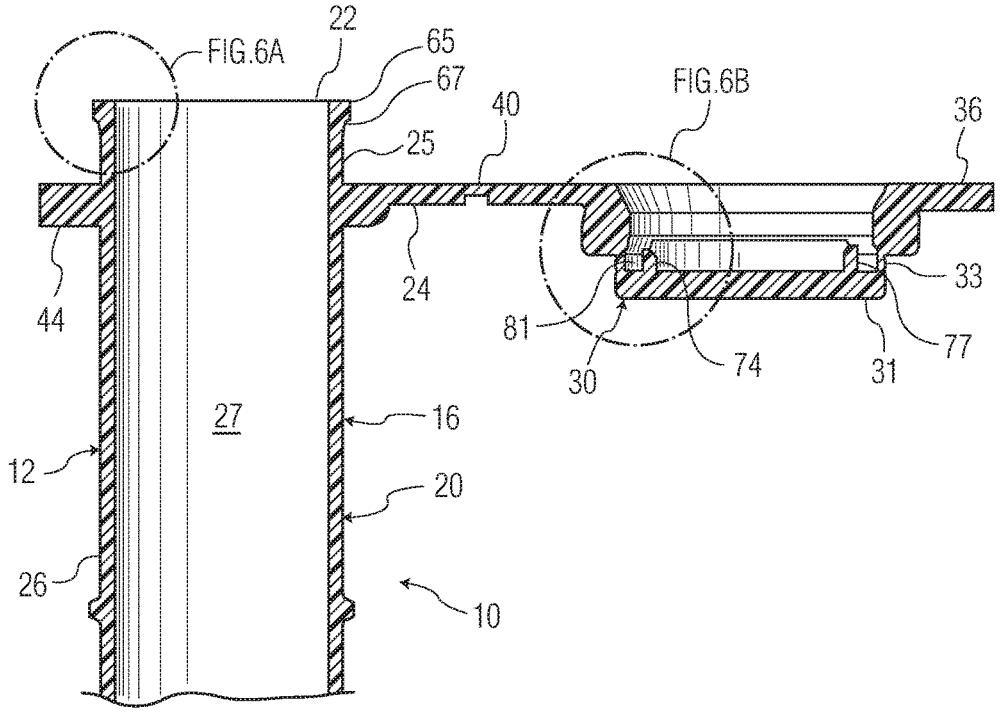
FIG. 6 is a side cross sectional view of another embodiment of a cap and container assembly according to the invention, in an opened position.
Figure 6A:
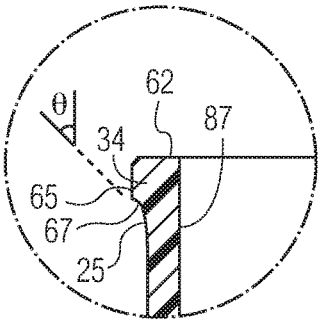
FIG. 6A is an enlarged detail of FIG. 6.
Figure 6B:
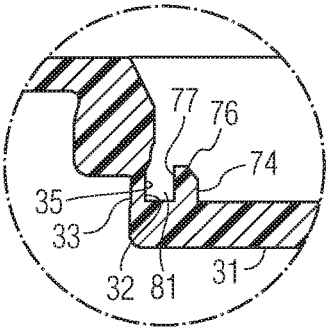
FIG. 6B is another enlarged detail of FIG. 6.

Another embodiment of a container assembly 10 according to the invention is shown in FIGS. 6, 6A and 6B. The assembly of FIGS. 6, 6A and 6B is similar to that of FIGS. 1-5, and only the differences will be described in detail. The same reference numbers as those used in FIGS. 1-5 will be used to designate the same or analogous elements of the assembly of FIG. 6, unless otherwise specified. FIG. 6A shows the rim 25 of this embodiment in detail. As shown, sealing projection 34 and the smooth transition surface at upper edge 62 of the container 20 form an annular region for interlocking with the cap 30. In one embodiment, the outer diameter of the sealing projection 34 is greater than the inner diameter of container side wall 26. In one embodiment, the outer diameter of the sealing projection 34 is about 0.025" greater than the outer diameter of side wall 26. The sealing projection 34 includes an outer projection surface 65, which has the maximum outer diameter of the sealing projection 34. The outer diameter of the outer projection surface 65 may be constant. In one embodiment, the outer diameter of the outer projection surface 65 is constant for a length of 0.033" in an axial direction of the assembly 10. Adjacent the outer projection surface 65, a lower projection surface 67 tapers downward and inward toward the side wall 26. In one embodiment, the lower projection surface extends for a distance of about 0.030" in an axial direction of the assembly 10 and tapers at an angle θ of 21° with respect to the side wall 26 and outer projection surface 65.

The assembly of FIG. 6 further includes an inner sealing ridge 74, as shown in detail in FIG. 6B. Sealing ridge 74 is positioned on a lower surface of the top wall 31, extending downward and substantially perpendicularly therefrom, and is disposed radially inward with respect to skirt 33. The sealing ridge 74 is disposed within the container opening 22 and abuts an inner surface 87 of the side wall 26 when the assembly 10 is in the closed position. An outer surface 77 of the sealing ridge 74 and inner surface 35 of skirt 33 define a gap 81 into which rim 25 fits, to form a seal when the cap 30 is in the closed position. The rim 25 is configured to sealingly fit within the gap 81, for example, by way of an outer surface 77 of the sealing ridge 74 being in continuous contact with an inner surface 87 of the rim 25 along the entire annular extensions thereof, or by way of an outer surface of the rim 25, for example, a surface of the sealing projection 34, being in continuous contact with an inner surface 35 of the skirt 33, such as an inner surface of recess 32, along the entire annular extensions thereof.

The sealing ridge 74 may further include a bottom surface 76, which may be curved, angled, or both, to form a smooth transition surface to facilitate guiding the sealing ridge 74 into the container opening 22.

The sealing ridge 74 may take on other configurations or include other features known in the art. For example, the sealing ridge 74 could take on all or part of any of the configurations disclosed in any of U.S. Pat. Nos. 7,537,137, 7,213,720 or 8,528,778, each of which is incorporated herein by reference as if fully set forth.

Figure 7:
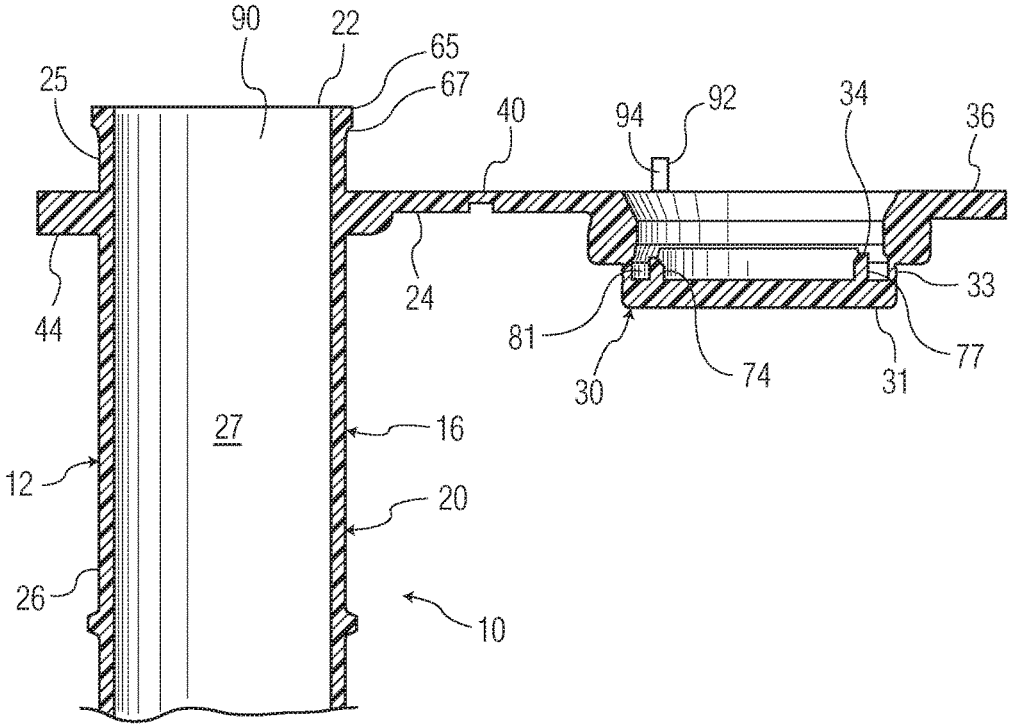
FIG. 7 is a side cross sectional view of another embodiment of a cap and container assembly according to the invention, in an opened position.
Figure 8:
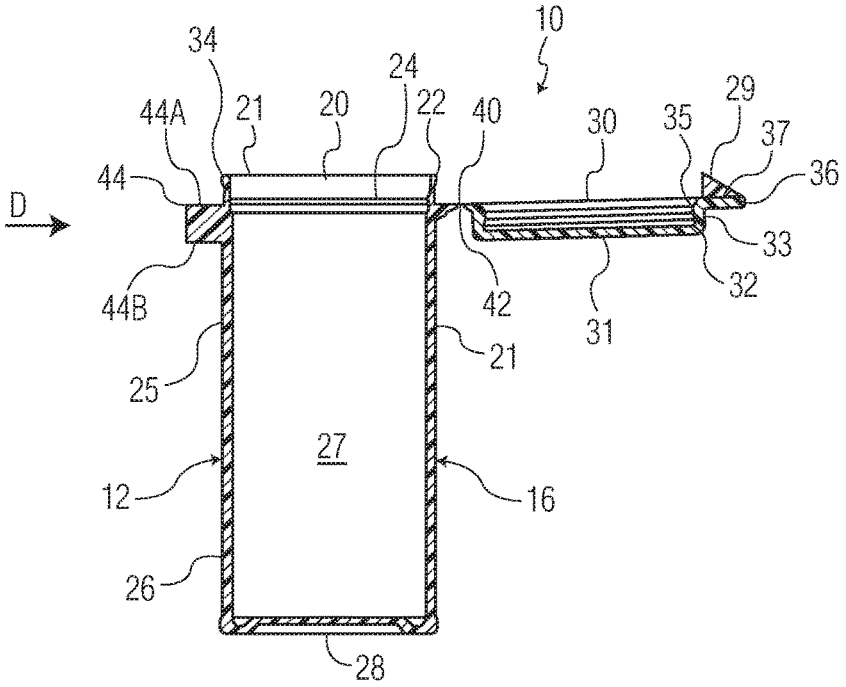
FIG. 8 is a side cross sectional view of another embodiment of a cap and container assembly according to the invention, in an opened position.
Figure 9:
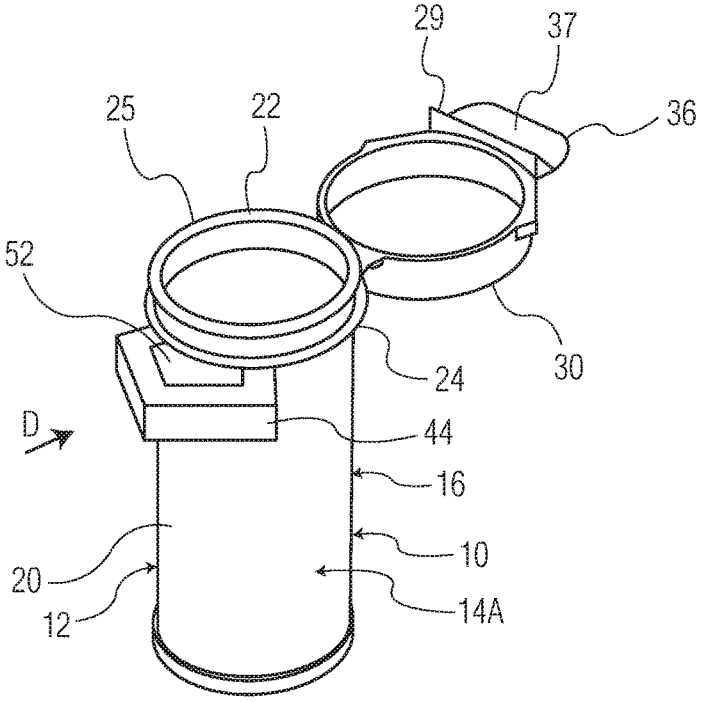
FIG. 9 is a front perspective view of the assembly of FIG. 8, in an opened position.

Another embodiment of a container assembly 10 according to the invention is shown in FIG. 7. The assembly 10 of FIG. 7 is similar to that of FIG. 6, and only the differences will be described in detail. The same reference numbers as those used in FIG. 6 will be used to designate the same or analogous elements of the assembly of FIG. 6, unless otherwise specified.

In the embodiment of FIG. 7, the container 20 further includes a pin 90 that extends outward from the side wall 26 at an upper portion of the container 20.

The cap 30 includes a latch 92 extending downward from the skirt 33. The latch 92 includes an aperture 94. When the assembly 10 is in the closed position, pin 90 is retained within the aperture 94 to retain the cap 30 over the opening 22 in the closed position. In order to displace the cap 30 and move the assembly into an opened position, the latch 92 can be pulled away from the pin, releasing the pin 90 from the aperture to allow opening and closing of the assembly 10.

The features and functionality of the above-described embodiments will be better understood with reference to the following examples, which set forth the results of tests conducted on container assemblies according to the invention. These examples are for illustrative purposes and should not be considered limiting the scope of the invention.

Example 1

A container assembly having the features described with reference to FIG. 6 was provided to panelists. The assembly was empty and was opened and closed ten (10) times prior to testing. Directions to open the package read: TO OPEN: PUSH IN AND FLIP UP WITH THUMB.

Panelists

In the child testing phase of this study, the panelists included twenty (20) children between the ages of forty-two (42) months and fifty-one (51) months, and were distributed into three age groups (42-44, 45-48, and 49-51 months, evenly distributed by sex).

In the senior phase of this study, the panelists include twenty (20) seniors between the ages of fifty (50) years and seventy (70) years of age, and were distributed into three age groups (50-54, 55-59, and 60-70 years, with 75% female).

Test Supervisory

Test supervisor(s) were instructed to conduct the evaluation of the packaging in strict accordance with the 16 CFR 1700.

Results and Discussion

Results of this study appear in the Tables 1 and 2. These tables represent a compilation of all data obtained during the study. For clarity in presentation and discussion this information, the following features will be used as the major points of discussion: Child-resistant effectiveness, senior-use effectiveness, and compliance with the Code of Federal Regulations Title 16, Part 1700.

Child-Resistant Effectiveness

Results of the package evaluation by the twenty (20) child panelists appear in Table 1, below. From Table 1 it will be noted that no children were successful in opening the package before demonstration, and one (1) child was successful in opening the package following a demonstration, for a total of one (1) successful child panelist. This represents a child-resistant effectiveness rate of 95%.

TABLE 1

Package opening test evaluated by children aged forty-two (42) to fifty-one (51) months for child resistant effectiveness.

| Age in | | | | Successful Panelists | | | | |
|---|---|---|---|---|---|---|---|---|
| | | | | Before Demonstration | | After Demonstration | | |
| Months | Males | Females | Total | Males | Females | Males | Females | Total |
| 42-44 | 2 | 3 | 5 | 0 | 0 | 1 | 0 | 1 |
| 45-48 | 5 | 5 | 10 | 0 | 0 | 0 | 0 | 0 |
| 49-51 | 3 | 2 | 5 | 0 | 0 | 0 | 0 | 0 |
| Totals | 10 | 10 | 20 | 0 | 0 | 1 | 0 | 1 |

CHILD-RESISTANT EFFECTIVENESS = 95.00%

Senior-Use Effectiveness

The senior panel consisted of fifteen (15) females and five (5) males from sixty (60) to seventy (70) years of age. Nineteen (19) of the twenty (20) seniors were successful in opening the package, representing a senior use effectiveness of 95%.

TABLE 2

Package opening test evaluated by adults of sixty (60) to seventy (70) years of age for senior use-effectiveness.

| | SUCCESSFUL PANELISTS | | | |
|---|---|---|---|---|
| 60-70 years old: | Panelists Tested | First Opening | Second Opening and Second Closing | TOTAL Failures |
| Females | 15 | 14 | 14 | 1 |
| Males | 5 | 5 | 5 | 0 |
| Subtotal | 20 | 19 | 19 | 1 |
| TOTAL | 20 | 19 | 19 | 1 |

SENIOR-USE EFFECTIVENESS (SAUA) - 95.00%

Compliance with 16 CFR 1700

The tested containers fulfill the standards for poison prevention packaging under 16 CFR 1700.

Example 2

A container assembly having the latch and pin features described with reference to FIG. 7 was provided to panelists. The assembly was empty and was opened and closed ten (10) times prior to testing. Directions to open the package did not appear on any of the test units. Panelists In the child testing phase of this study, the panelists included fifty (50) children between the ages of forty-two (42) months and fifty-one (51) months, and were distributed into three age groups (42-44, 45-48, and 49-51 months, evenly distributed by sex).

Test Supervisor(s)

Test supervisor(s) were instructed to conduct the evaluation of the packaging in strict accordance with the 16 CFR 1700.

Results and Discussion

Results of this study appear in Table 3, which represents a compilation of all data obtained during the study. For clarity in presentation and discussion of this information, the following features will be used as the major points of discussion: Child-resistant effectiveness and compliance with the Code of Federal Regulation Title 16, Part 1700.

Child-Resistant Effectiveness

Results of the package evaluation by the fifty (50) child panelists appear in Table 3, below. From Table 3 it will be noted that no children were successful in opening the packaging before demonstration, and one (1) child was successful in opening the packaging following a demonstration for a total of one (1) successful child panelist. This represents a child-resistant effectiveness of 98%.

Table 3. Package opening test evaluated by children aged forty-two (42) to fifty-one (51) months of age for child resistant effectiveness.

TABLE 3

Package opening test evaluated by children aged 42 to 51 months of age for child resistant effectiveness.

| Age in | | | | Successful Panelists | | | | |
|---|---|---|---|---|---|---|---|---|
| | | | | Before Demonstration | | After Demonstration | | |
| Months | Males | Females | Total | Males | Females | Males | Females | Total |
| 42-44 | 7 | 8 | 15 | 0 | 0 | 0 | 0 | 0 |
| 45-48 | 10 | 10 | 20 | 0 | 0 | 0 | 0 | 0 |
| 49-51 | 8 | 7 | 15 | 0 | 0 | 1 | 0 | 1 |
| Totals | 25 | 25 | 50 | 0 | 0 | 1 | 0 | 1 |

CHILD-RESISTANT EFFECTIVENESS = 98.00%

Compliance with 16 CFR 1700

The tested containers fulfill the standards for poison prevention packaging under 16 CFR 1700.

FIGS. 8-11 show anther embodiment of a cap and container assembly 10 in accordance with the present invention. The assembly 10 of FIGS. 8-11 is similar to that of FIGS. 1-5, and only the differences will be described in detail. The same reference numbers as those used in FIGS. 1-5 will be used to designate the same or analogous elements to the assembly of FIGS. 1-5, unless otherwise specified.

Figure 10:
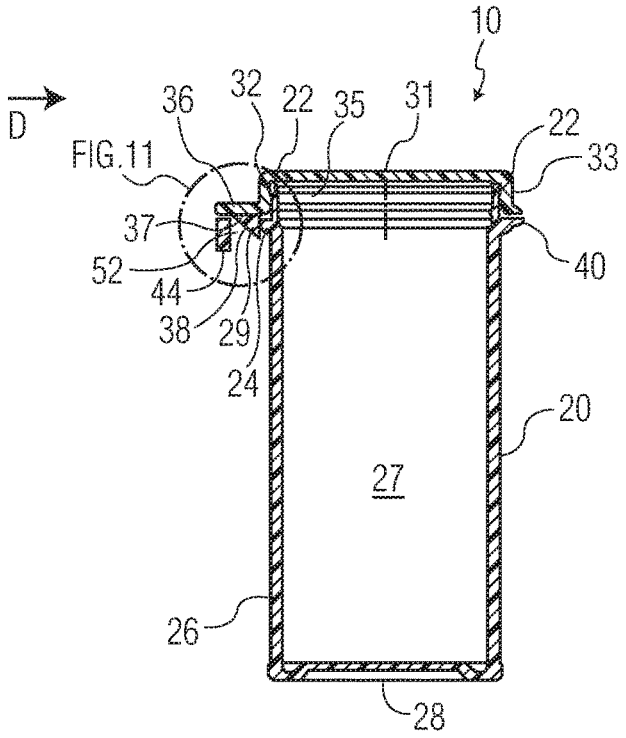
FIG. 10 is a side cross sectional view of the container of FIG. 8, in a closed position.
Figure 11:
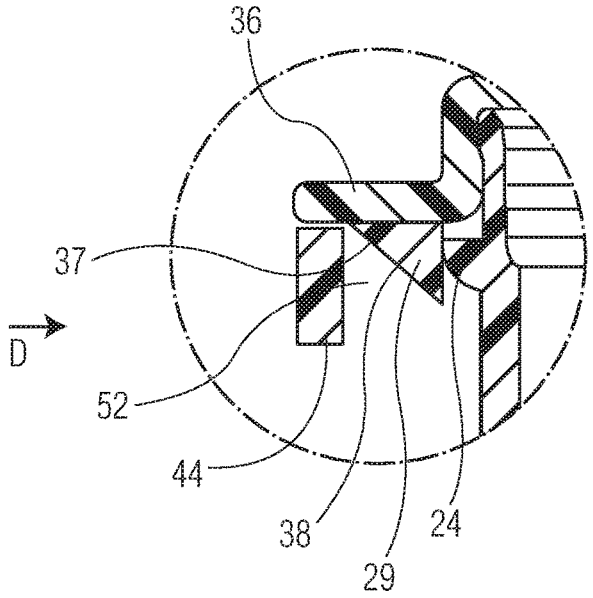
FIG. 11 is an enlarged detail of FIG. 10.

As shown, the assembly 10 of FIGS. 8-11 includes a ramp 29 protruding from a lower surface 37 of the thumb tab 36. When the assembly 10 is in the closed position as shown in FIGS. 10 and 11, the ramp 29 protrudes into the opening 52 of the spacer 44. When a sufficient force is applied to the spacer 44 in an inward direction D towards the container 20, the spacer 44 contacts inclined surface 38 of the ramp 29, which extends, generally, in an angled direction downwards towards the bottom of the container 20 and inwards towards the center of the container 20. As the spacer 44 continues to move in direction D, the incline of surface 32 forces thumb tab 36, and in turn the cap 30, in an upward direction, causing the cap 30 to lift off of the container 20. According to such an embodiment, a separate action of applying pressure to the thumb tab 36 to open the assembly 10 may be eliminated, as the application of a sufficient force itself to the spacer 44 itself results in lifting of the cap 30. Alternatively, the assembly 10 could be configured such that some pressure must be applied to the thumb tab 36 in order to open the assembly, with the ramp 29 serving merely to reduce the necessary amount of pressure and assist in lifting of the cap 30.

Figure 12:
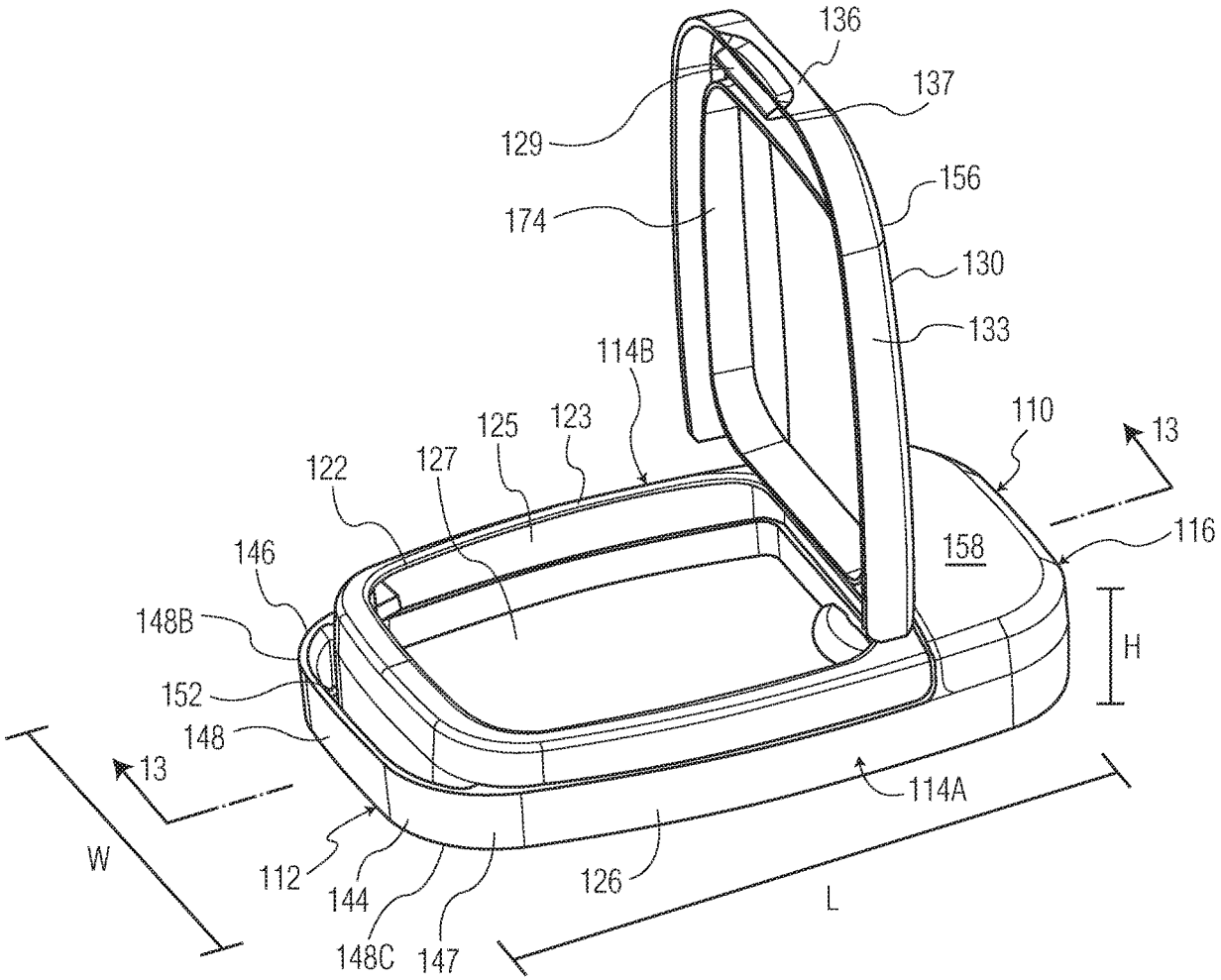
FIG. 12 is a side perspective view of another embodiment of a cap and container assembly according to the invention, in an opened position.
Figure 13:
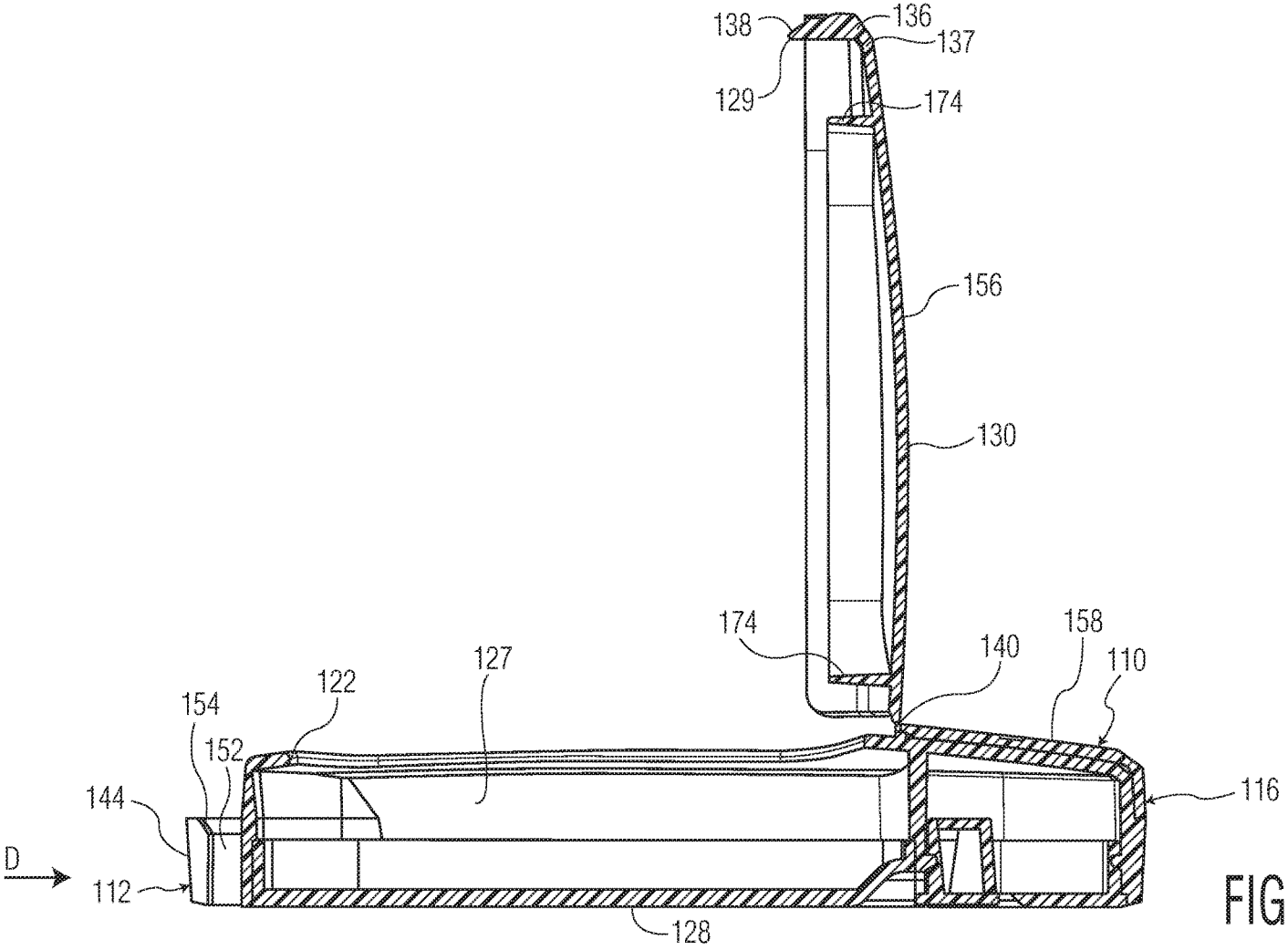
FIG. 13 is a side cross sectional view of the assembly of FIG. 12.

Another embodiment of a cap and container assembly 110 according to the invention is shown in FIGS. 12 and 13. The assembly 110 of FIGS. 12 and 13 is similar to that of FIGS. 8-11, and only the differences will be described in detail. Unless otherwise specified, the same reference numbers as those used in FIGS. 8-11 will be used to designate the same or analogous elements to the assembly of FIGS. 8-11, increased by 100.

In the embodiment of FIGS. 12 and 13, the cap 130 and container 120 both have substantially rectangular shapes with rounded sides and corners. The side wall 126 has a height H, which extends upward with respect to the assembly 110 and perpendicular to the base 128. The base 128 has a width W running parallel to hinge 140 and a length L running perpendicular to hinge 140. The height H of the side wall 126 of this embodiment is substantially less the width W and length L of the base 128, which can be advantageous for transport and storage of the assembly 110, for example in the pocket of a user. The width W is shorter than the length L in the embodiment of FIGS. 12 and 13, giving the assembly 110 a substantially rectangular shape.

The embodiment of FIGS. 12 and 13 further includes an inner sealing ridge 174 extending downward from a lower surface of top wall 131 and located interior to the 133 skirt. The inner sealing ridge 174, with the exception of having a substantially rectangular shape, may take on a configuration similar to that of the sealing ridge shown in and described with respect to FIGS. 6 and 7, as well as other configurations known in the art, such as those disclosed in U.S. Pat. Nos. 7,537,137, 7,213,720 or 8,528,778, each of which is incorporated herein by reference as if fully set forth.

The embodiment of FIGS. 12 and 13, like those described above, includes a spacer 144 that must be pressed inward with a sufficient force in order to open the assembly 110. As shown in FIG. 12, the spacer 144 of this embodiment has a substantially three sided shape, including first side segment 146, second side segment 147, and front segment 148. First and second connecting segments **48*b*, 48*c* extend in substantially curved paths, such that the spacer 144 extends in a path matching the substantially rectangular outer perimeter of the container base 120 and cap 130, with rounded corners. In other embodiments the spacer 144** could take on other configurations.

Referring in particular to FIG. 13, the spacer 144 of this embodiment includes an upper inclined surface 154 extending in an angled path, generally upwards and outwards, away from the container 120. The inclined surface 154 engages the tab inclined surface 138, as described in detail below.

The tab 136 of the assembly 110 of FIGS. 12 and 13 is formed as an extension of the skirt 133. In particular, a portion of skirt 133 extends downward from the front edge of cap 133, forming tab 136. Ramp 129, having inclined surface 138, extends downward from a bottom edge 137 of thumb tab 136. Ramp inclined surface 138 is complimentary to the spacer inclined surface 154. When spacer 144 is pushed in an inward direction D, spacer inclined surface 154 slides against ramp inclined surface 138, to facilitate upward driving of tab 136 and in turn lid 130 in the manner described above with respect to FIGS. 8-11.

The embodiment of the assembly shown in FIGS. 12 and 13 includes a two part cap 130. As shown, such a two part cap 130 includes a front portion 156 and a rear portion 158. The hinge 140 divides the cap 130 into the front portion 156 and rear portion. As shown, the front portion 156 is pivotally affixed to the container 120 at the hinge 140, permitting the front portion 156 to pivot between an opened position in which the opening 122 is exposed, as shown in FIGS. 12 and 13, and a closed position, in which the front portion 156 covers the opening 122 and is located substantially in alignment with the rear portion 158. The front portion 156 extends from the hinge 140 towards the front 112 of the assembly 110, and includes tab 136.

Rear portion 158 of the cap 130 extends between hinge 140 and the rear side 116 of the assembly. The rear portion 158 remains in a fixed position upon the assembly in the embodiment shown, and does not pivot about the hinge 140. In other embodiments, rear portion 158 could pivot about hinge 140 to expose a second opening or a rear portion of opening 122. In other embodiments, opening 122 could be located beneath rear portion 158 and front portion 156 could be affixed in position upon the container 120. In yet other embodiments, the lid 130 could be formed as unitary structure that pivots with respect to the hinge 140.

Figure 14:
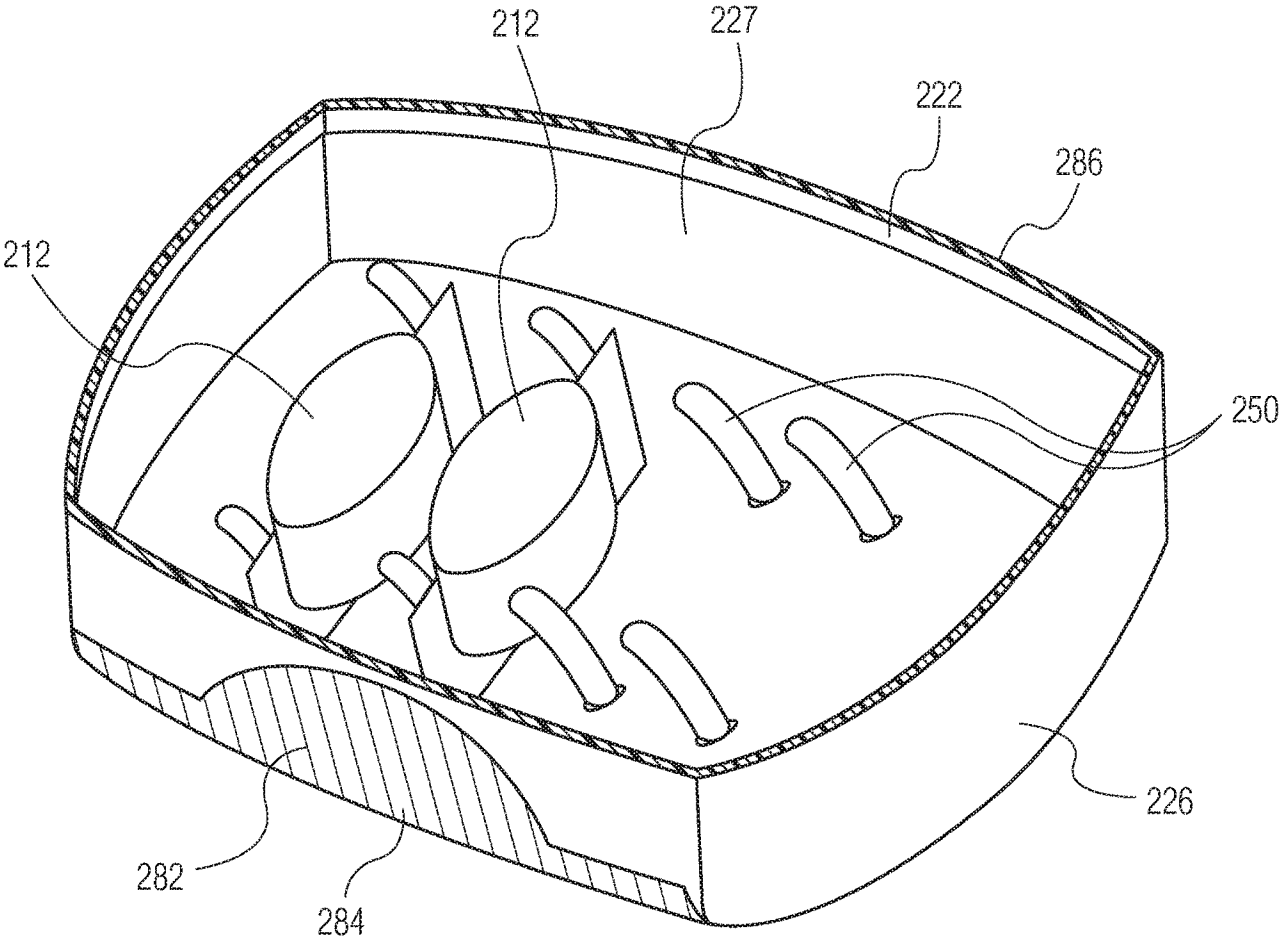
FIG. 14 is a side perspective view of a container of a cap and container assembly according to another embodiment of the invention.

FIG. 14 shows a container 220 of yet another embodiment of the cap and container assembly 210 of the present invention. The container 220 shown in FIG. 14 can be used in an assembly that incorporates a cap similar to that shown in FIGS. 12 and 13, as well as other embodiments of the assembly described herein and other cap and container assemblies known in the art.

The container 220 of FIG. 14 includes a plurality of flexible fingers 250 for retaining products 212 within the interior 227 of the container 220. The fingers 250 can be made of any material that permits a sufficient degree of flexibility to allow repositioning thereof to permit placement of products 212 therebetween. For example, the fingers 250 could be formed of a resilient polymeric material, which could be, for example, an elastomeric material. The fingers 250 could also be formed of a flexible material with a lower degree of resiliency, so that they are easily deformed but retain their positions.

The container 220 of FIG. 14 further includes a gripping surface 282 on the exterior thereof. The gripping surface 282 could be a surface formed of a material having a high coefficient of friction, such as an elastomeric material. Alternatively, or in addition, the gripping surface 282 could include texturing elements, such as scoring, as shown in FIG. 14, to facilitate gripping by a user. In other embodiments a gripping surface 282 similar to that shown in FIG. 14 could be incorporated into containers having other configurations, such any other container assembly disclosed herein, as well as other cap and container assemblies known in the art.

The container 220 of FIG. 14 further includes a seal 286. The seal 286 extends about the perimeter of the upper edge of the container 220 side wall 226 such that it is contacted by the cap when closed over the opening 222. The seal 286 may be formed of any suitable material known in the art for producing seals, such as an elastomeric material. In other embodiments, a seal such as that shown in FIG. 14 could be incorporated into containers having other configurations, such as other embodiments of cap and container assemblies disclosed herein, or other cap and container assemblies known in the art. The seal 286 could be included in an assembly with or without an inner sealing ridge 174 such as that shown in FIGS. 12 and 13, for example, acting as a secondary seal in embodiments of assemblies having such an inner sealing ridge 174.

FIGS. 15-18 show another embodiment of a cap and container assembly according to the invention. The assembly 310 of FIGS. 15-18 is similar to that of FIGS. 12 and 13, and only the differences will be described in detail. Unless otherwise specified, the same reference numbers will be used to designate the same or analogous elements to the assembly of FIGS. 12 and 13, increased by 200.

As shown, the assembly 310 of FIGS. 15-18 has a substantially rectangular shape. The side wall 326 has a height H, which extends upward with respect to the assembly and perpendicular to the base 328. The base 328 has a width W running parallel to hinge 340 and a length L running perpendicular to hinge 340. The height H of the side wall 326 of this embodiment is substantially less than the width W and length L of the base 328, which can be advantageous for transport and storage of the assembly 310, for example in the pocket of a user. The width W is longer than the length L in the embodiment of FIGS. 15-18, giving the assembly 310 a substantially rectangular shape.

The embodiment of FIGS. 15-18 includes a front guard wall 333. The front guard wall 333 extends in a substantially perpendicular and downward direction from an outer edge of the top wall 331, similarly to the skirt 33, 133 of the previously described embodiments, but only along the front side 314 of top wall 331, opposite hinge 340, and part way along the sides 314A, 314B, towards the rear 316 of the assembly 310. Guard wall 333 defines openings 371A, 371B that receive container buttons 370A, 370B to retain the assembly 310 in a closed position, as described in detail below. In other embodiments of the invention, an assembly such as that shown in FIGS. 15-18 could be provided with a skirt that extends around the entire perimeter of the top wall 331.

Figure 16:
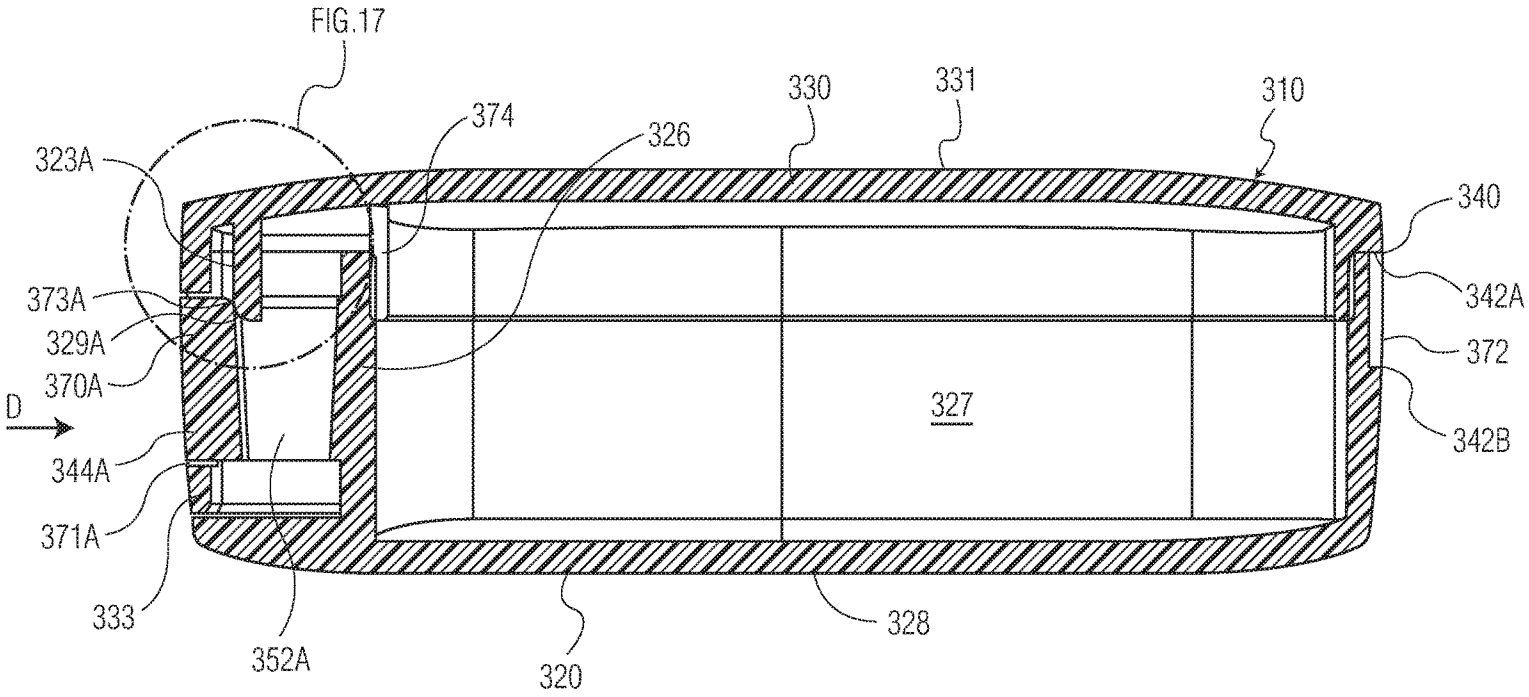
FIG. 16 is a cross section taken along line 16-16 of FIG. 15.

Referring in particular to FIG. 16, the hinge 340 of this embodiment is a double hinge. A hinge strip 372 is formed between the cap 330 and an upper edge of side wall 326. Specifically, an upper edge of hinge strip 372 joins with cap 330 to form a first bending line 342A, and a lower edge of hinge strip 372 joins with side wall 326 to form a second bending line 342B. First bending line 342A pivotally affixes the cap 330 with the hinge strip 372, and second bending line 342B pivotally affixes the container 320 with the hinge strip 372. First and second bending lines 342A, 342B can be formed as recesses, such as the recess 42 in the embodiment of FIGS. 1-5. Alternatively, first and second bending lines 342A, 342B could be formed as mechanical hinges, or by other means of forming hinges known in the art. The inclusion of two bending lines between the cap 330 and container 320 allows for greater mobility in pivoting between the two elements.

The embodiment of FIGS. 15-18 further includes an inner sealing ridge 374 extending downward from a lower surface of top wall 331. The inner sealing ridge 374, may take on a similar configuration to that of the sealing ridge shown in and described with respect to FIGS. 6 and 7, as well as other configurations known in the art, such as those disclosed in U.S. Pat. No. 7,537,137, 7,213,720 or 8,528,778, each of which is incorporated herein by reference as if fully set forth.

Figure 15:
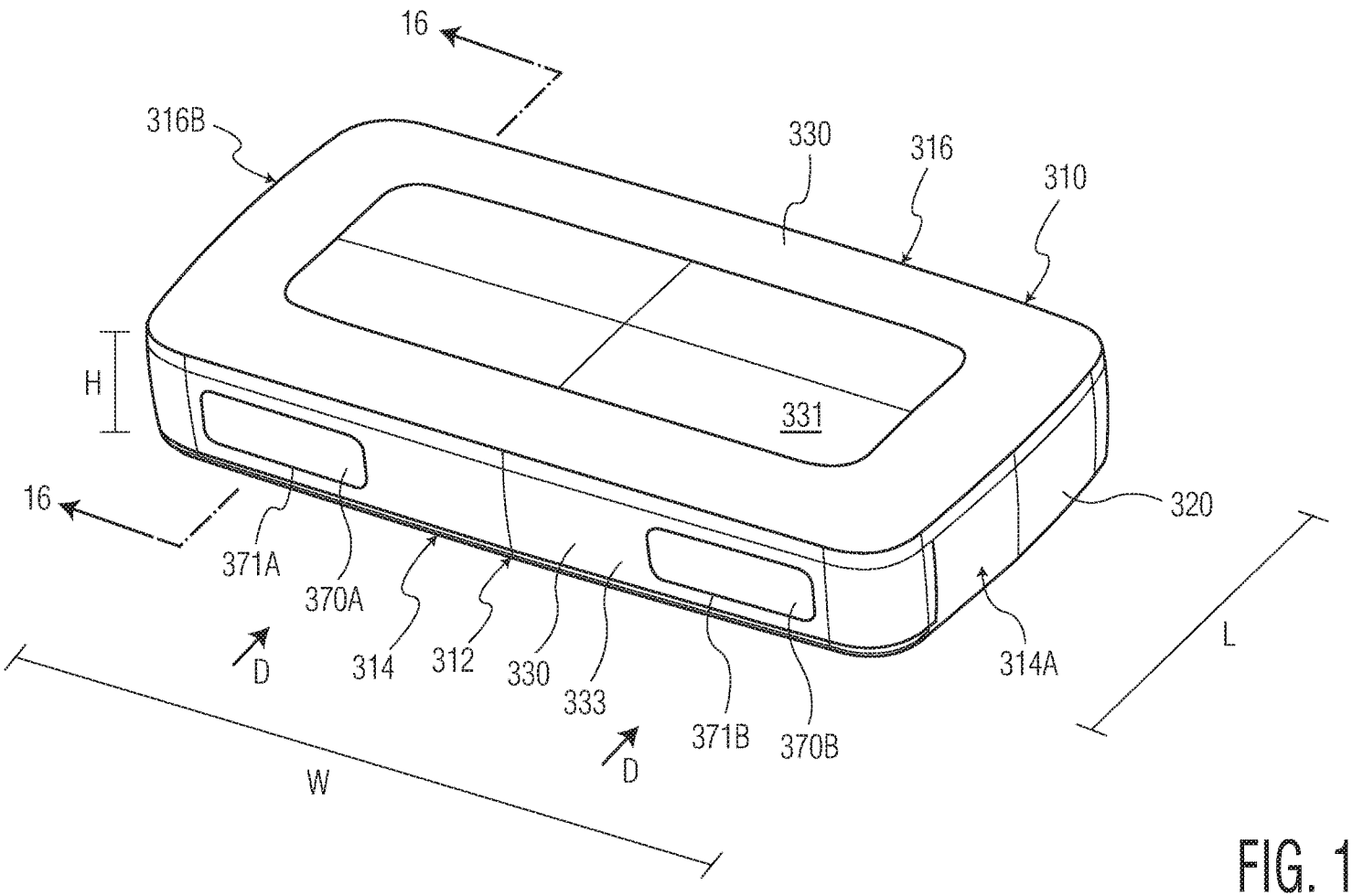
FIG. 15 is a front perspective view of another embodiment of a cap and container assembly according to the invention, in a closed position.
Figure 17:
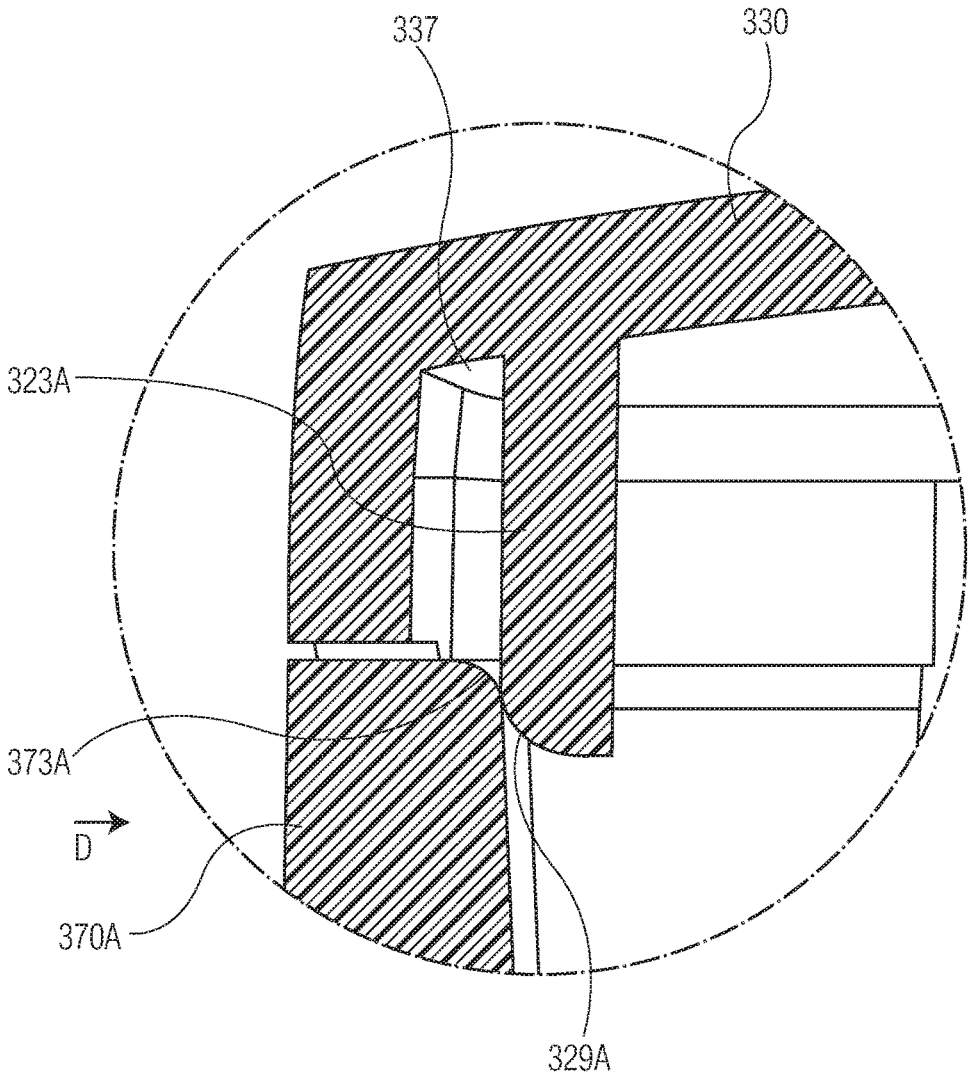
FIG. 17 is an enlarged detail of FIG. 16.
Figure 18:
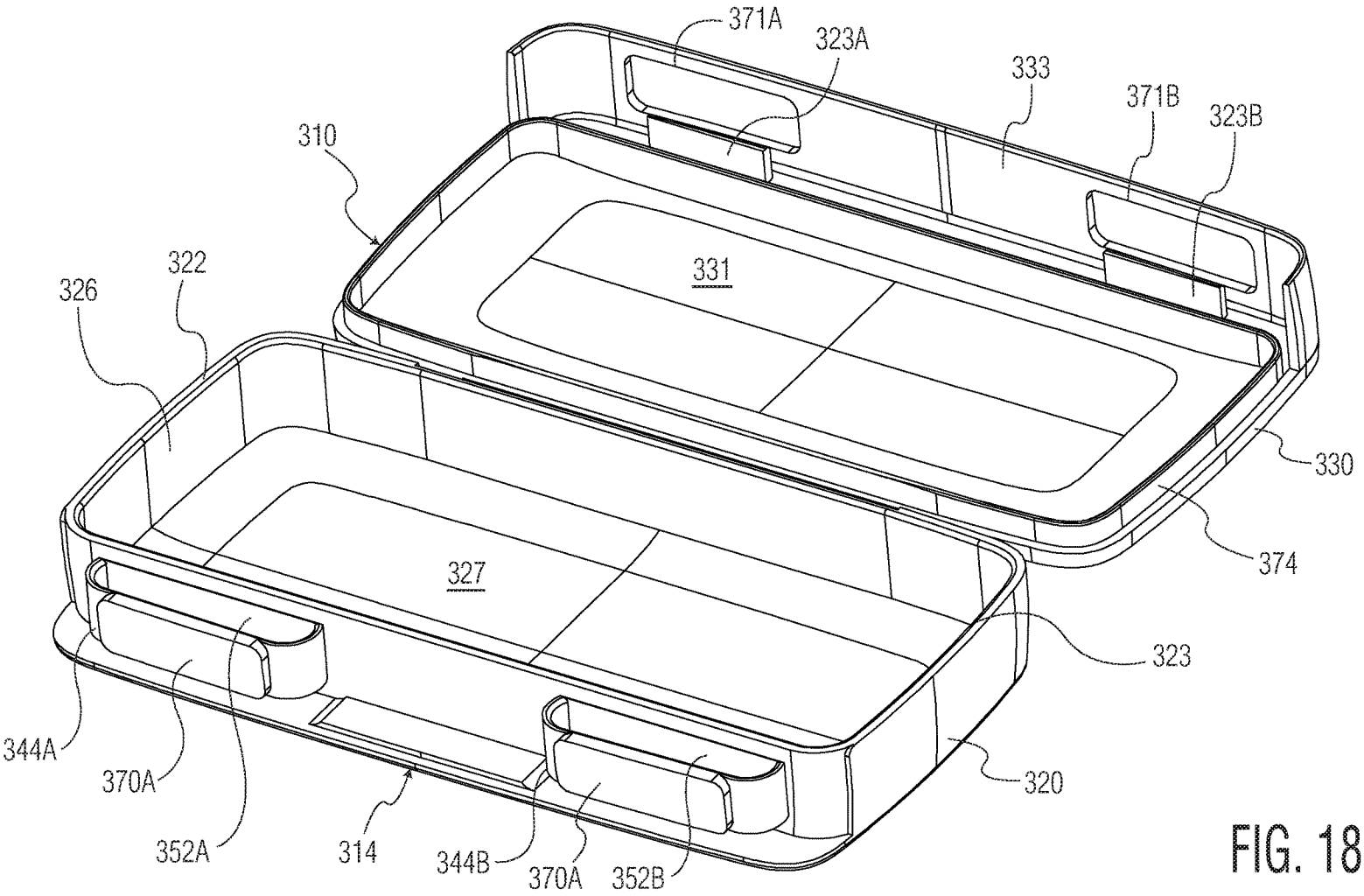
FIG. 18 is a front perspective view of the assembly of FIG. 15, in an opened position.

Two openings 371A, 371B are formed in the guard wall 333, along the front side 312 of the assembly. As shown in FIGS. 16-18, two spacers 344A, 344B extend out from the container side wall 326 along the front side 312 of the assembly 310, at locations in alignment with the openings 371A, 371B. Buttons 370A, 370B are formed on the front sides of spacers 344A, 344B. As shown in FIGS. 15-17, buttons 370B, 370B extend into openings 371A, 371B when the assembly 310 is in the closed position, to prevent the cap 330 from moving from its position over the opening 322, to maintain the assembly 310 in the closed position. The spacers 344A, 344B are in the locked positions in such a configuration.

In order to open the assembly 310, a sufficient force is applied to both of the spacers 344A, 344B in inward direction D of the assembly, so as to displace the buttons 370A, 370B from within the openings 371A, 371B, placing the spacers 344A, 344B in the unlocked positions. The cap 330 can then be pivoted with respect to the container 320 to move the assembly 310 from the closed position to the opened position.

Two spacers 344A, 344B having buttons 370A, 370B and associated openings 371A, 371B are provided in the illustrated embodiment. Such a configuration is advantageous because it requires a user to simultaneously apply sufficient force to both spacers 344A, 344B in order to unlock and in turn open the assembly, yet can easily be performed by adults by using two hands to open the assembly, for example by gripping the assembly 310 lengthwise using both hands and depressing both buttons 370A, 370B simultaneously using both thumbs. In other embodiments, more than two, as well as a single spacer 344 and button 370 with an associated opening could be provided, and the invention should not be viewed as limited to a specific number of spacers 344, buttons 370 or openings.

Referring to FIGS. 16-18 in particular, guide strips 323A, 323B extend downward from the bottom surface of cap top wall 331 at locations behind openings 371A, 371B. As shown in FIGS. 16 and 17, guide strips 323A, 323B include ramps 329A, 329B facing outward with respect to the assembly and located at the bottom edges of guide strips 323A, 323B. Ramps 329A, 329B have curved surfaces, which curve outward between the front and bottom surfaces of guide strips 323A, 323B. In other embodiments, the ramps 329A, 329B could have inclined flat surfaces. Ramps 329A, 329B extend downward to vertical positions just lower than the upper edges of buttons 370A, 370B when the assembly 310 is in the closed position. Buttons 370A, 370B have button ramps 373A, 373B which face guide strip ramps 329A, 329B when the assembly 310 is in the closed and locked position. In particular, button ramps 373A, 373B have curved surfaces, which curve outward between the rear and top surfaces of buttons 370A, 370B. Button ramps 370A, 370B contact corresponding guide strip ramps 329A, 329B when the assembly is in the closed position in the illustrated embodiment, but button ramps 370A, 370B and guide strip ramps 329A, 329B could also be displaced from each other.

Button ramps 370A, 370B and corresponding guide strip ramps 329A, 329B contact each other when the buttons 370A, 370B are displaced inward in direction D, to move the spacers 344A, 344B into the unlocked positions. As buttons 370A, 370B move in direction D, button ramps 373A, 373B contact guide strip ramps 329A, 329B, to drive guide strips 323A, 323B and in turn the entire cap 330 upward, away from the container 320, moving the assembly into the opened position. The curved surfaces of button ramps 373A, 373B and guide strip ramps 329A, 329B facilitate smooth gliding between the buttons 370A, 370B and guide strips 323A, 323B during this transition.

FIGS. 19-22 show another embodiment of a cap and container assembly 410 according to the invention. The assembly 410 of FIGS. 19-22 is similar to that of FIGS. 15-18, and only the differences will be described in detail. Unless otherwise specified, the same reference numbers will be used to designate the same or analogous elements to the assembly of FIGS. 15-18, increased by 100.

Figure 19:
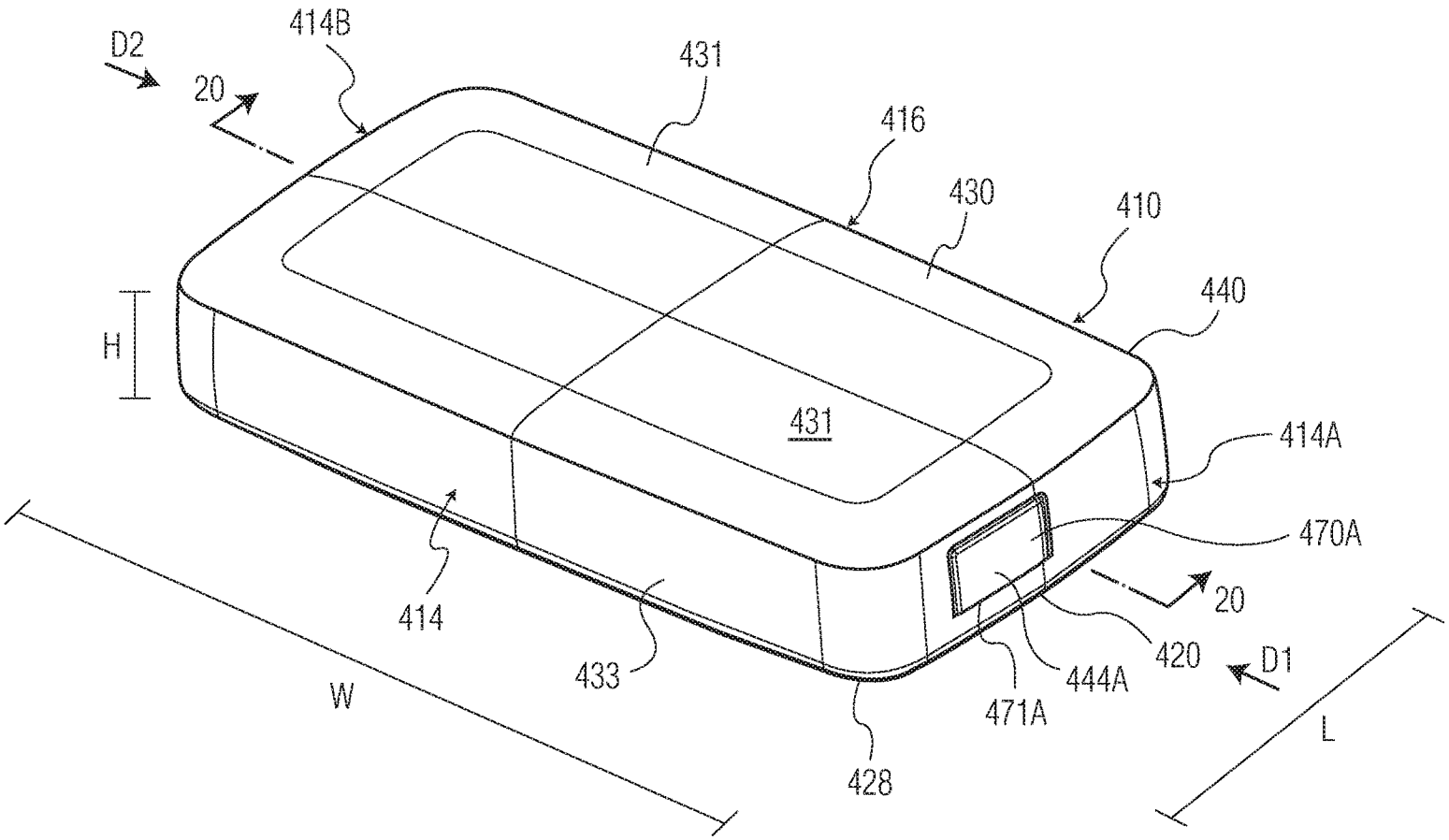
FIG. 19 is a front perspective view of another embodiment of a cap and container assembly according to the invention, in a closed position.
Figure 20:
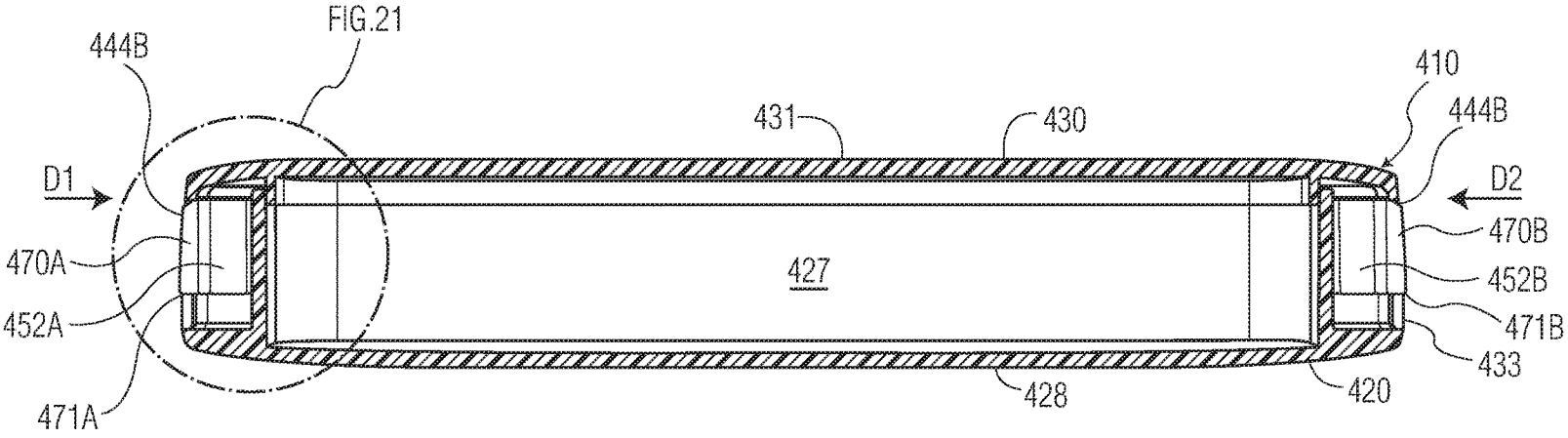
FIG. 20 is a cross section taken along line 20-20 of FIG. 19.
Figure 21:
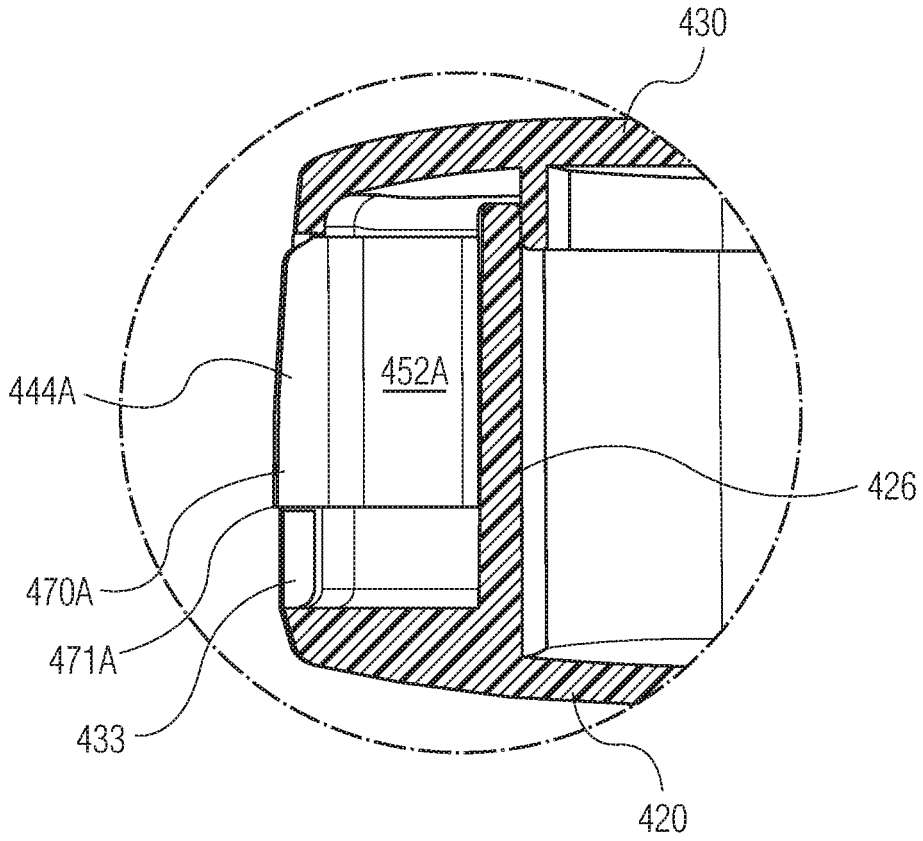
FIG. 21 is an enlarged detail of FIG. 20.
Figure 22:
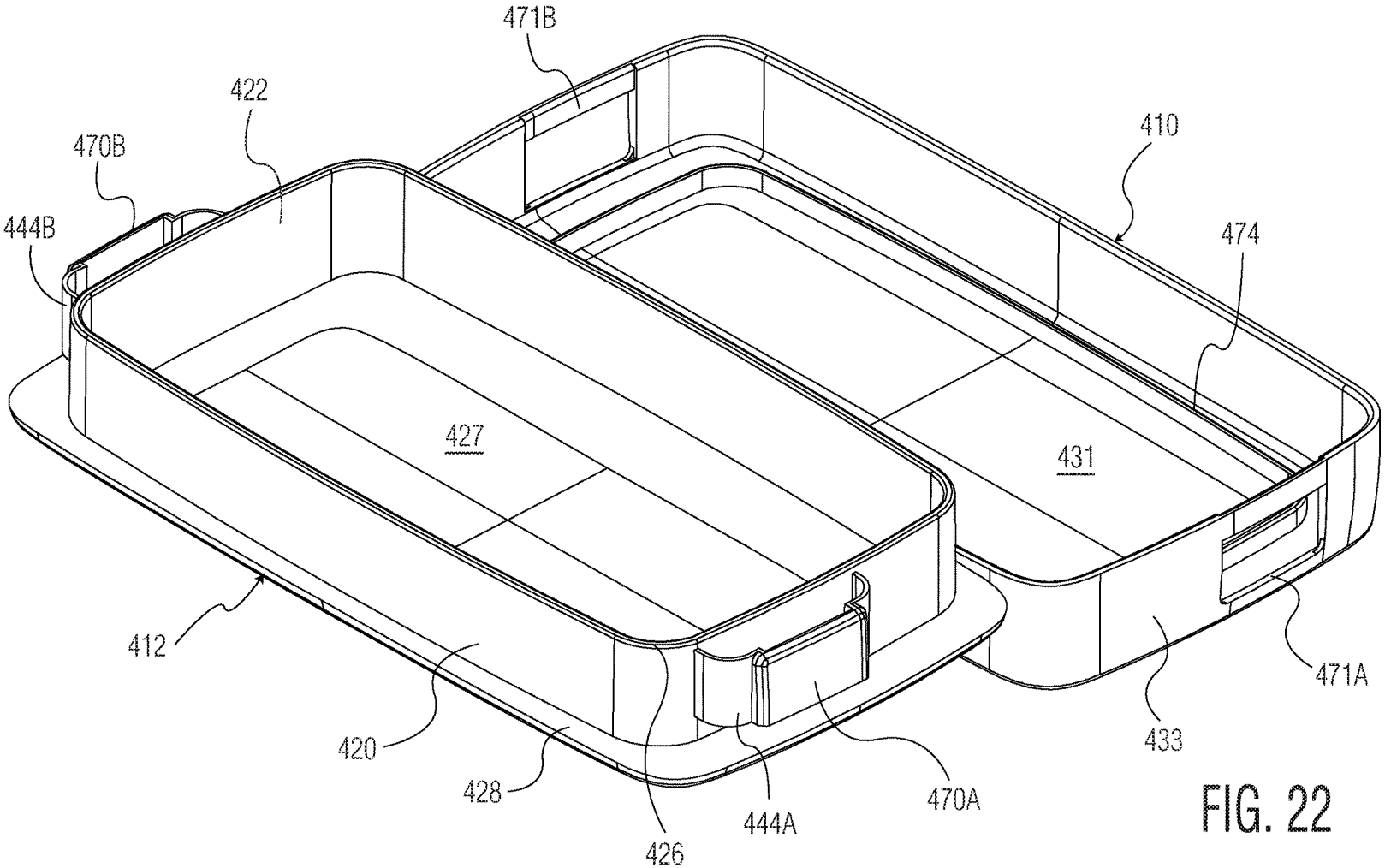
FIG. 22 is a front perspective view of the container of FIG. 20, in an opened position.

The assembly 410 of FIGS. 19-22 includes a skirt 433 extending downward from and substantially perpendicular to the cap top wall 430. The skirt 433 surrounds the entire perimeter of the top wall 431, and functions similarly to the guard wall 333 of the previously described embodiment, and may be considered a guard wall that extends around the entire perimeter of the top wall 341. When the assembly 430 is in the closed position, as shown in FIG. 19, the bottom edge of skirt 433 sits on an upper surface of container base 428.

Spacers 444A, 444B protrude from opposite sides of side wall 426 in the embodiment of FIGS. 19-22. Accordingly, openings 471A, 471B are formed on opposite sides of skirt 433, in alignment with buttons 470A, 470B. Buttons 470A, 470B are retained within openings 471A, 471B when the assembly 410 is in the closed position. In order to move the assembly into the opened position, buttons 470A, 470B are depressed inward with respect to the assembly 410, towards each other, in directions D1 and D2, to displace buttons 470A, 470A from within openings 471A, 471B, so that the cap 430 can be displaced from the container 420 to move the assembly 410 into the opened position.

The placement of buttons 470A, 470B on opposite sides of the assembly 410 allows a user to open the assembly 410 using a single hand, by, for example, simultaneously depressing the buttons 470A, 470B using the thumb and forefinger. The width W of the assembly 410 may be selected to permit a typical user to grasp the assembly 410 with a single hand while placing the thumb and forefinger over opposite buttons 470A, 470B in this manner FIGS. 23-26 show another embodiment of a cap and container assembly 510 according to the invention. The assembly of FIGS. 23-26 is similar to that of FIGS. 12 and 13, and only the differences will be described in detail. Unless otherwise specified, the same reference numbers as those used in FIGS. 12 and 13 shall be used to designate the same or analogous elements, increased by 100.

In the embodiment of FIGS. 23-26, the cap 530 and container 520 both have substantially square shapes. The side wall 526 has a height H, which extends upward with respect to the assembly and perpendicular to the base 528. The base 528 has a width W running parallel to hinge 540 and a length L running perpendicular to hinge 540. The height H of the side wall 526 of this embodiment is substantially less the width W and length L of the base 528, which can be advantageous for transport and storage of the assembly 510, for example in the pocket of a user. The width W and the length L are substantially equal in the embodiment of FIGS. 23-26, giving the assembly 510 a substantially square shape. The front side 514 of this embodiment of the assembly 510 has an outwardly bowed extension.

Figure 24:
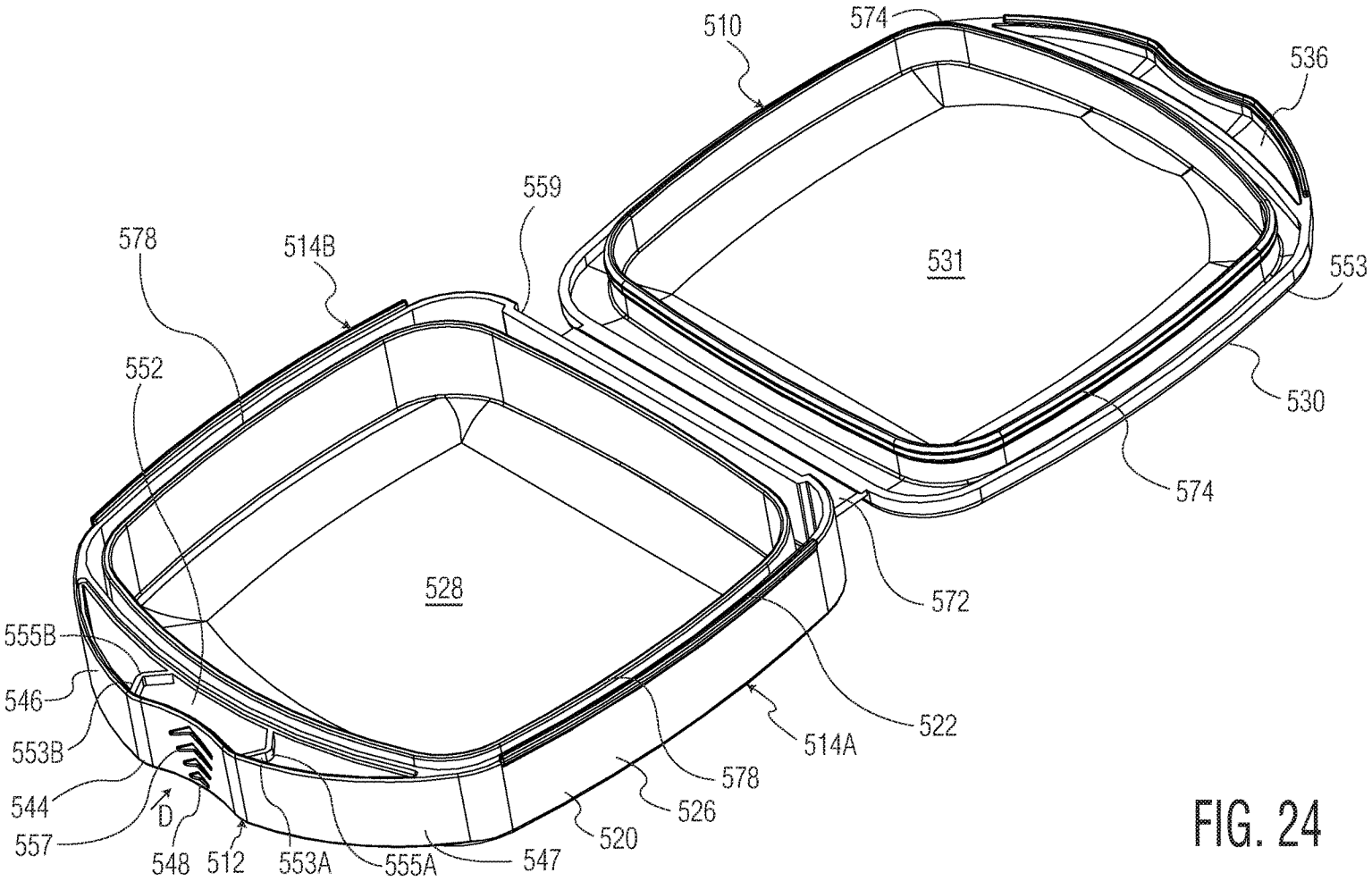
FIG. 24 is a front perspective view of the assembly of FIG. 23, in an opened position.
Figure 25:
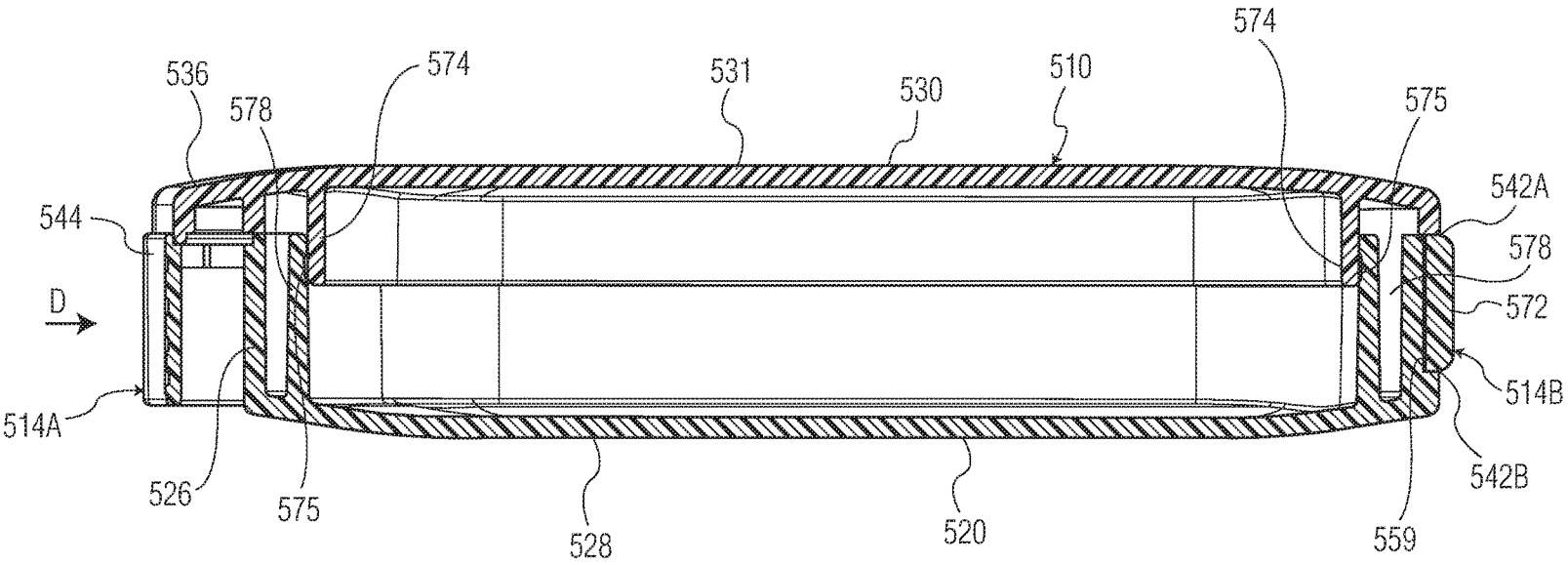
FIG. 25 is a cross section taken along FIG. 25-25 of FIG. 23.
Figure 26:
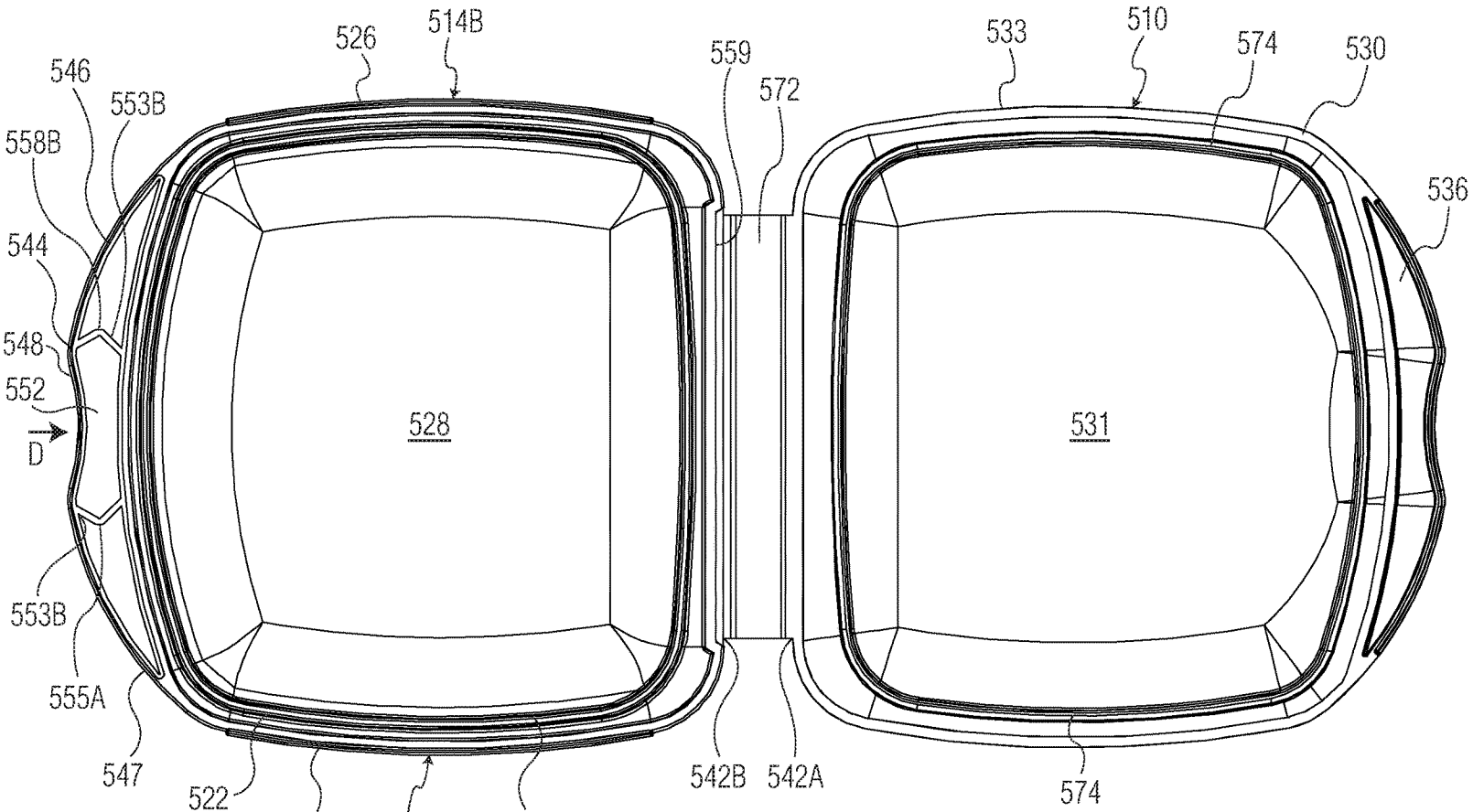
FIG. 26 is a top plan view of the container of FIG. 23, in an opened position.
Figure 27:
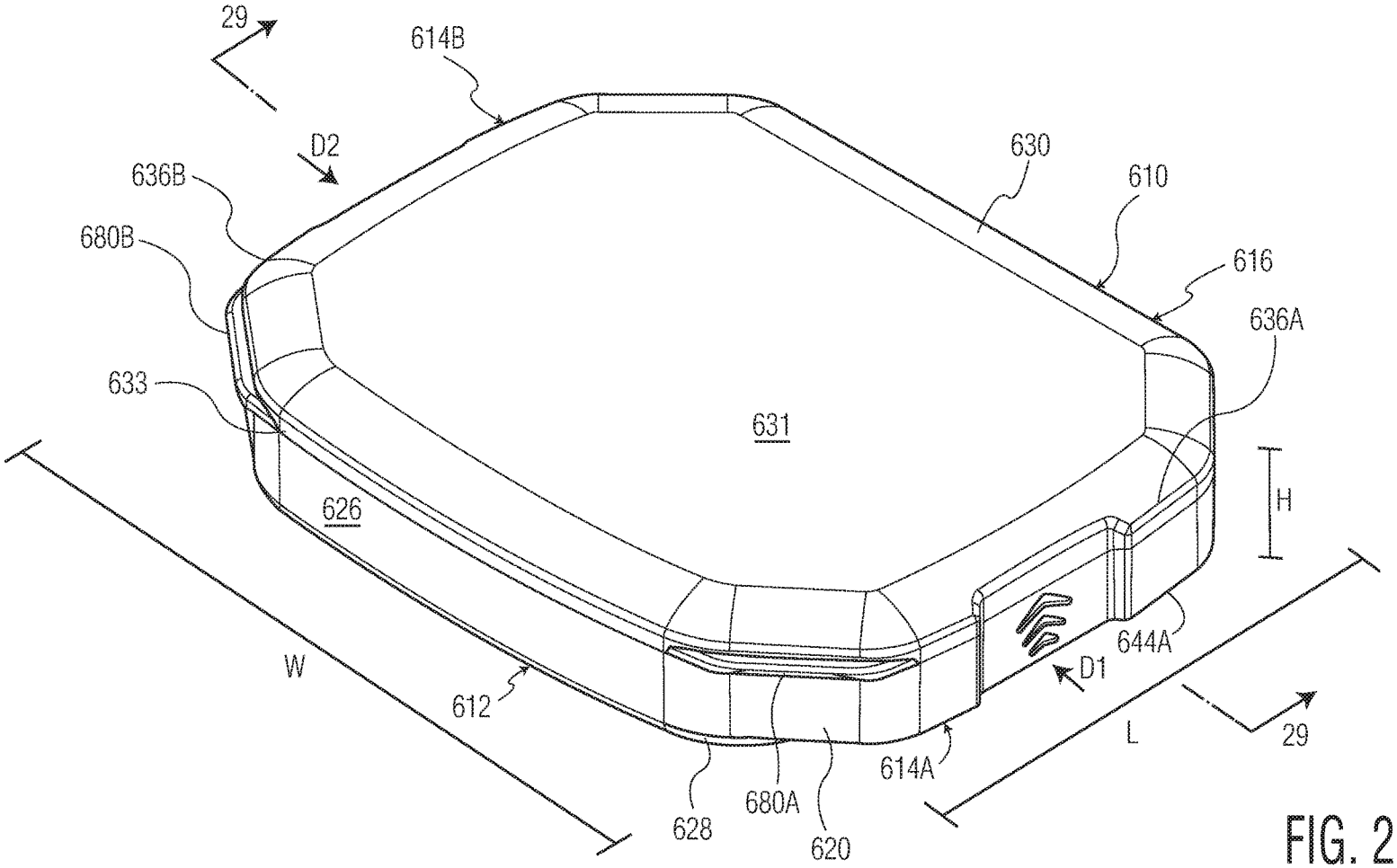
FIG. 27 is a front perspective view of another embodiment of a cap and container assembly according to the invention, in a closed position.

Referring to FIGS. 24-26, this embodiment further comprises an inner lip 578. The inner lip 578 extends upward from a top surface of the base 528 and is radially inwardly disposed with respect to the side wall 526. In use, products housed within the container would sit on the top surface of the base 528 within the inner lip 578.

The embodiment of FIGS. 23-26 further includes an inner sealing ridge 574. The inner sealing ridge 574 is radially inwardly disposed with respect to the skirt 533 and extends downward from a bottom surface of the top wall 531. Referring in particular to FIG. 25, the inner sealing ridge 574 engages the inner lip 578 of the container 520 when the assembly 510 is in the closed position. As shown, an outer surface of the inner sealing ridge 574 abuts an inner surface of the inner lip 578, and may form a substantially moisture-tight seal therebetween. The inner sealing ridge 574 may include a sealing bead 575, formed as a projection on the outer surface thereof, in order to ensure sufficient contact between the inner sealing ridge 574 and the inner lip 578 to form such a moisture-tight seal. The inner sealing ridge 574 can take on any of the configurations previously described herein, as well as other configurations known in the art, such as those disclosed in U.S. Pat. Nos. 7,537,137, 7,213,720 or 8,528,778, each of which is incorporated herein by reference as if fully set forth.

Figure 23:
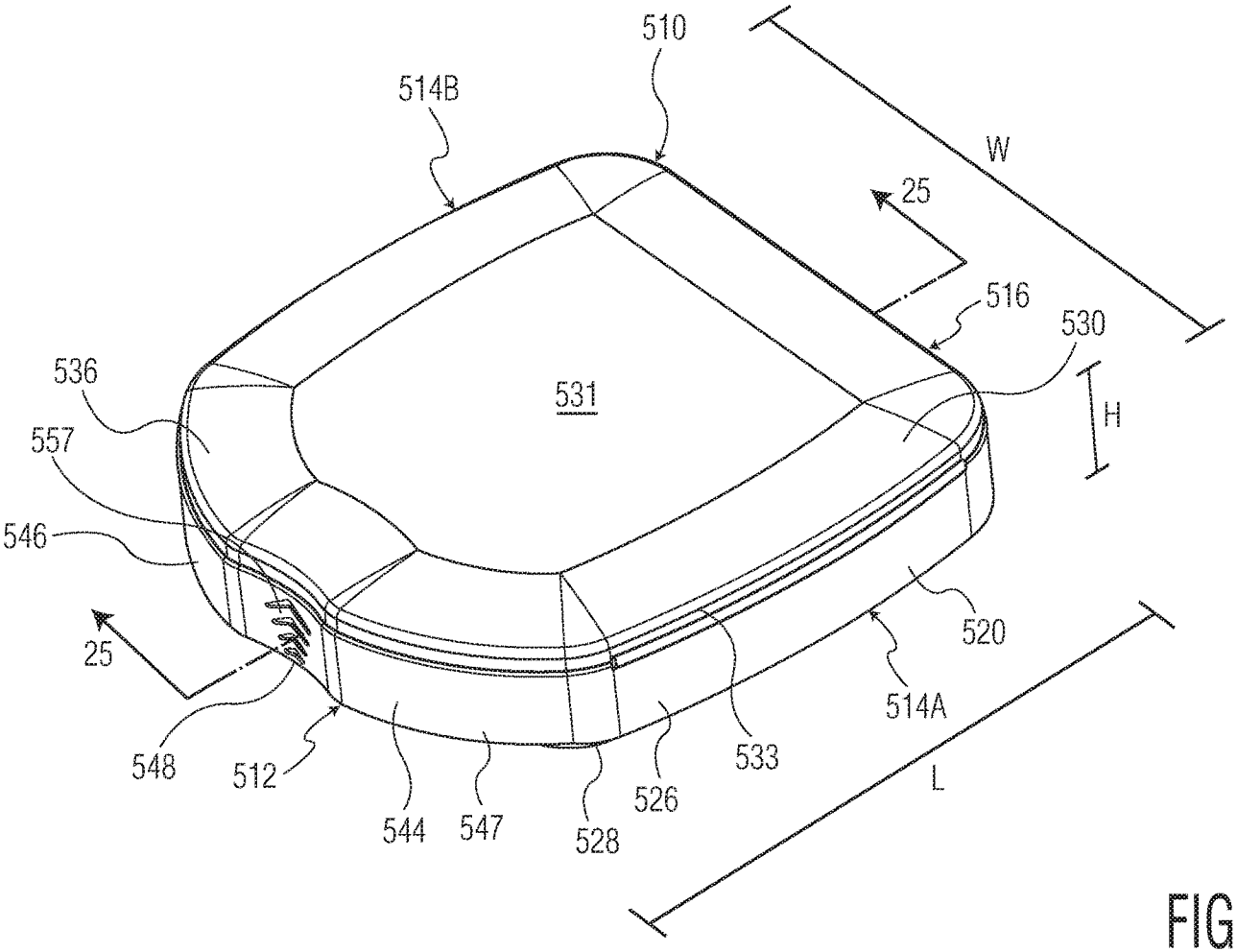
FIG. 23 is a front perspective view of another embodiment of a cap and container assembly according to the invention, in a closed position.

The embodiment of FIGS. 23-26 includes a spacer 544 that must be depressed inward with a sufficient force in order to open the assembly 510. As shown in FIGS. 23, 24 and 26, the spacer 544 of this embodiment has a substantially three sided shape, including first side segment 546, second side segment 547, and front segment 548. First side segment 546 and second side segment 547 may be slightly outwardly curved, as shown in the illustrated embodiment. Front segment 548 may be slightly inwardly curved, as shown in the illustrated embodiment. Such a configuration creates a convenient indentation for a user's finger when applying sufficient force to move the spacer 544 from the locked to the unlocked configuration.

As shown in FIG. 23, the top wall 531 of the cap 530 may have a profile matching the inward and outward curvatures of the spacer segments 546, 547, 548, so that the top wall 531, and in particular the front portion, forming a tab 536 is substantially flush with the outer surface of the spacer 544. In other embodiments, the spacer 544 could extend further outward than the top wall 531. In either configuration, the spacer 544 blocks the bottom surface of 537 of tab 536.

Referring to FIGS. 24 and 26, springs 553 may be provided to bias the spacer 544 to the locked position. In the illustrated embodiment, two springs 553A, 553B are provided. The springs 553A, 553B may traverse spacer opening 552, between the spacer and the container side wall 526. In the illustrated embodiment, springs 553A, 553B comprise hinges 555A, 555B that permit bending of the springs 553A, 553B during depression of the spacer 544. Springs 553A, 553B of this configuration further serve to guide the front segment 548 of spacer 544 in direction D during movement of the spacer 544 from the locked to the unlocked position. Springs 553A, 553B can be, for example, made of a material that resists bending to a degree that requires application of a sufficient force in order to allow movement of front segment 548 in direction D, and which is resilient enough to return springs 553A, 553B and in turn spacer 544 to their original positions upon removal of the sufficient force.

A gripping surface 557 may be formed on an outer surface of spacer 544, on the front segment 548 in the illustrated embodiment, to facilitate gripping of a user's finger when moving the spacer 544 inward in direction D. In the illustrated embodiment, the gripping surface 557 comprises a plurality of ridges, though other means of forming a high friction surface known in the art could be employed as well.

The embodiment of FIGS. 23-26 includes a double hinge 540, similar to the double hinge of FIGS. 15-18, and including a hinge strip 572, first bending line 542A between hinge strip 572 and cap 530, and second bending line 542B between hinge strip 572 and base 520. In the embodiment of FIGS. 23-26, second bending line 542B is formed on a lower portion of side wall 526, rather than at the upper edge, as in the embodiment of FIGS. 15-18. Side wall 526 includes an indentation 559 located on the rear 516 of the assembly 510. When the assembly 510 is in the closed configuration, hinge strip 572 rests within the indentation 559, as shown in FIGS. 25 and 26.

FIGS. 27-30 show another embodiment of a cap and container assembly 610 according to the invention. The assembly 610 of FIGS. 27-30 is similar to that of FIGS. 23-26 and only the differences will be described in detail. Unless otherwise specified, the same reference numbers will be used to designate the same or analogous elements to the assembly of FIGS. 23-26, increased by 100.

Figure 28:
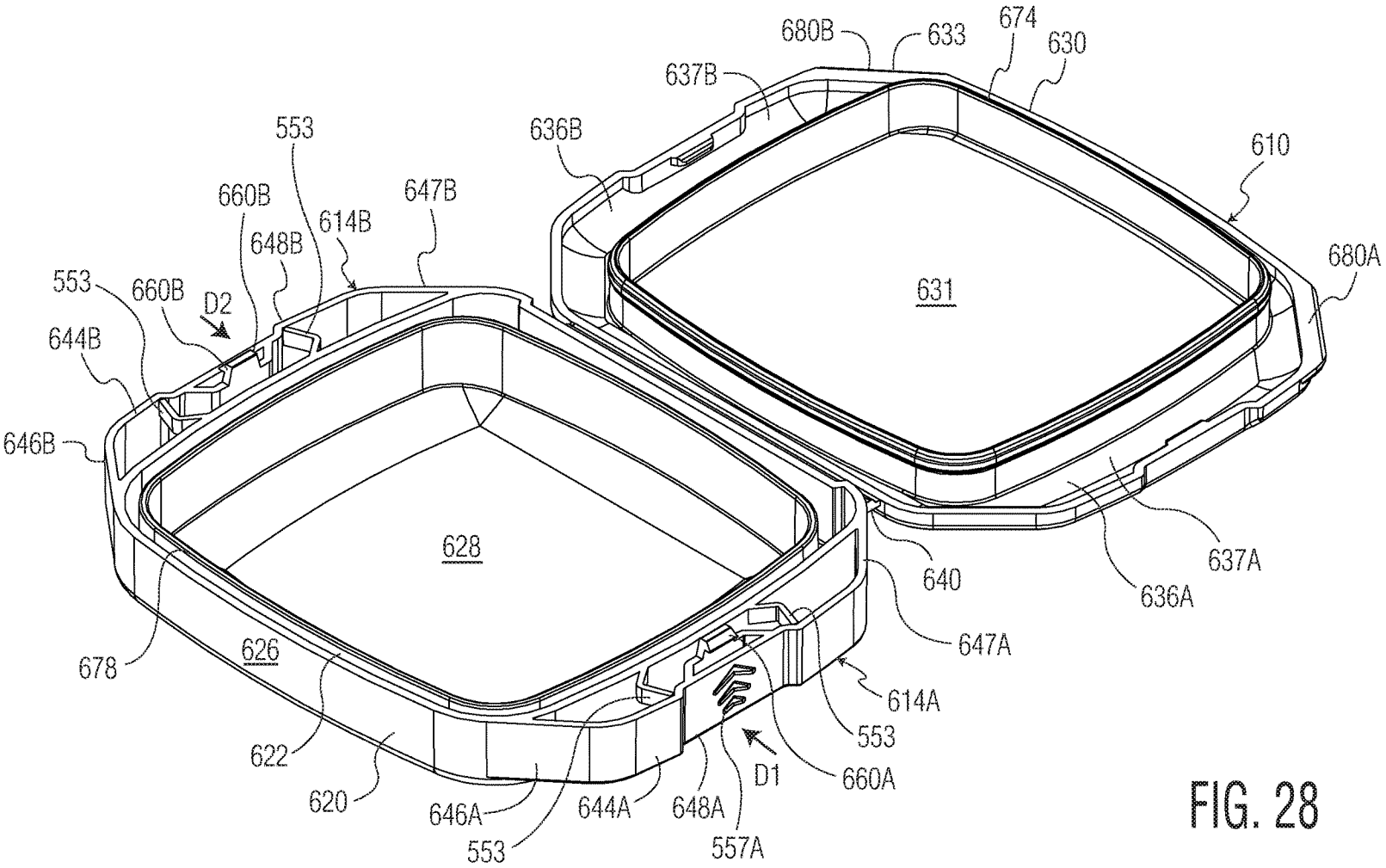
FIG. 28 is a front perspective view of the assembly of FIG. 27, in an opened position.
Figure 29:
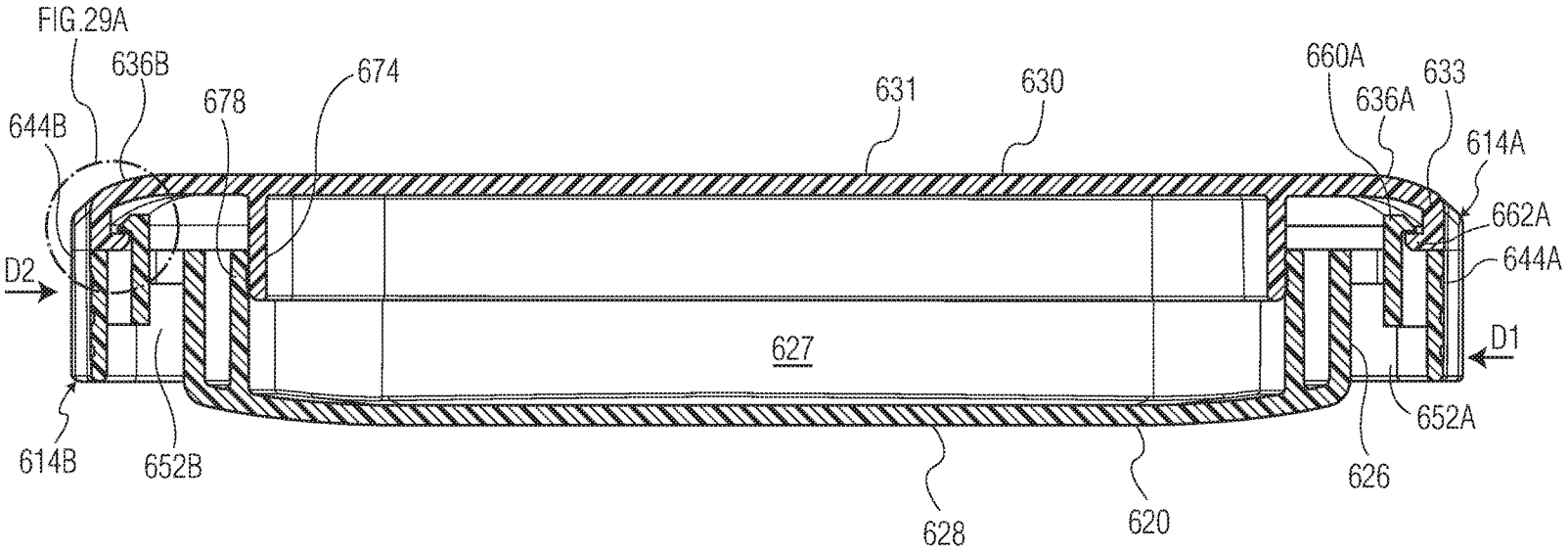
FIG. 29 is a cross section taken along line 29-29 of FIG. 27.
Figure 30:
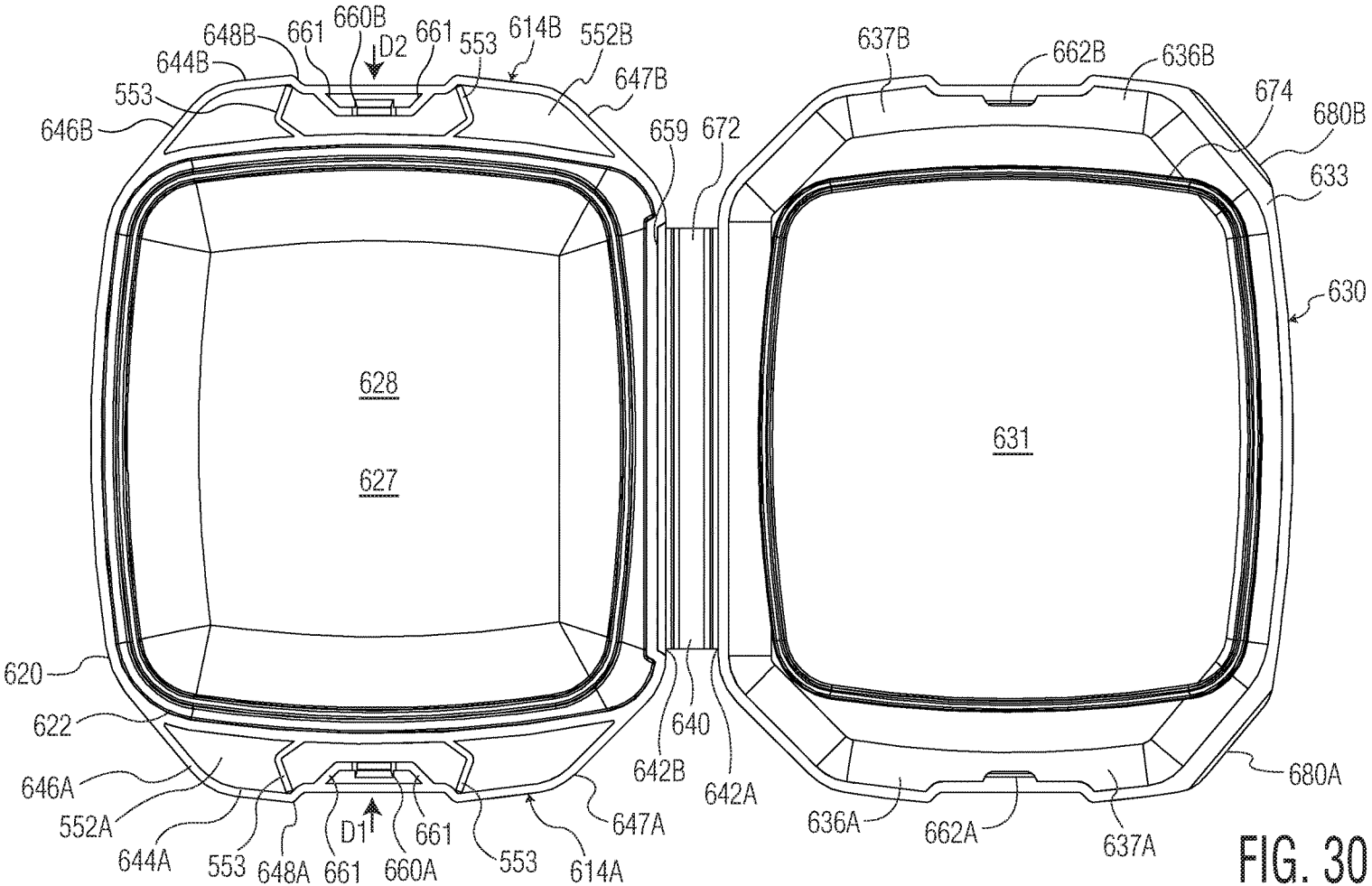
FIG. 30 is a top plan view of the assembly of FIG. 27, in an opened position.

The assembly of FIGS. 27-30 includes two spacers 644A, 644B, located on opposite sides 614A, 614B of the assembly 610. Referring in particular to FIGS. 28 and 30, the assembly has a generally rectangular configuration, with the height H being less than both the length L and width W, and the width W being greater than the length L. Side portions 636A, 636B of the cap top wall 631 function similarly to the front portion or tab 536 of FIGS. 23-26. In particular, the side portions 636A, 636B are located directly over spacers 644A, 644B and substantially flush therewith. In other embodiments, the side portions 636A, 636B could extend beyond spacers 644A, 644B. In either configuration, the lower surfaces 637A, 637B of side portions 636A, 636B are blocked by spacers 644A, 644B and generally inaccessible to a user of the assembly, when the spacers 644A, 644B are in the locked positions.

The spacers 644 of this embodiment include latches 660, and the cap side portions include catches 662 that engage the latches when the spacers 644 are in the locked positions, to help retain the assembly 610 in the closed position.

As shown, the latches 660A, 660B are formed as hooks that extend upwardly from the spacers 644A, 664B and in opposite outward directions with respect to the assembly 610. The latches 660A, 660B of the illustrated embodiment extend from within the spacer openings 652A, 652B, each being affixed therein to the spacer front segments 648A, 648B by a pair of supports 661 that extend into each of the openings 652A, 652B from an inner surface of the front segment 648. In other embodiments, the latches 660 could be affixed to other portions of the spacer 644. For example, the latches 660 could be formed integrally with any of the segments 646, 647, 648.

Figure 29A:
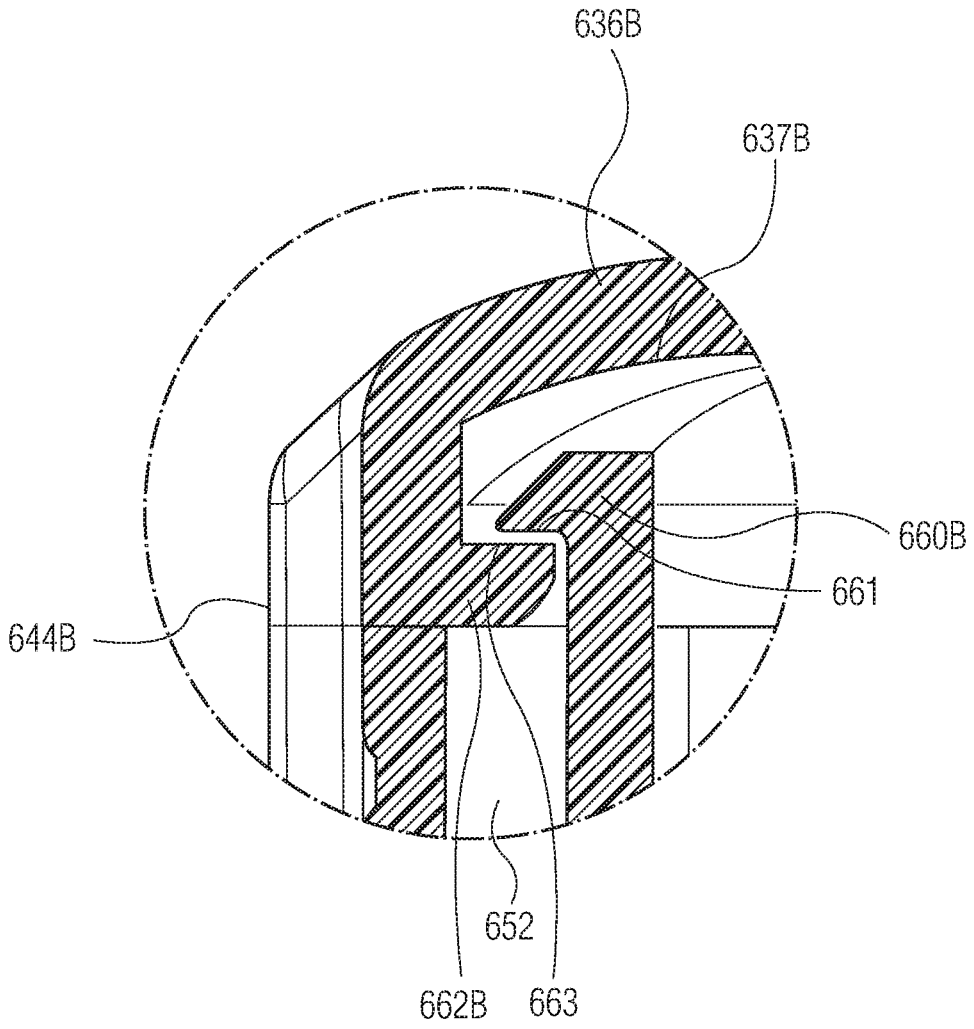
FIG. 29A is an enlarged detail of FIG. 29.

The catches 662A, 662B are formed as tabs that project in opposite inward directions of the assembly 610 from a lower edge of skirt 633. As shown in FIGS. 29 and 29A, when the assembly 610 is in the closed position and the spacers 644A, 644B are in the locked positions, each of the latches 660A, 660B hooks on to an associated one of the catches 662A, 662B, such that a top surface 663 of each catch 662A, 662B abuts a bottom surface 664 of each latch 660A, 660B, blocking the catch 662 and in turn the entire cap 630 from moving away from the container 620 in an upward direction, to help retain the assembly 610 in the closed position.

In order to open the assembly 610, a sufficient force is simultaneously applied to both spacers 644A, 644B in opposite inward directions D1, D2 of the assembly 610. When this occurs, latch 660 is displaced from catch 662, allowing catch 662 and the entire cap 630 to move freely away from the container 620, so that the assembly 610 can move to the opened position. While this is occurring, the lower tab surfaces 637A, 637B become exposed, due to the inward movement of spacers 644A, 644B, so that a user can apply pressure to thereto in order to drive the cap 630 away from the container 620.

The embodiment of FIGS. 27-30 may optionally include corner tabs 680A, 680B to facilitate opening of the assembly 610. Corner tabs 680A, 680B may extend outwardly from the corners of the cap 660, for example at the region at which the front of cap 630 joins the side portions 636, and may optionally extend beyond spacers 644, as in the illustrated embodiment. A user may grip one or both of the corner tabs 680A, 680B and draw the cap 630 away from the container 620, after moving the spacers 644A, 644B to the unlocked positions, to move the assembly 610 into the opened position. Alternatively, tabs having a similar configuration to corner tabs 680A, 680B could be provided at other locations on the cap 630, a single tab could be provided, or the tabs could be omitted, and a user could utilize the lower surfaces 637A, 637B of side portions 636A, 636B to displace the cap 630 from the container 620 in opening the assembly 610.

The placement of spacers 644A, 644B on opposite sides of the assembly 610 allows a user to open the assembly 610 using a single hand, by, for example, simultaneously depressing the spacers 644A, 644B in directions D1 and D2 using the thumb and forefinger. The width W may be selected to permit a typical user to grasp the assembly 610 with a single hand while placing the thumb and forefinger over opposite spacers 644A, 644B in this manner FIGS. 31-34 show another embodiment of a cap and container assembly 710 according to the invention. The assembly of FIGS. 31-34 is similar to that of FIGS. 27-30 and only the differences will be described in detail. Unless otherwise specified, the same reference numbers will be used to designate the same or analogous elements to those of FIGS. 27-30, increased by 100.

Figure 32:
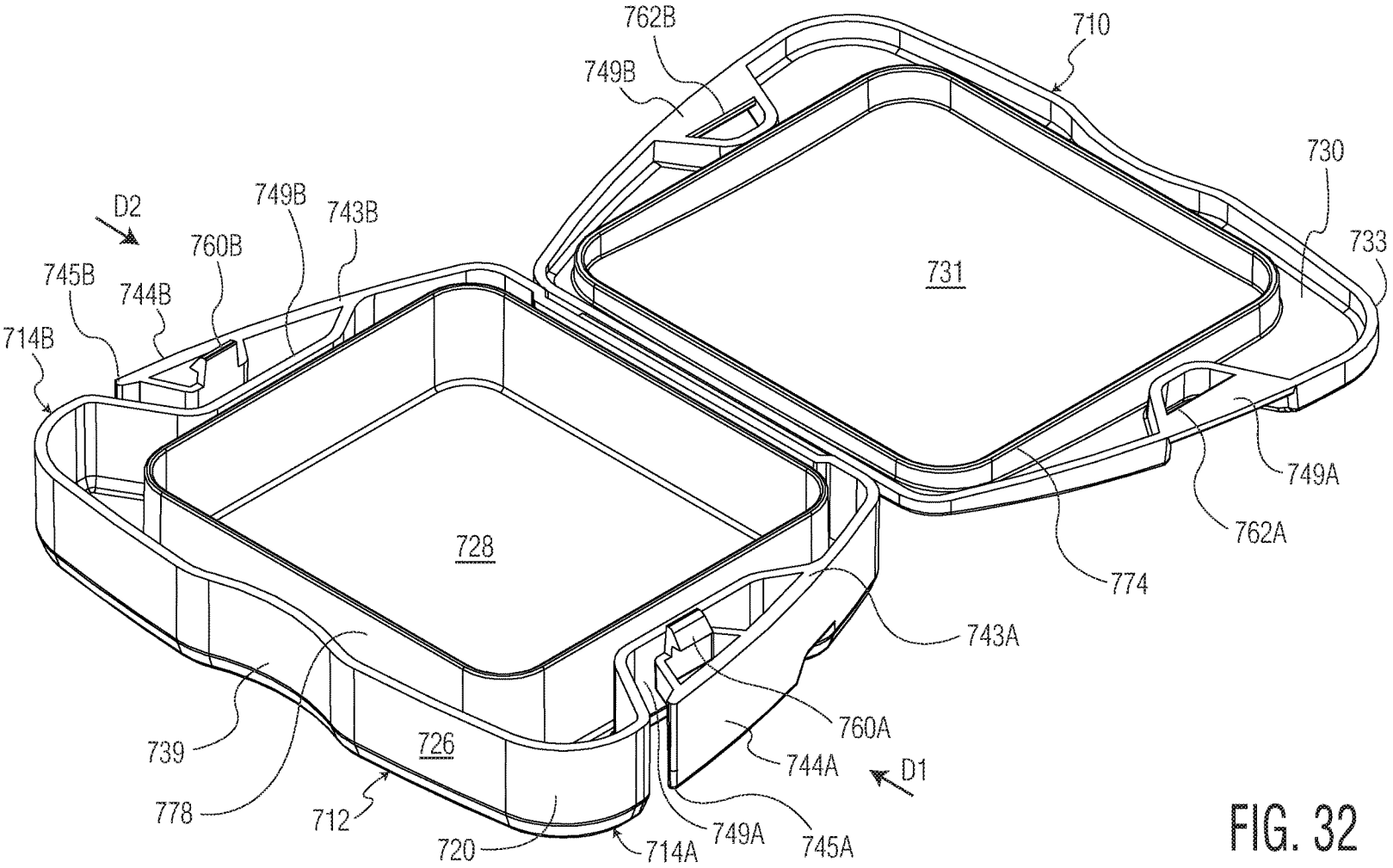
FIG. 32 is a front perspective view of the assembly of FIG. 31, in an opened position.
Figure 33:
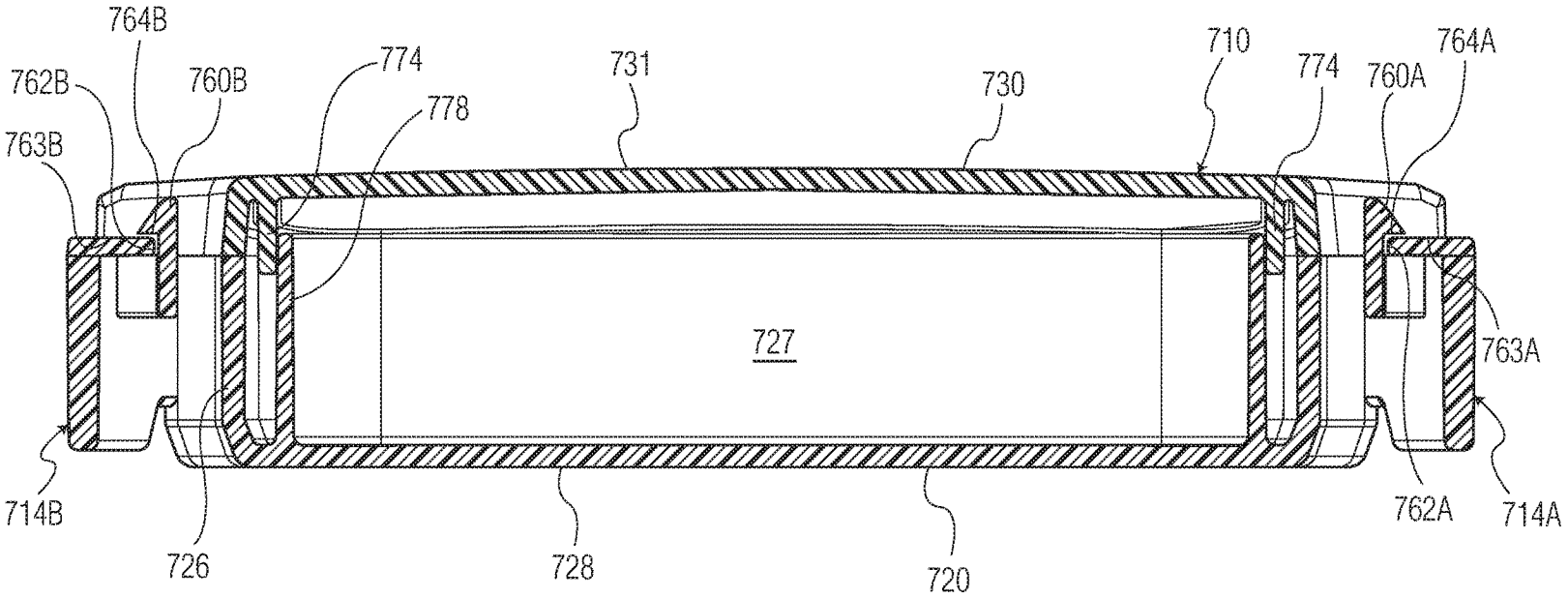
FIG. 33 is a cross section taken along line 33-33 of FIG. 31.

The container 720 of this embodiment includes an inner lip 778 and an inner sealing ridge 774. As shown in FIG. 33, the inner sealing ridge 774 of this embodiment sits outside of the inner lip 778, such that an inner surface of the inner lip 774 abuts an outer surface of the inner sealing ridge, and may form a moisture-tight seal therewith. Alternatively, this embodiment of the assembly 710 could be provided with any of the seal configurations previously described herein, and any other embodiment of the assembly could be provided with the seal arrangement shown in FIGS. 31-34.

Figure 34:
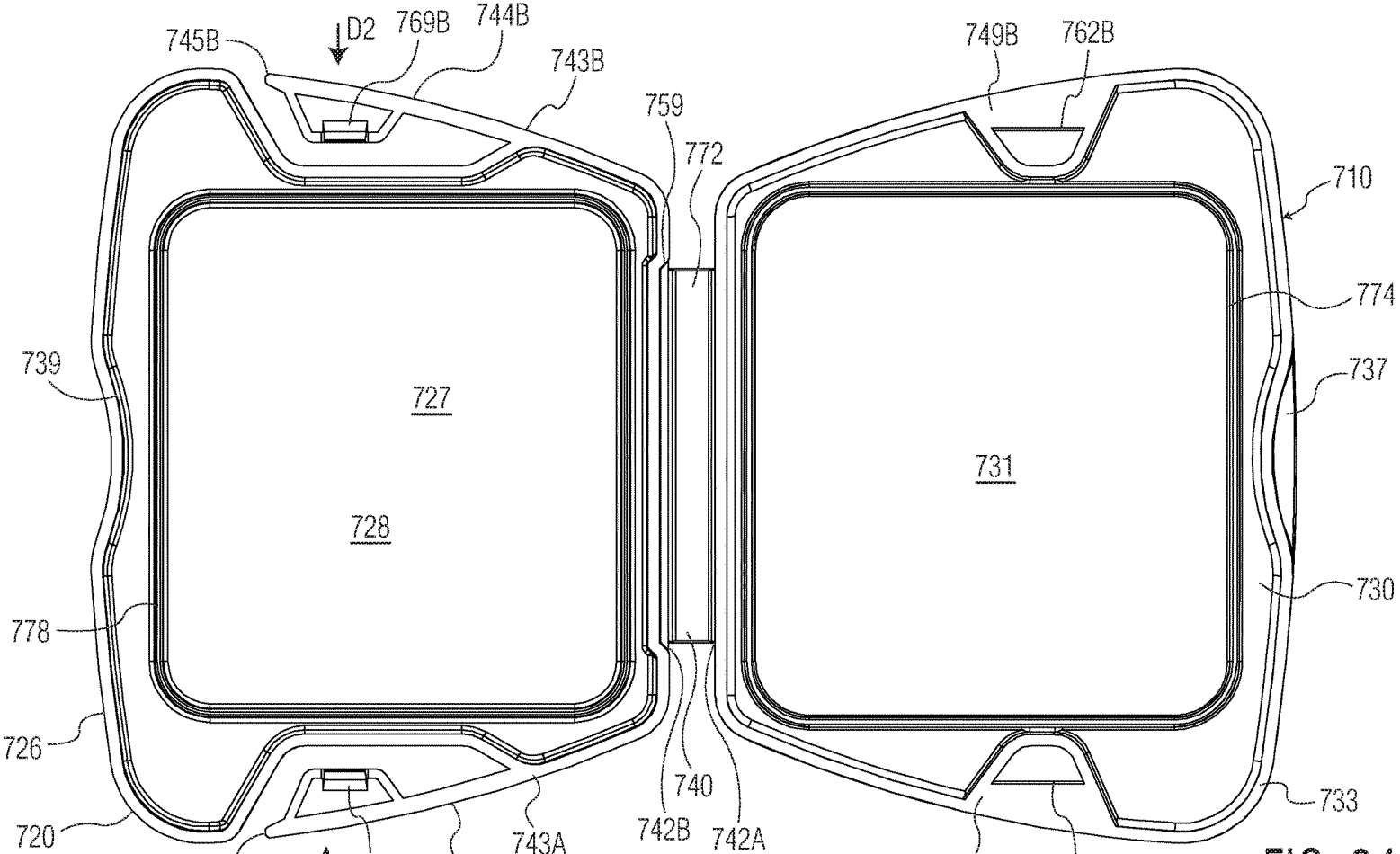
FIG. 34 is a top plan view of the assembly of FIG. 31.

The spacers 744A, 744B are located on opposite sides 714A, 714B of the assembly 710. As shown, the spacers 744A, 744B of this embodiment each have a first end 743 located towards the rear 716 of the assembly 710 and a second end 745 located towards the front 712 of the assembly 710. As best shown in FIGS. 32 and 34, the first end 743 is affixed to the side wall 726, while the second end 745 is detached from the side wall 726. As a result, the spacers 744A, 744B are formed as arms that extend from the sides 714A, 714B of the assembly 710. First ends 743A, 743B at which the spacers 744A, 744B are attached to the assembly 710 act as pivot points, such that the spacers 744A, 744B pivot inward about first ends 743, towards the assembly 710 in directions D1, D2 when a sufficient force is applied thereto.

The spacers 744A, 744B, as shown in FIGS. 31-34, do not include springs, but may be formed of a material having a sufficient degree of stiffness and resiliency so as to bias the spacers 744A, 744B to the unlocked positions so that they can only be moved inward in directions D1 and D2 upon application of a sufficient force. Alternatively, the spacers 744A, 744B of this embodiment could be provided with springs such as those shown in FIGS. 27-30.

Still referring to FIGS. 32 and 34, the side wall 726 includes side recessed portions 749A, 749B. Side recessed portions 749A, 749B extend inwards towards the center of the container 720 to accommodate spacers 744A, 744B. This allows spacers 744A, 744B to extend generally in alignment and flush with the sections of side wall 726 surrounding side recessed portions 749A, 749B.

In the illustrated embodiment, the edges forming the front 712 and rear 716 of the assembly 710 are parallel, while the edges forming sides 714A, 714B extend at angles away each other as they extend from the rear 716 to the front 712 of the assembly 710, such that the assembly 710 has a substantially trapezoidal shape. Accordingly, the spacers 744A, 744B extend at angles away from each other in the rear to frontward direction of the assembly 710, to match the extension of sides 714A, 714B. In other embodiments, the assembly 710 could take on other shapes, such as the square or rectangular shapes of the other embodiment described above.

The spacers 744A, 744B of this embodiment include latches 760A, 760B, which are similar in configuration to the latches 692 of FIGS. 27-30. The latches 760A, 760B of this embodiment engage apertures 762A, 762B formed in the cap 730. As shown, apertures 762A, 762B are formed within indented regions 769A, 769B of the cap top wall 731. Indented regions 769A, 769B are vertically aligned with spacers 744A, 744B and apertures 762A, 762B are vertically aligned with latches 760A, 760B when the assembly is in the closed position. As a result, latches 760A, 760B extend through and engage apertures 762A, 762B when the assembly 710 is in the closed position to help retain the cap 730 over the container 720. In particular, latches 760A, 760B hook into apertures 762A, 762B, such that a top surface 763 of the indented region 769 abuts a bottom surface 764 of each latch 760, preventing the cap 730 from moving away from the container 720 in an upward direction, to help retain the assembly 710 in the closed position.

Figure 31:
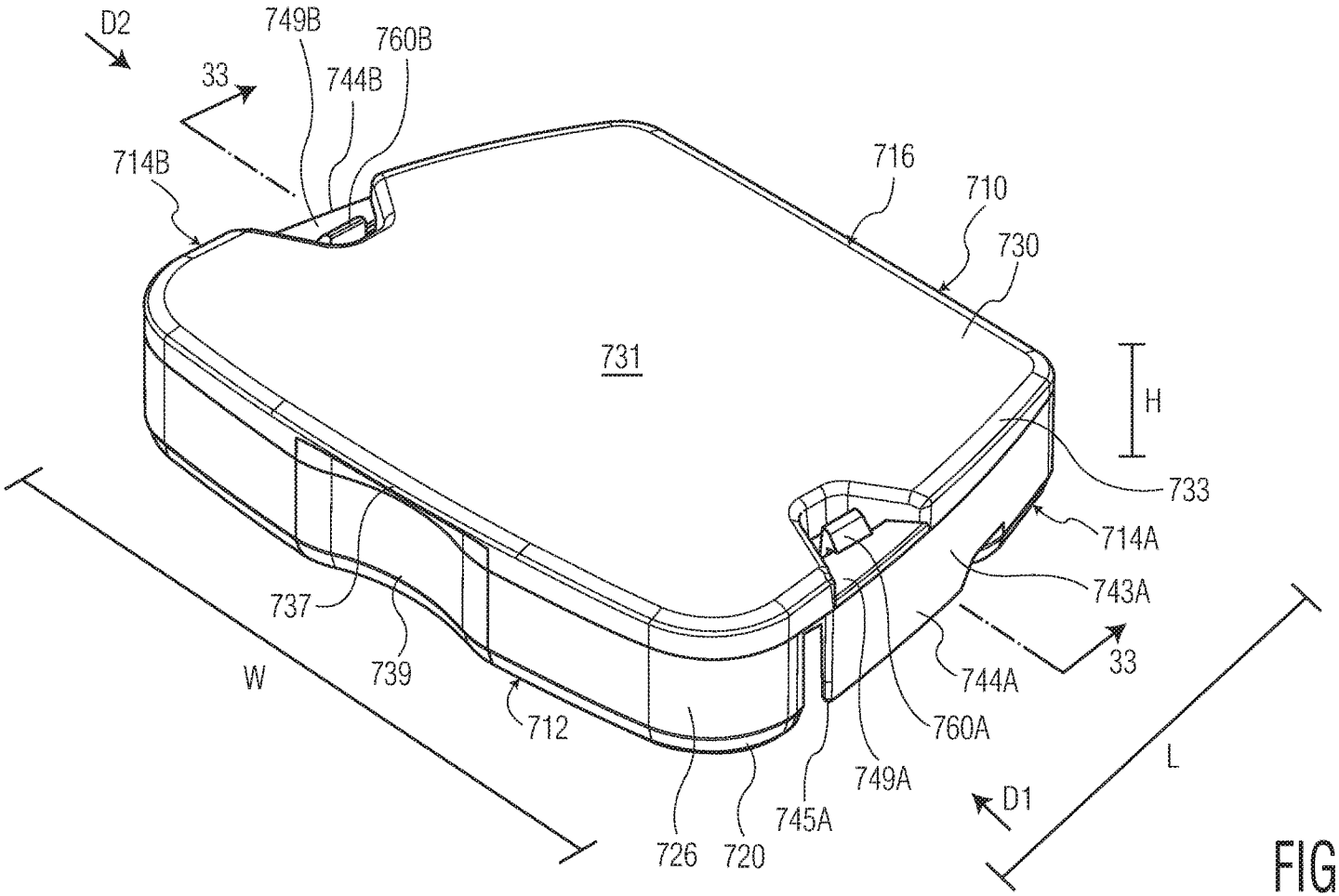
FIG. 31 is a front perspective view of another embodiment of a cap and container assembly according to the invention, in a closed position.

The side wall 726 of this embodiment further includes a front recessed portion 739. The front recessed portion 739, like the side recessed portions 749A, 749B, is formed as a portion of side wall 726 that dips inward, toward the center of the assembly 710. When the assembly 710 is in the closed position, as shown in FIG. 31, a portion of top wall 731 overlaps recessed portion 739, leaving a front area 737 of the bottom surface of the top wall exposed.

In order to open the assembly 710, a user applies sufficient force to the spacers 744A, 744B simultaneously in inward directions D1 and D2. This moves latches 760A, 760B inward within apertures 762A, 762B. Latches remain within apertures 762A, 762B during this process, due to the fact that apertures 762A, 762B have a greater extension in the width W direction of the assembly, but the inward movement of the latches 760A, 760B displaces bottom surfaces 764 of the latches from top surfaces 763 of indented regions 769A, 769B. The cap 730 can then be moved away from the container 720, and a user may use the portion of the cap 730 lower surface 737 that is exposed by front recess 739 in order to achieve this.

Another embodiment of a cap and container assembly 810 according to the invention is shown in FIGS. 35-39. The assembly 810 of this embodiment is similar to that of FIGS. 31-34 and only the differences will be described in detail. Unless otherwise specified, the same reference numbers will be used to designate the same or analogous elements to those of FIGS. 31-34, increased by 100.

This embodiment of the assembly 810 has a generally rectangular shape, with the width W, extending parallel to hinge 840 being greater than the length L, extending perpendicular to the hinge 840, and the height H, extending perpendicular to both the length L and width W being less than the length L and width W. It should be understood that this embodiment of the assembly could take on other shapes, such as a trapezoidal shape such as that of the embodiments of FIGS. 31-34, or a square shape.

Figure 35:
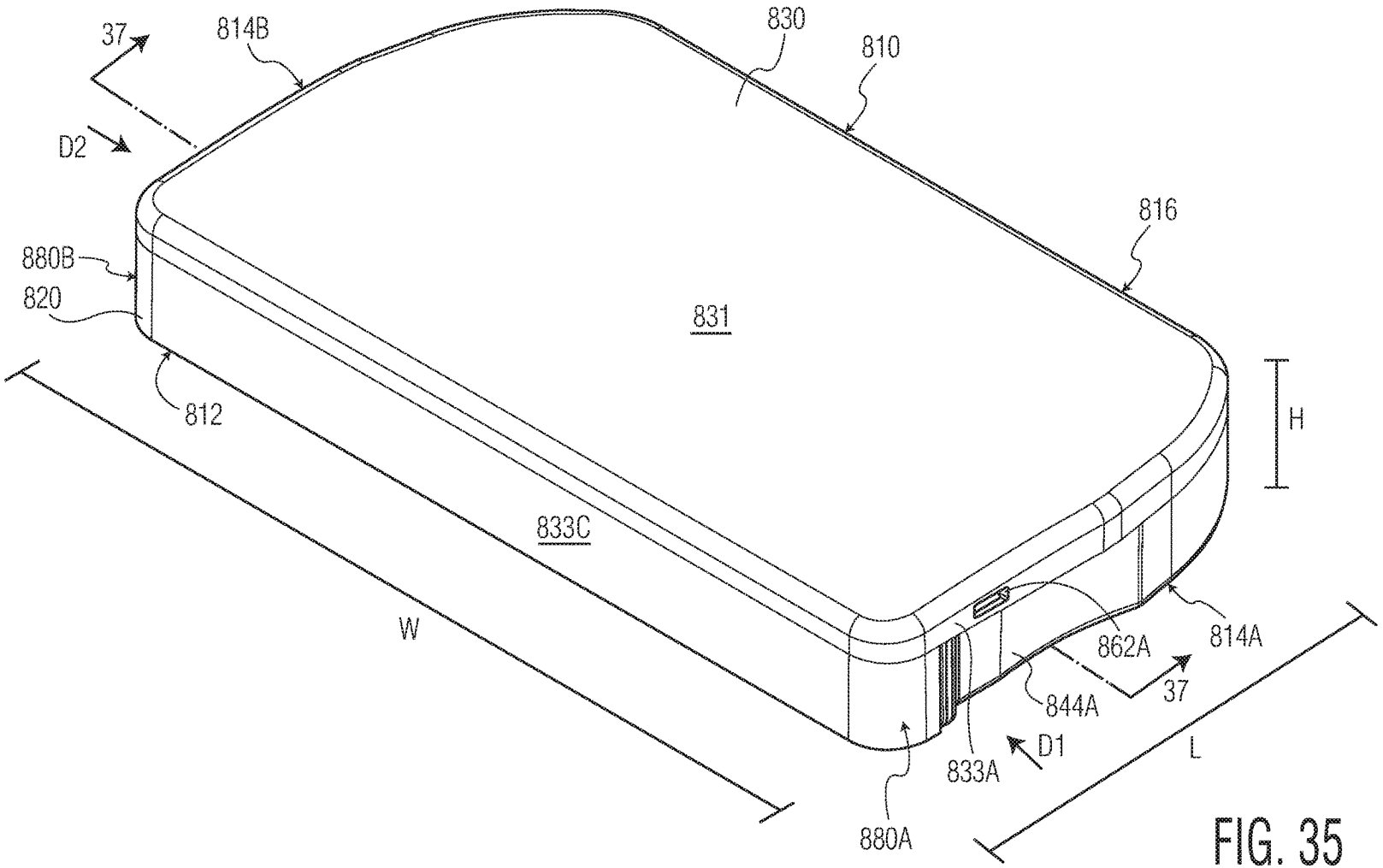
FIG. 35 is a front perspective view of another embodiment of a cap and container assembly according to the invention.
Figure 37:
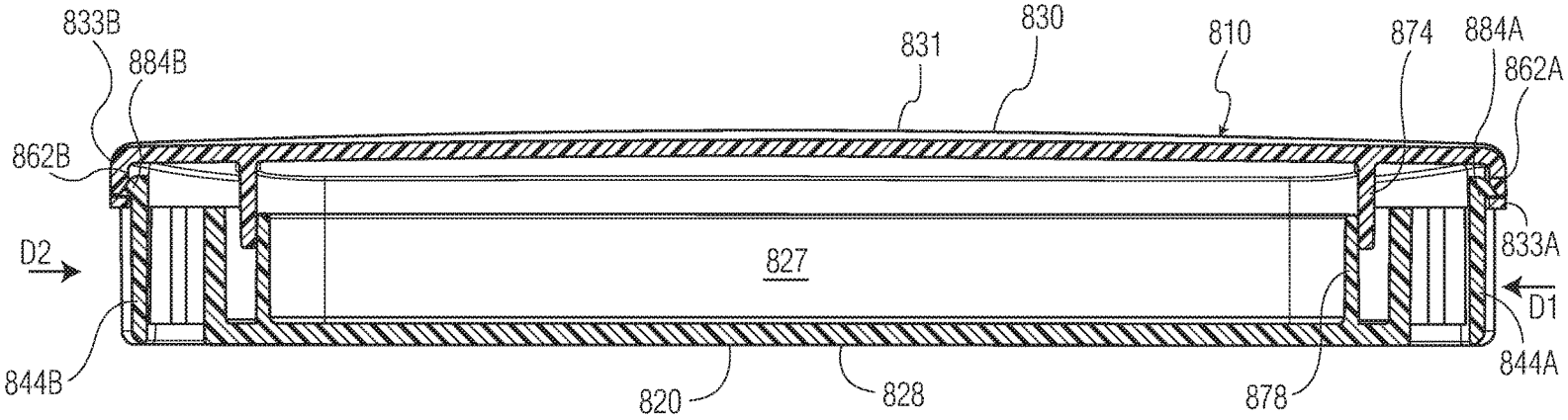
FIG. 37 is a cross section taken along line 37-37 of FIG. 35.
Figure 38:
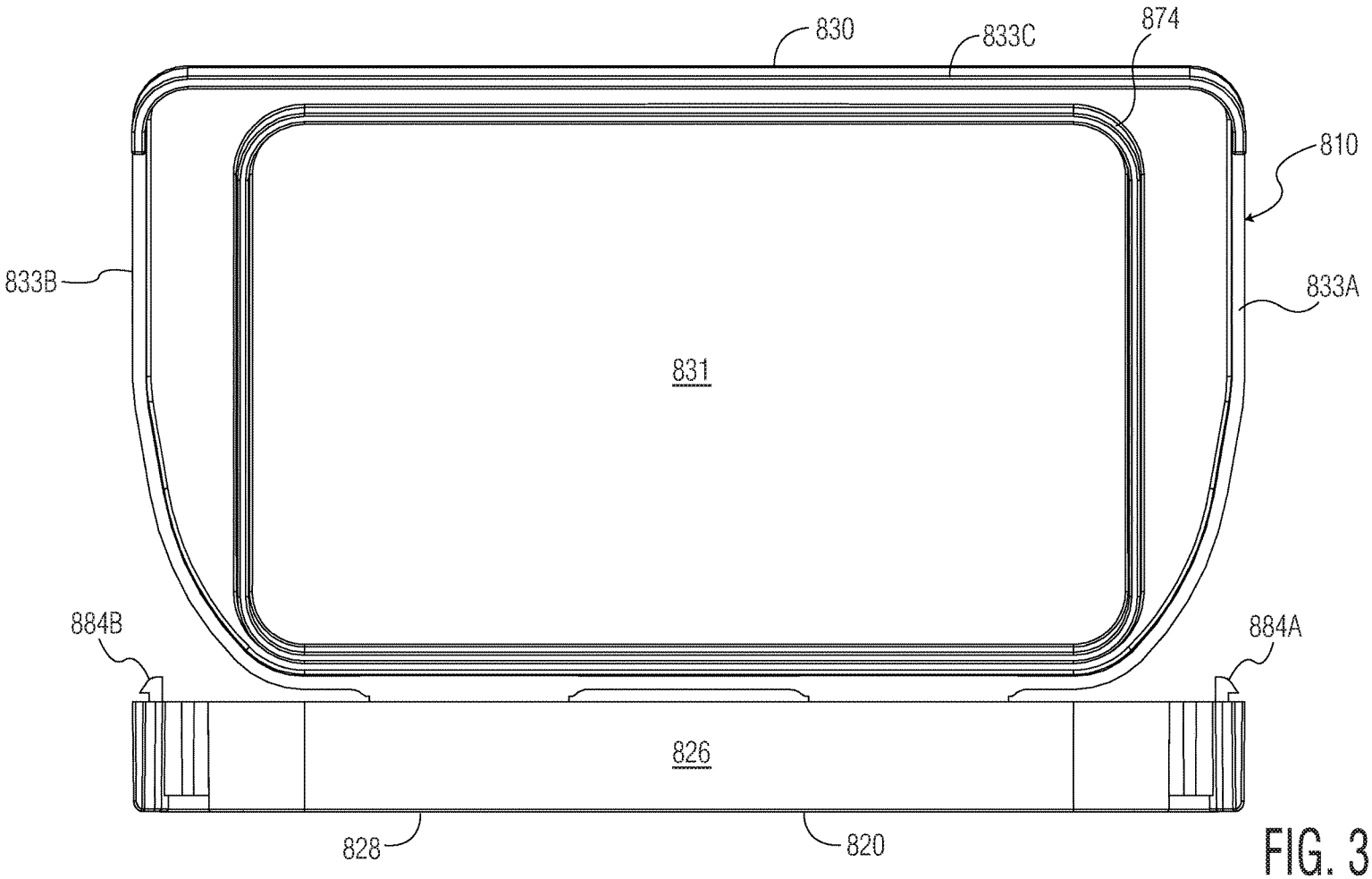
FIG. 38 is a front elevational view of the assembly of 35, in an opened position.
Figure 39:
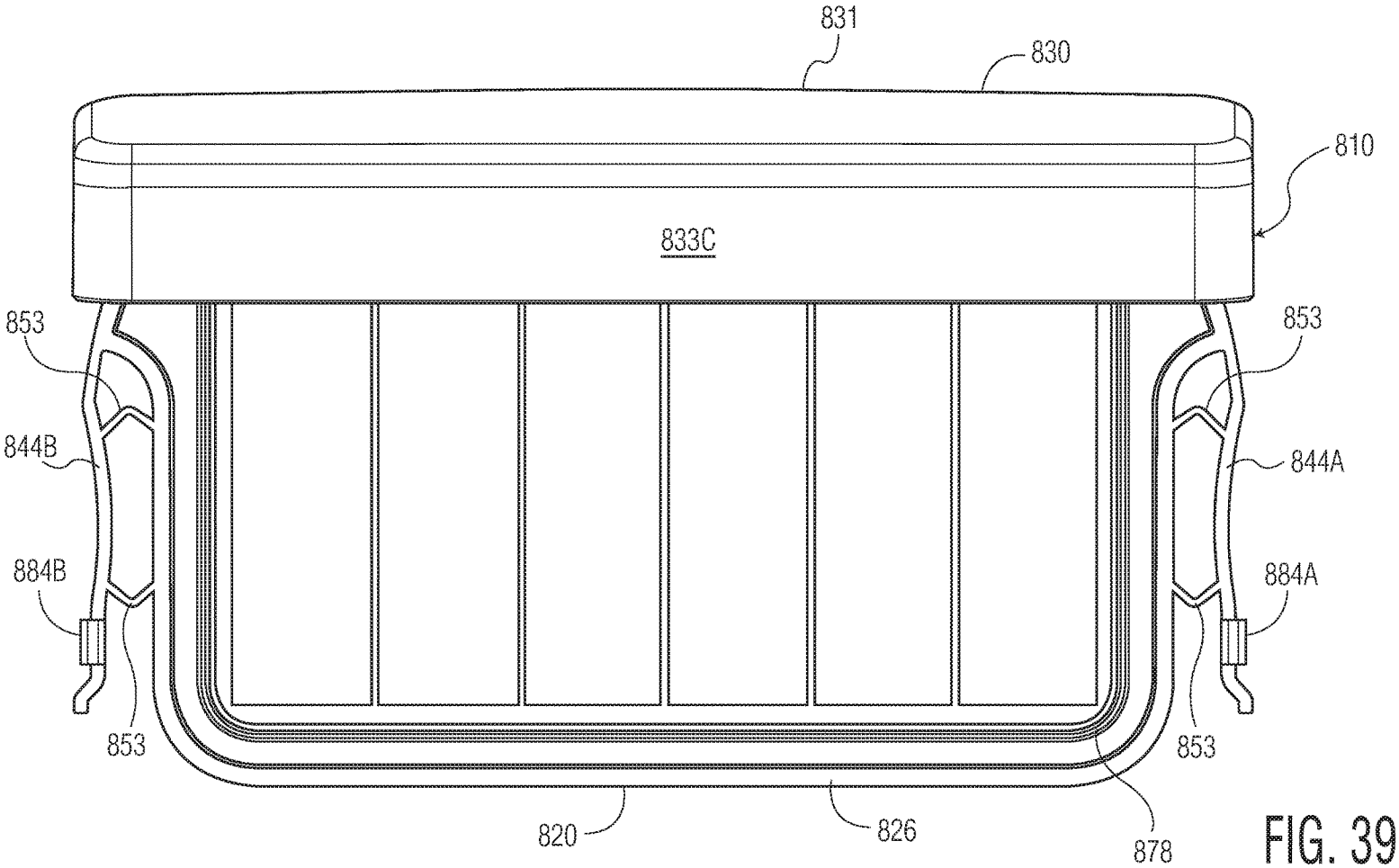
FIG. 39 is a top plan view of the assembly of FIG. 35, in an opened position.

The spacers 844A, 844B of this embodiment include latches 860A, 860B that engage apertures 862A, 862B formed within the skirt 833. As shown in FIGS. 35 and 37, latches 860A, 860B are horizontally aligned with apertures 862A, 862B when the assembly 810 is in the closed position. The hook portions 884 of latches extend into the apertures 862A, 862B when the assembly 810 is in the closed position and the spacers 844 are in the locked positions, to prevent the cap 830 from moving away from the container 820 to expose the opening 822.

Figure 36:
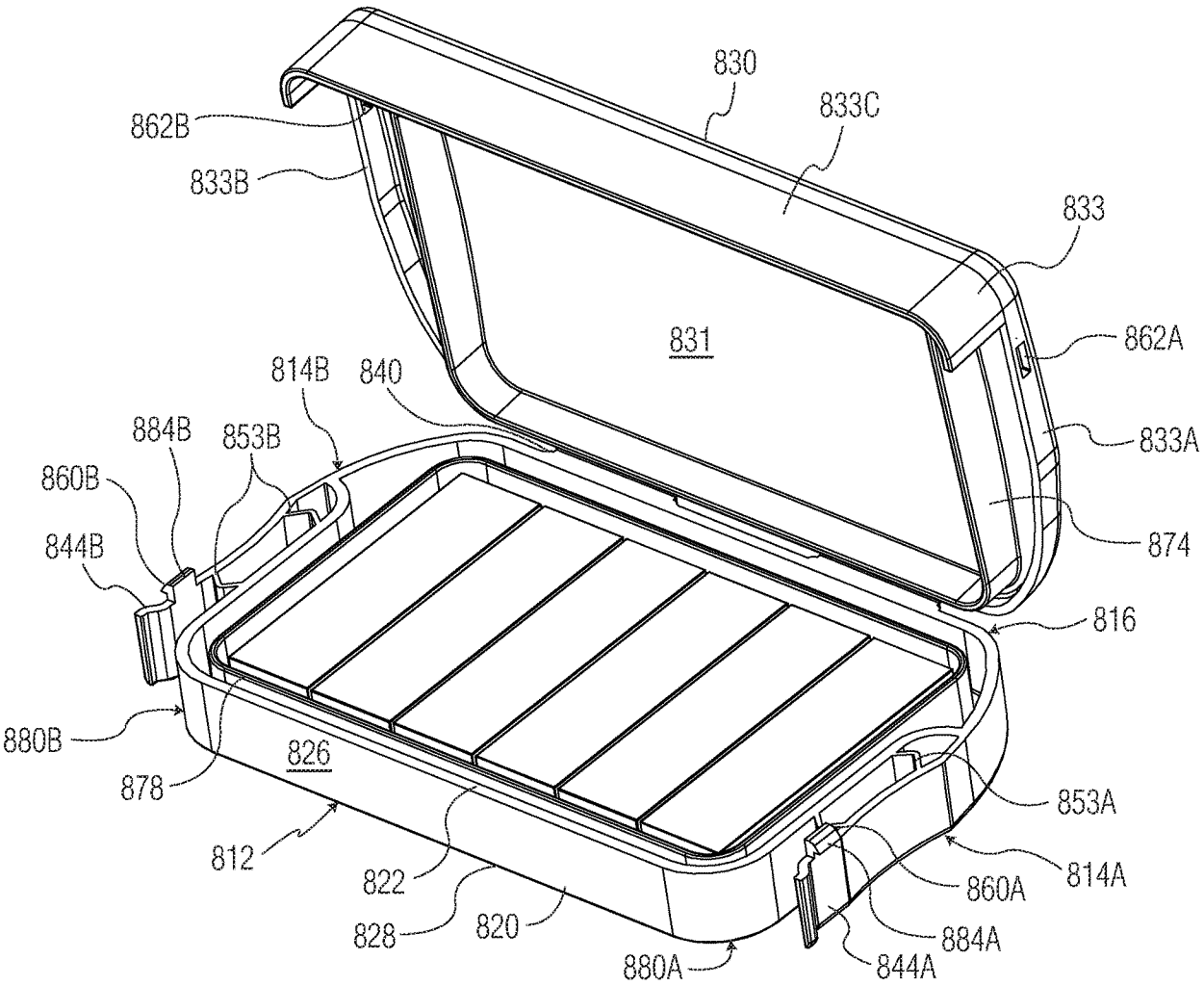
FIG. 36 is a front perspective view of the assembly of FIG. 35, in an opened position.

As best shown in FIG. 36, the skirt 833 of this embodiment includes a front section 833C and opposite side sections 833A, 833B. The front section 833C extends across the entire front side 812 of the assembly 810 and wraps around the corners 880A, 880B towards the sides 814A, 814B. The front section 833C has a greater extension in the vertical or height H direction of the assembly 810, such that it covers the entire portion of the side wall 826 extending along the front 812 of the assembly 810. The side portions 833A, 833B pick up where front portion 833C terminates and extend along the entire sides 814A, 814B of the assembly 810. The side portions 833A, 833B have a smaller extension in the vertical or height H direction of the assembly, extending downward from the edges of top wall 831 to a height just below hook portions 880A, 880B when the assembly is in the closed position, leaving the lower portions of spacers 844A, 844B exposed.

In another embodiment, the front 833C and side portions 833A, 833B could have equal vertical extensions, for example, each of these portions could have vertical extensions equal to those of the side portions 833A, 833B of the illustrated embodiment. In such an embodiment the spacers 844A, 844B would remain exposed, as they are in the illustrated embodiment, allowing the assembly 810 to be opened in the manner described below.

In order to move the assembly from the closed position to the opened position, a user applies sufficient force to the spacers 844A, 844B, inward in directions D1 and D2, to displace the hook portions 884A, 884B from apertures 862A, 862B, moving the spacers 844A, 844B into the unlocked positions, so that the cap 830 can be displaced from the container 820 to move the assembly 810 into the opened position.

FIGS. 40-46 show another embodiment of a cap and container assembly 1010 according to the invention.

As shown, the assembly 1010 includes a container 1020 having a base 1028 and a tubular side wall 1026 extending upward from the base 1028. The side wall 1026 defines an opening 1022 at an upper edge thereof, and the opening 1022 leads to an interior 1027 of the container 1020.

The assembly 1010 has a front 1012, rear 1016 and opposite sides 1014A, 1014B.

Figure 40:
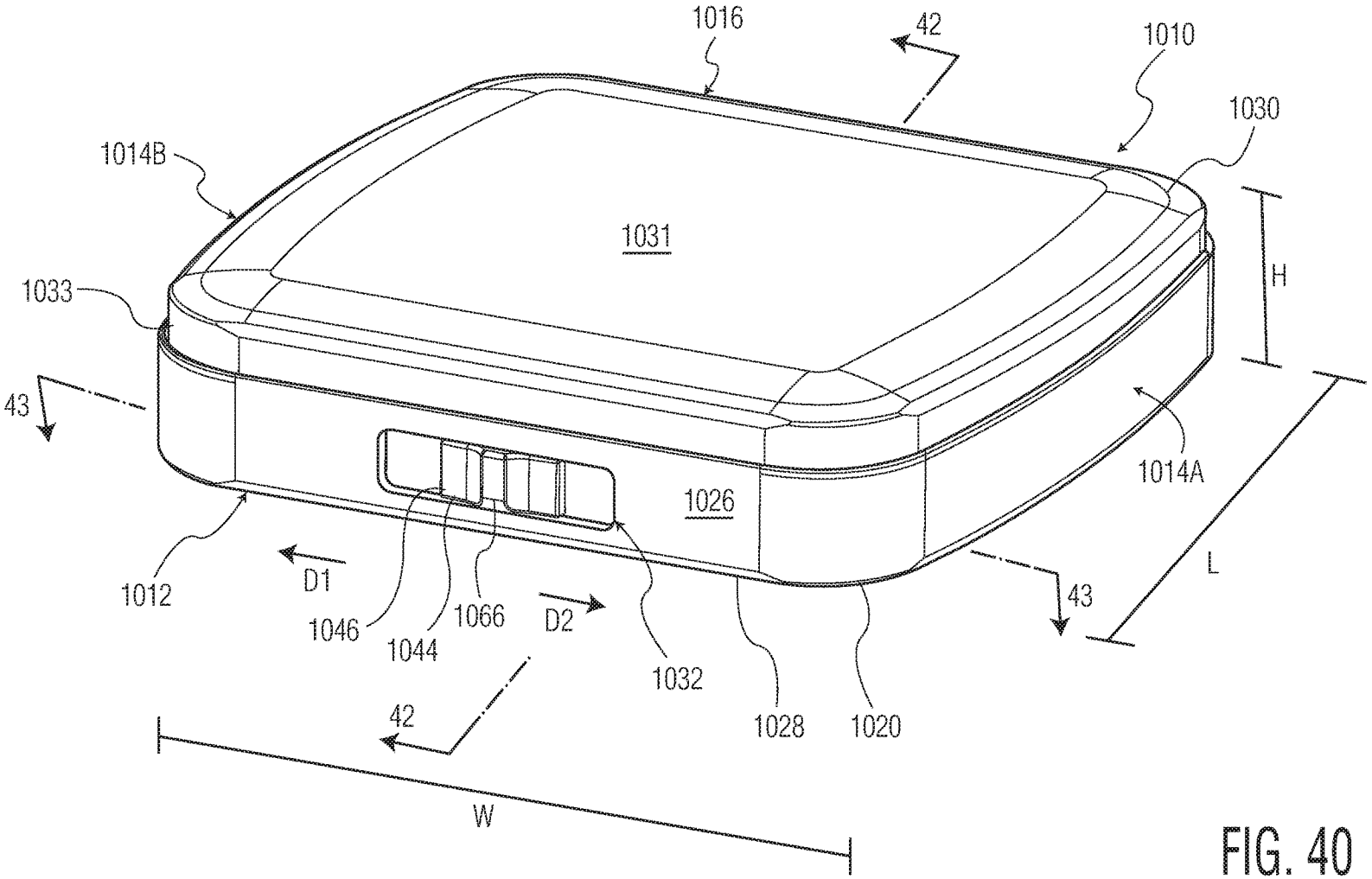
FIG. 40 is a front perspective view of another embodiment of a cap and container assembly according to the invention, in a closed position.
Figure 41:
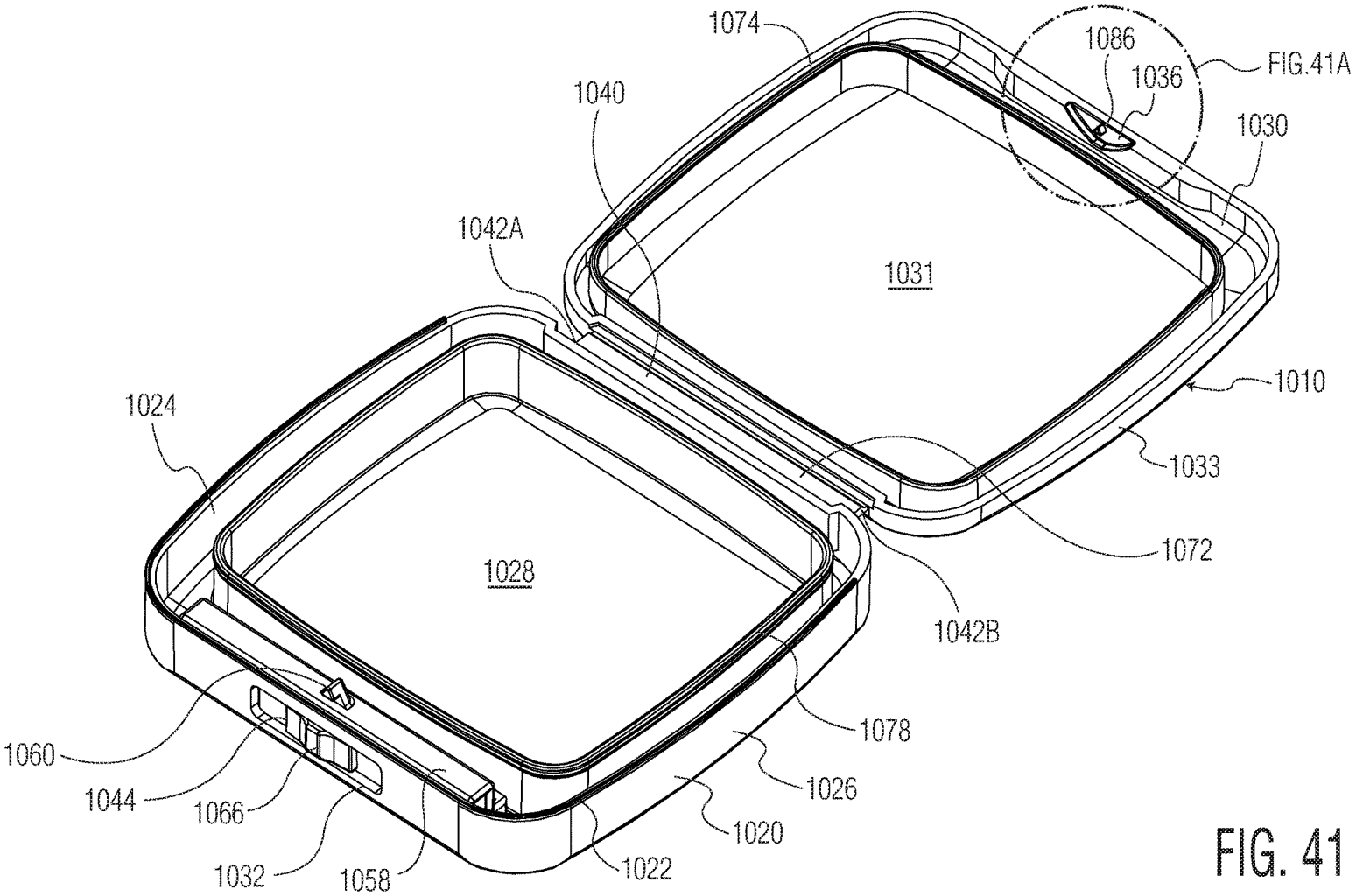
FIG. 41 is a front perspective view the assembly of FIG. 40, in an opened position.
Figure 42:
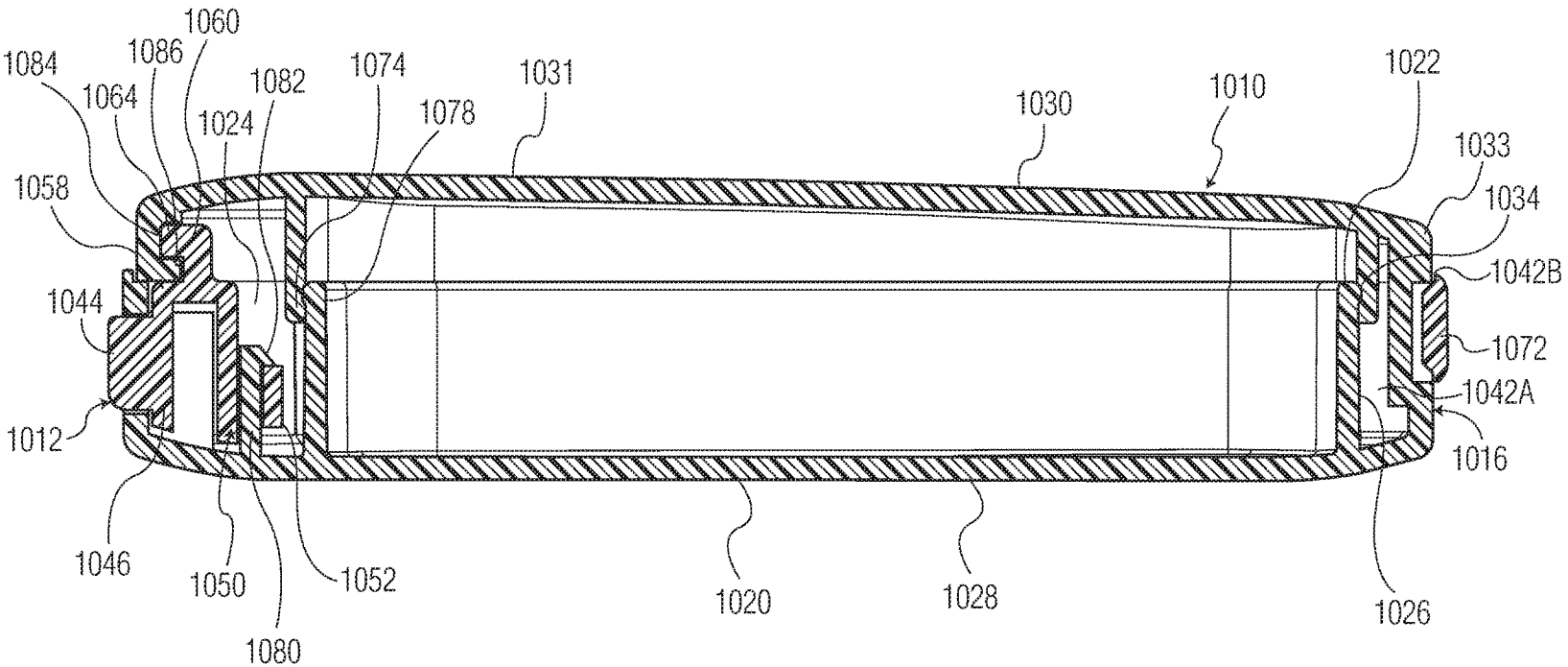
FIG. 42 is a cross section taken along line 42-42 of FIG. 40.

Still referring to FIGS. 40-46, the assembly 1010 of this embodiment further includes a cap 1030. The cap 1030 includes a top wall 1031 and a skirt 1033 that extends downward, substantially perpendicularly around the outer periphery of the top wall 1031. The cap 1030 moves between a closed position, in which the cap 1030 covers the opening 1022, as shown in FIGS. 40 and 42, and an opened position, in which the opening 1022 is exposed, as shown in FIG. 41. The cap 1030 of the illustrated embodiment is pivotally affixed to the container by a hinge 1040, located at the rear 1016, which allows the cap 1030 to pivot between the opened and closed positions.

The assembly 1010 has a width W extending horizontally and generally parallel to the hinge 1040, a length L, extending horizontally and generally perpendicular to the hinge 1040, and a height H extending vertically and generally perpendicular to the hinge 1040. The assembly 1010 of the illustrated embodiment has a generally rectangular shape, with the height H having a smaller extension than the length L and width W, and the width W having a greater extension than both the length L and the height H. The assembly could be provided in any other suitable configuration known in the art or disclosed herein, taking on, for example, a cylindrical or square shape.

The cap 1030 of this embodiment includes an inner sealing ridge 1074 extending downward from a bottom surface of the top wall and located inward with respect to the skirt 1033. The container 1020 includes an inner lip 1078 extending upward from a bottom surface of the base 1028 and located inward with respect to the side wall 1026. The inner sealing ridge 1074 and the inner lip 1078 may engage to form a moisture-tight seal. As shown in FIG. 42, when the assembly 1010 is in the closed position, an inner surface of the inner sealing ridge 1074 abuts an outer surface of the inner lip 1078 to form a moisture-tight seal therebetween. The inner lip 1078 of this embodiment includes a sealing projection 1034 at the upper edge and on an outer surface thereof, to ensure complete contact with the inner sealing ridge 1074. In an alternative embodiment, the sealing projection 1034 could be omitted or provided on an inner surface of the inner sealing ridge 1074.

A bottom edge of the skirt 1033 contacts a top edge of the side wall 1026 when the assembly 1010 is in the closed position. In some embodiments, a moisture-tight seal may be formed between the skirt 1033 and the rim side wall 1026, which can be an additional or alternative moisture-tight seal to that formed between inner sealing ridge 1074 and inner lip 1078.

Referring in particular to FIGS. 41 and 42, the hinge 1040 of this embodiment is a double hinge. A hinge strip 1072 is formed between the cap 1030 and an upper edge of side wall 1026. Specifically, an upper edge of hinge strip 1072 joins with cap 1030 to form a first bending line 1042A, and a lower edge of hinge strip 1072 joins with side wall 1026 to form a second bending line 1042B. First bending line 1042A pivotally affixes the cap 1030 with the hinge strip 1072, and second bending line 1042B pivotally affixes the container 1020 with the hinge strip 1072. First and second bending lines 1042A, 1042B can be formed as recesses, such as the recess 42 in the embodiment of FIGS. 1-5. Alternatively, first and second bending lines 1042A, 1042B could be formed as mechanical hinges, or by other means of forming hinges known in the art. The inclusion of two bending lines between the cap 1030 and container 1020 allows for greater mobility in pivoting between the two elements.

The assembly 1010 of FIGS. 40-46 includes a slider 1044 that moves between a locked position, which retains the cap 1030 over the opening 1022 of the container 1020, and an unlocked position, which allows the cap 1030 to move away from the container 1020 to move the assembly 1010 from the closed position to the opened position.

Figure 45:
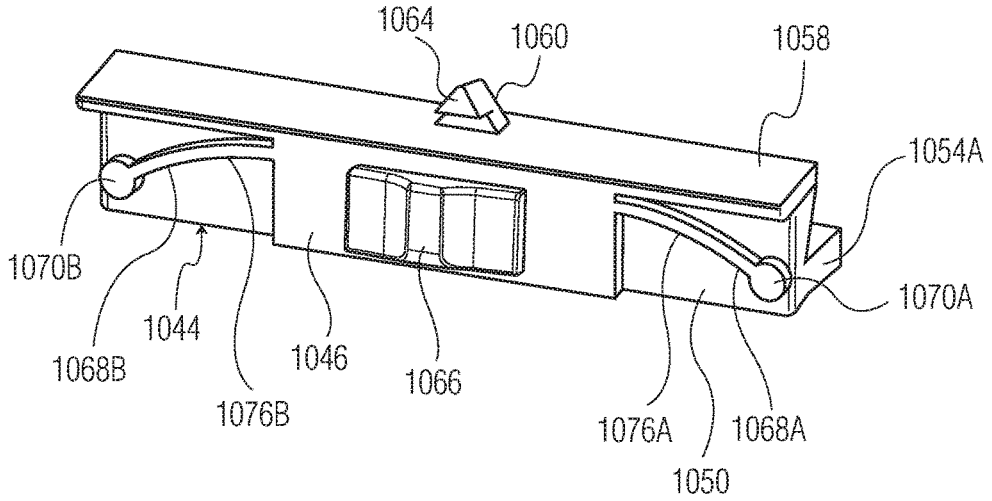
FIG. 45 is a front perspective view of the slider of the assembly of FIG. 40.
Figure 46:
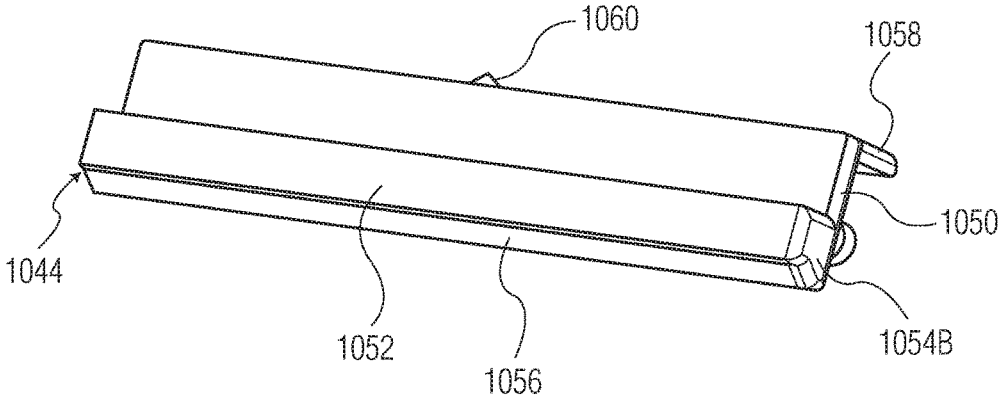
FIG. 46 is a rear perspective view of the slider of the assembly of FIG. 40.

As shown, in particular in FIGS. 45 and 46, the slider 1044 includes a body 1048. The body 1048 is formed of an elongate front wall 1050 and an elongate rear wall 1052 extending parallel to and directly behind the front wall 1050.

Opposite side walls 1054A, 1054B join the front wall 1050 and the rear wall 1052. An opening 1056 is formed between the front wall 1052, rear wall 1054 and side walls 1056A, 1056B. A top ledge 1058 extends horizontally forward from an upper edge of the front wall 1050. A latch 1060 extends upwards from the upper surface of top ledge 1058. The latch 1060 includes a forwardly extending hook 1064. An actuation portion 1046 is affixed to the slider 1044 slightly forward of front wall 1050 and extending downward from a front edge of the top ledge 1058. A grip 1066 projects forward from the front of actuation portion 1046. In the illustrated embodiment, the grip 1066 is a vertical ridge that can easily be gripped by a user, for example between the thumb and forefinger, during sliding of the slider 1044 between the unlocked and locked positions, as described in detail below. At least one spring 1068 may be included to bias the slider 1044 to the locked position. Two springs 1068A, 1068B are provided in the illustrated embodiment, projecting from opposite sides of the actuation portion 1046.

Referring to FIG. 42, the body 1042 sits slidably within a gap 1024 between the container side wall 1026 and the inner lip 1078 on the front side 1012 of the assembly 1010. An elongate divider 1080 extending in a width-wise direction of the assembly 1010 projects upward from the top surface of the base 1028 within the gap 1024, and extends into the opening 1056 of slider body 1048. A flange 1082 projects rearwardly from the top edge of divider 1080, and extends overtop of slider body rear wall 1052 to retain the slider 1044 within the gap 1024.

Figure 41A:
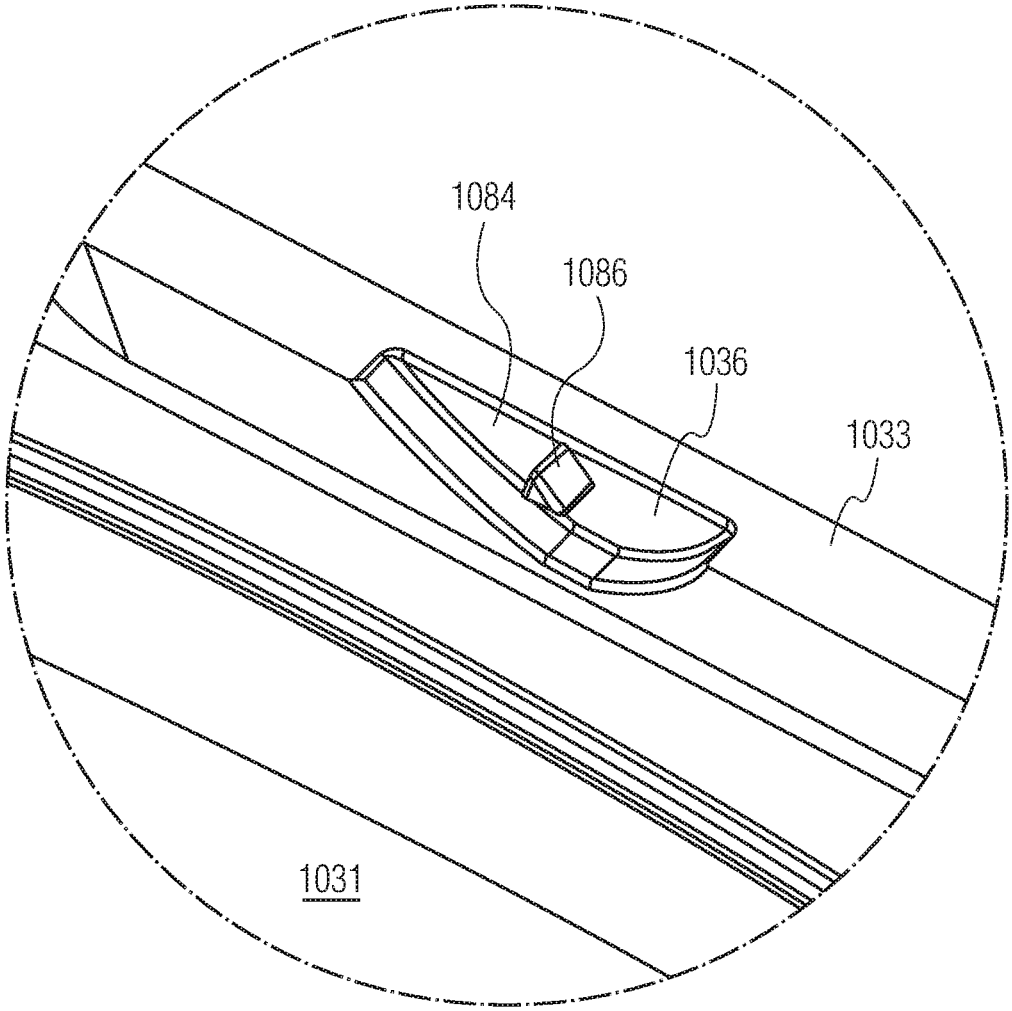
FIG. 41A is an enlarged detail of FIG. 41.

The side wall 1026 includes a horizontally extending slot 1032 on the front side 1012 of the assembly. Slider grip 1066 projects through the slot 1032. Latch 1060 projects upward, above the upper edge of side wall 1026. Referring to FIGS. 41, 41A and 42, an indentation 1084 is formed in an inner surface of the skirt 1033 located on the front 1012 of the assembly. Indentation 1084 extends upward from the bottom edge of skirt 1033. A projection 1086 extends inwardly from the inner surface of skirt 1033 within the indentation 1084, forming a groove 1036. The groove 1036 is in alignment with the hook 1064 of latch 1060 when the assembly 1010 is in the closed position, and as shown in FIGS. 40 and 42, hook 1064 is located within the groove 1036 when the assembly 1010 is in the closed and locked position.

In order to open the assembly 1010, the slider 1044 is slid from a centrally located, locked position, as shown in FIG. 40, in direction D1 or D2, to an unlocked position. To achieve this, a user can grip the grip 1066 and slide it within the slot 1032 in direction D1 or D2 by applying a sufficient force to overcome the bias of the springs 1076, to move the hook 1064 out from the groove 1036, so that the cap 1030 can be removed from the container 1020 to open the assembly 1010.

Figure 43:
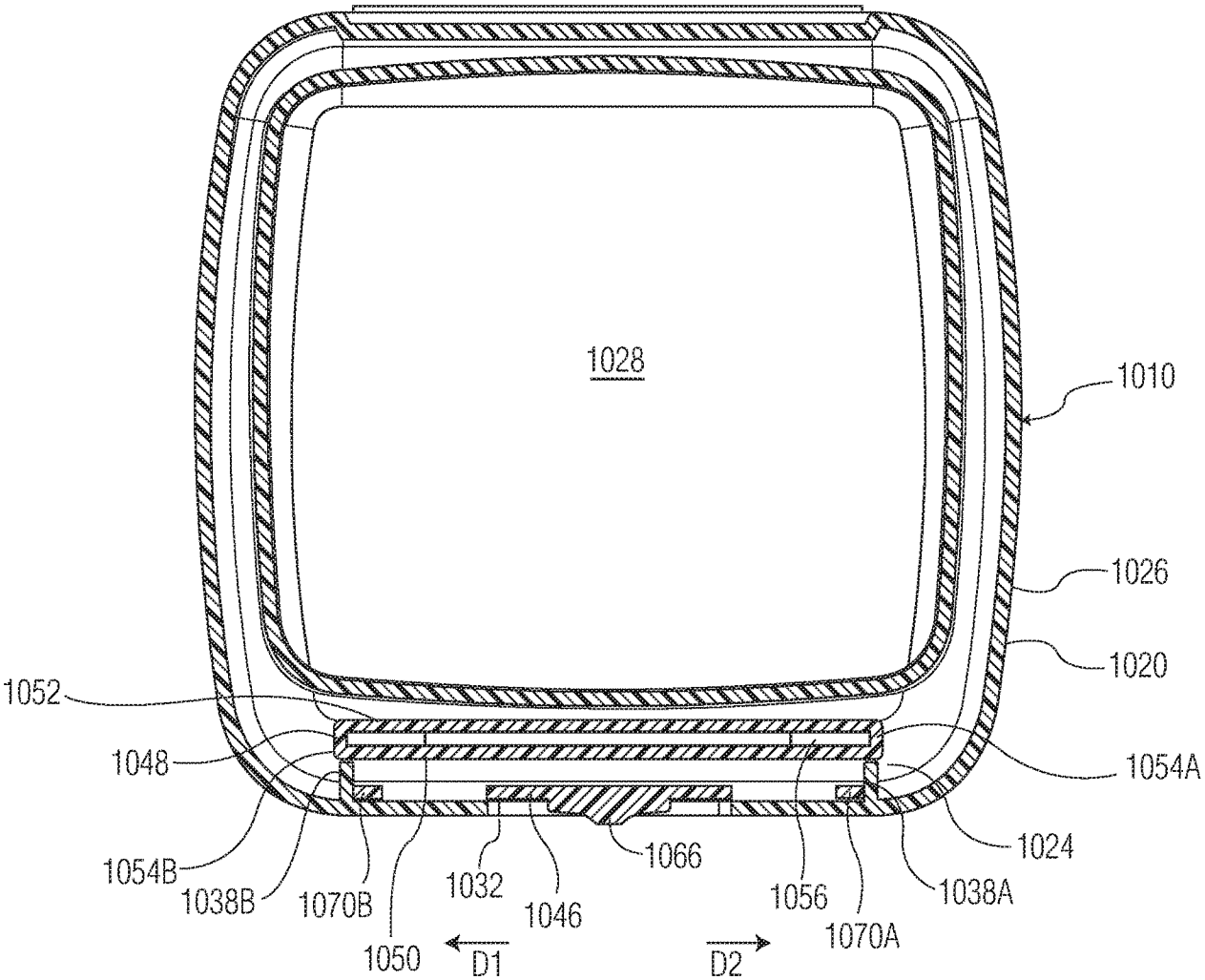
FIG. 43 is a cross section taken along line 43-43 of FIG. 40.
Figure 44:
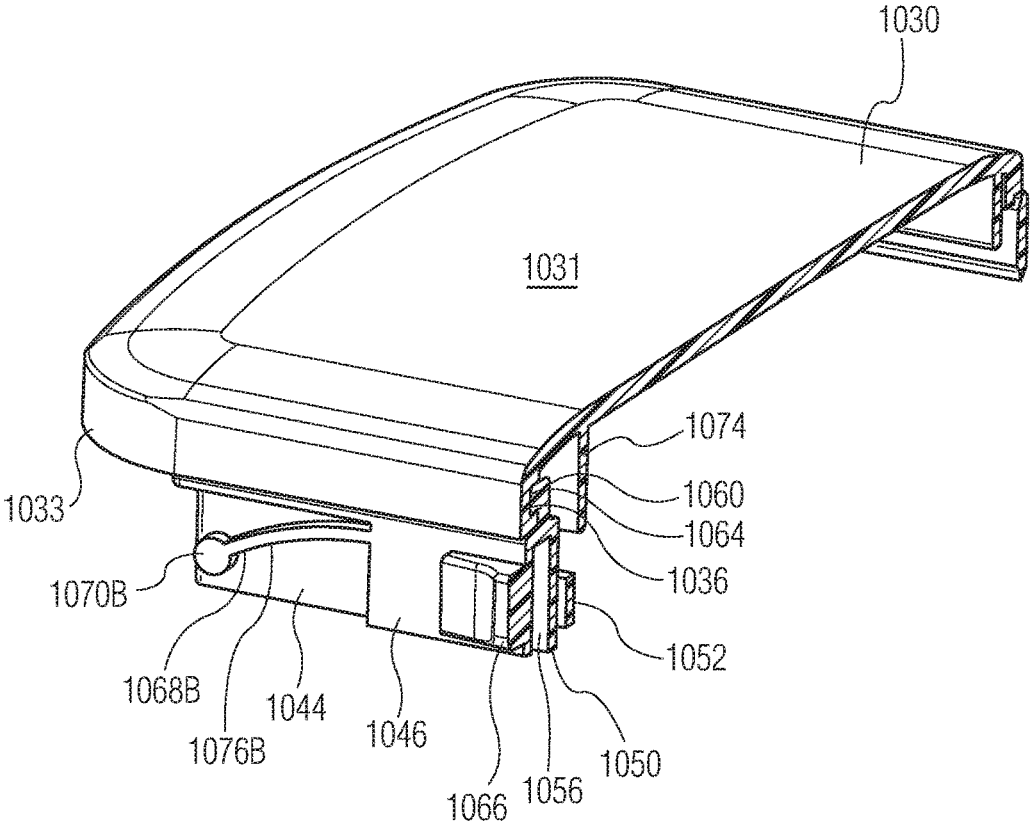
FIG. 44 is a partially cut away perspective view of the cap and slider of the assembly of FIG. 40.

As shown in FIG. 43, two tabs 1038A, 1038B extend inward from an inner surface of the side wall 1026 on the front side 1012 of the assembly 1010. The tabs 1038A, 1038B are located on opposite sides of the slider 1044, directly outside the ends 1070A, 1070B of springs 1068A, 1068B. The tabs 1038A, 1038B extend inward only to distance approximately equal to the thickness of springs 1068 in the length L direction of the assembly. Accordingly, springs 1068A, 1068B are prevented from sliding past tabs 1038A, 1038B during sliding of the slider 1044 in directions D1 and D2, while slider body 1048, which is located rearward of tabs 1038A, 1038B, can slide freely past tabs 1038A, 1038B in directions D1 and D2. During sliding, whichever of the spring arms 1076A, 1076B that is located towards the direction of sliding will undergo compression between the slider actuation portion 1046 and the adjacent tab 1038. When the slider 1044 is released, the spring 1068 urges the slider 1044 back to the centrally located, locked position.

Another embodiment of a cap and container assembly 1110 according to the invention is shown in FIGS. 47-53. This embodiment of the assembly 1110 is similar to that of FIGS. 40-46 and only the differences will be described in detail. Unless otherwise specified, the same reference numbers will be used to designate the same or analogous elements to those of the embodiment of FIGS. 40-46, increased by 100.

The side walls 1126 along sides 1114A, 1114B of the assembly 1110 of FIGS. 47-53 extend at angles towards each other as they extend between the front 1112 and rear 1116 of the assembly 1110, such that the assembly 1110 has a substantially trapezoidal shape. The assembly 1110 also includes angled front corners 1118A, 1118B, that extend at angles between the front 1112 and opposite sides 1114A, 1114B of the assembly 1110. Openings 1132A, 1132B are formed in the side wall 1126 at the angled front corners 1118A, 1118B, to facilitate sliding and actuation of the slider 1144, as described in detail below. In other embodiments, an assembly 1110 having the features shown in FIGS. 47-53 could take on a square or rectangular shape, such as any of those shown or described herein with respect to other embodiments of the assembly 1110.

Figure 48:
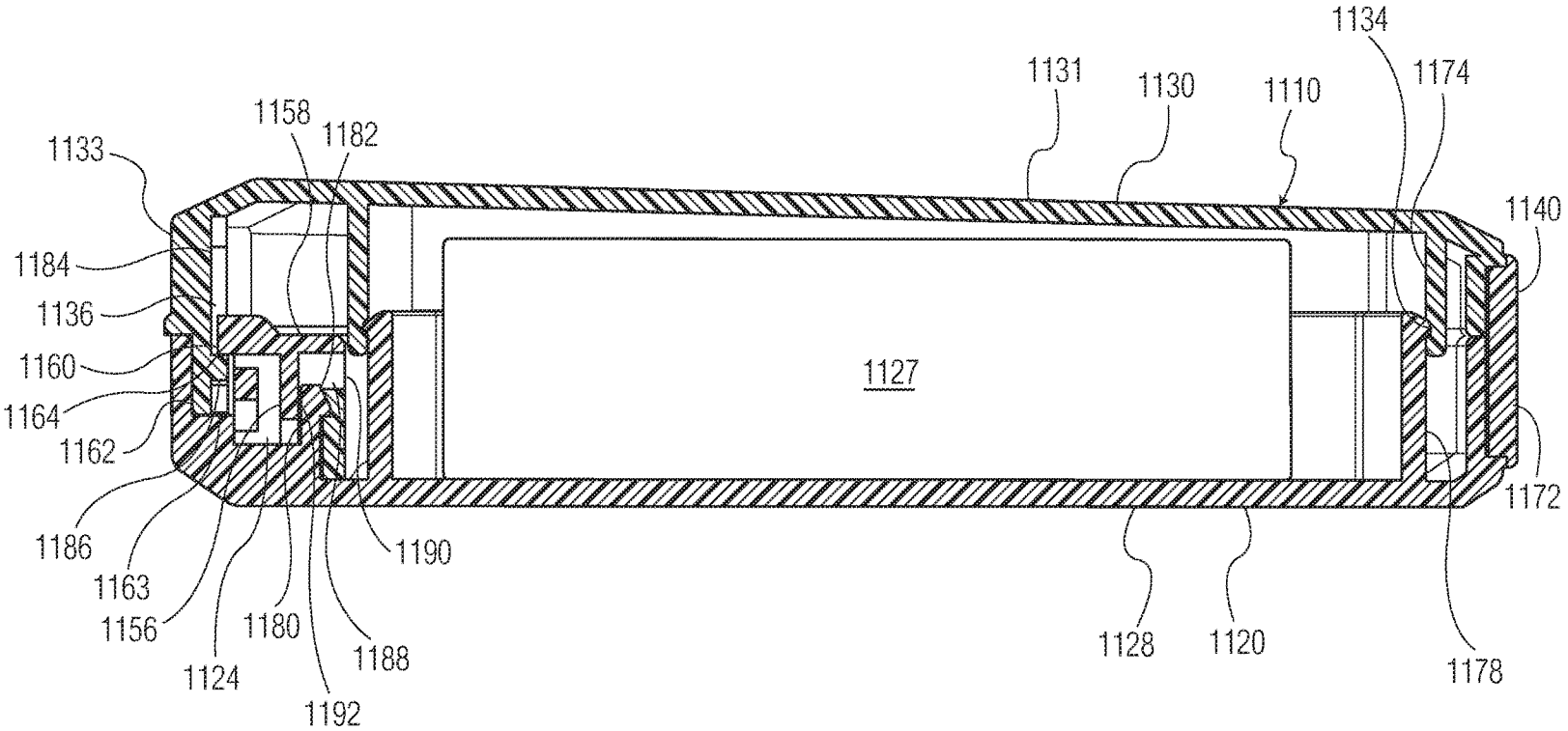
FIG. 48 is a cross section taken along line 48-48 of FIG. 47.
Figure 52:
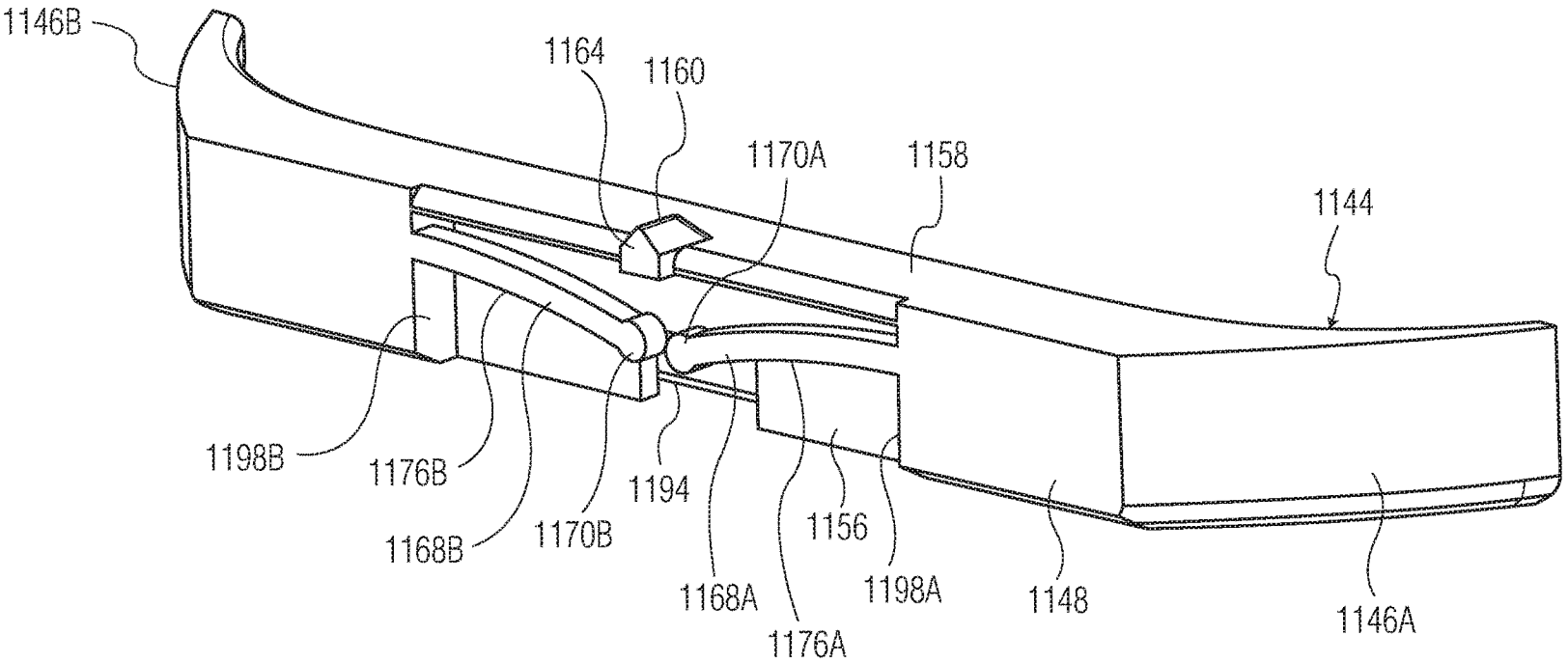
FIG. 52 is a front perspective view of the slider of the assembly of FIG. 47.
Figure 53:
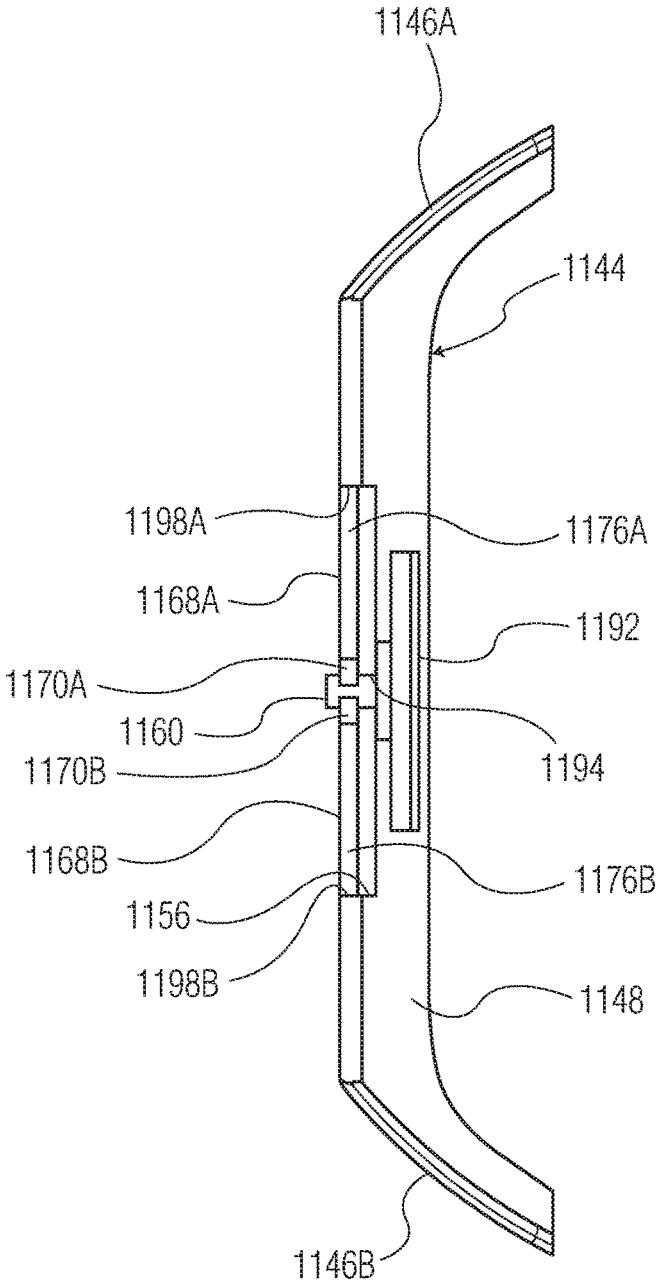
FIG. 53 is a bottom plan view of the slider of the assembly of FIG. 47.

Referring in particular to FIGS. 48, 52 and 53, the slider 1144 of this embodiment includes an elongate body 1148. A recess 1156 is formed in the front surface of the slider body 1148, as shown in FIG. 52, the recess 1156 extending inward from the front surface and upward from the bottom surface of the body 1148, leaving a top ledge 1158 extending over the recess 1156. A latch 1160 is formed on the body 1148 as a protuberance 1164 extending forward and upward from the top surface of the ledge 1158. At least one spring 1168 may be included to bias the slider 1144 to the locked position. Two springs 1168A, 1168B are provided in the illustrated embodiment, projecting from the inner side surfaces defining the recess 1156, inwards towards each other and the center of the recess 1156. A channel 1188 having an inverted "L" shape extends between the rear surface and the bottom surface of the body 1148. The channel 1188 has a width-wise extension approximately equal to that of the recess 1165. A horizontal leg 1190 of the channel 1188 extends inward from the rear surface of the body 1148, and a vertical leg 1192 of the channel 1188 extends upward from the bottom surface of the body 1148 to meet the horizontal leg 1190. The channel 1188 may be connected with the recess 1156 by a slot 1194 formed in the bottom surface of the body 1148 and extending in a length-wise direction of the assembly 1110. First and second actuation portions 1146A, 1146B are formed at opposite ends of the body 1148 and are accessible through front corner openings 1132A, 1132B of the side wall 1126. In the illustrated embodiment, the actuation portions 1146A, 1146B are angled surfaces configured to be substantially flush with angled corners 1118A, 1118B of the assembly 1110, and are exposed through openings 1132A, 1132B. In other embodiments, the actuation portions 1146A, 1146B could project outward from openings 1132A, 1132B for access by a user. In yet other embodiments, actuation portions 1146A, 1146B could be located on an interior 1127 of the assembly 1110, requiring a user to reach into the assembly 1110 and access the actuation portions 1146A, 1146B through openings 1110.

Figure 49:
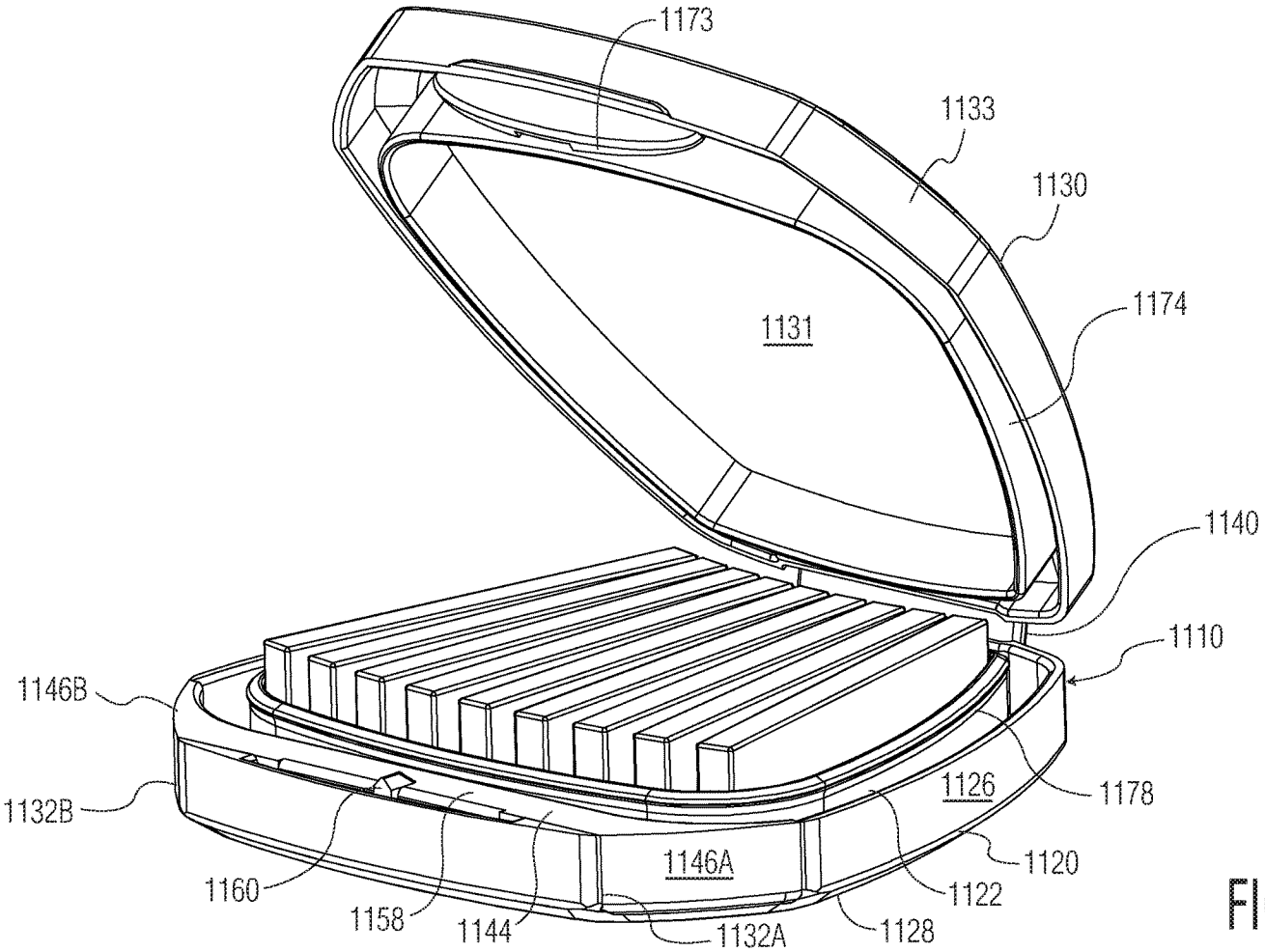
FIG. 49 is a front perspective view of the assembly of FIG. 47, in an opened position.
Figure 50:
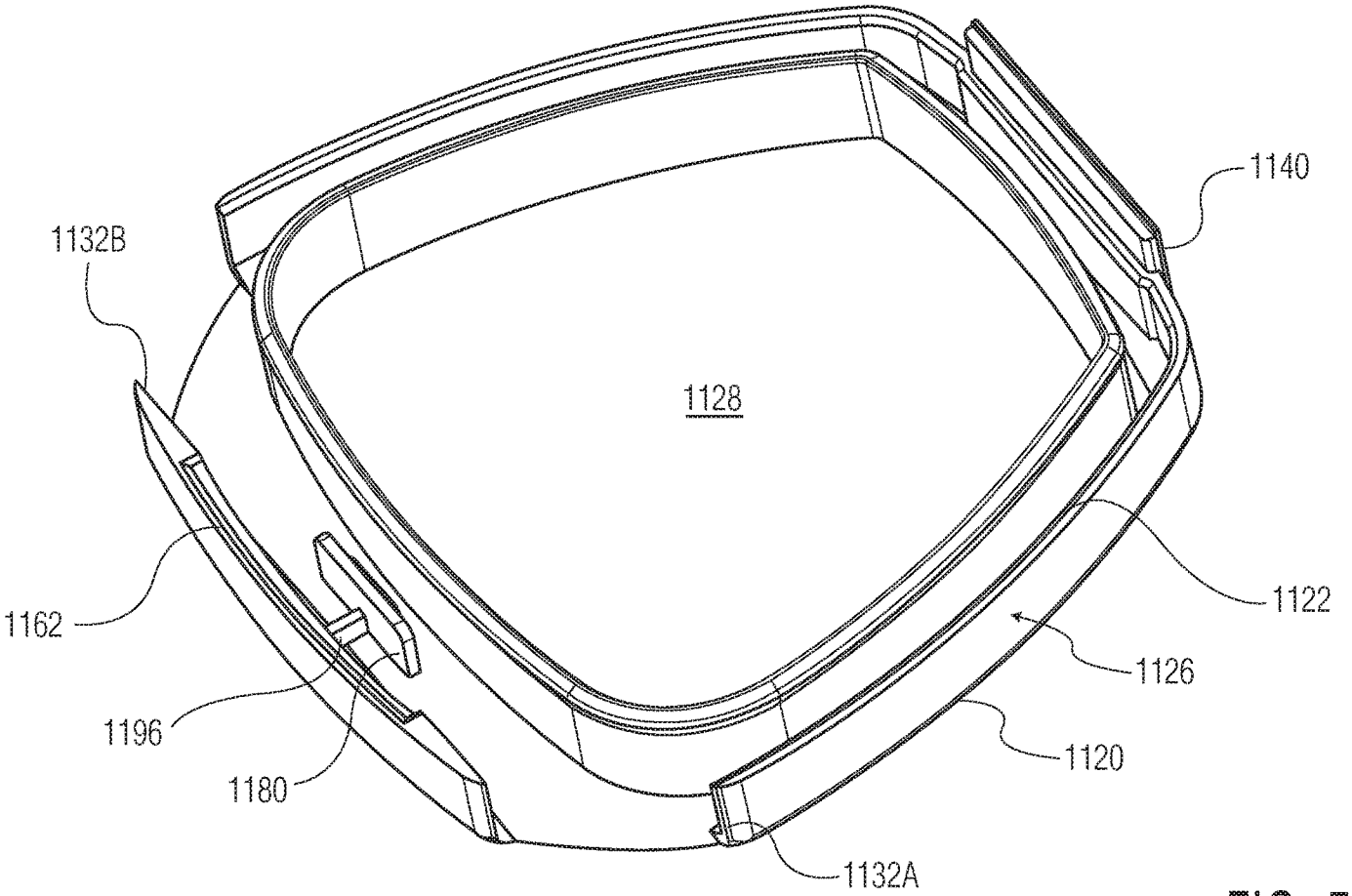
FIG. 50 is a top perspective view of the container of the assembly of FIG. 47.

Referring to FIGS. 48 and 49, the slider 1144 sits slidably with a gap 1124 formed between the container side wall 1126 and the inner lip 1178 on the front side 1112 of the assembly 1110. An elongate divider 1180 extending in a width wise direction of the assembly 1110 projects upward from the top surface of the base 1128 within the gap 1124 and extends into the vertical leg 1192 channel 1188 of slider body 1148. A flange 1182 projects rearwardly from the top edge of divider 1180, and extend into the horizontal leg 1190 of channel 1188, to retain the slider 1144 within the gap 1124. A rail 1196 extends upward from the top surface of container base 1128, in a length-wise direction of the assembly 1110, between the side wall 1126 and divider 1180. The rail 1196 extends through the slot 1194 and between springs 1168A, 1168B, forming abutment surfaces for springs 1168A, 1168B, during sliding of the slider 1144 between the locked and unlocked positions, as described in detail below.

Figure 47:
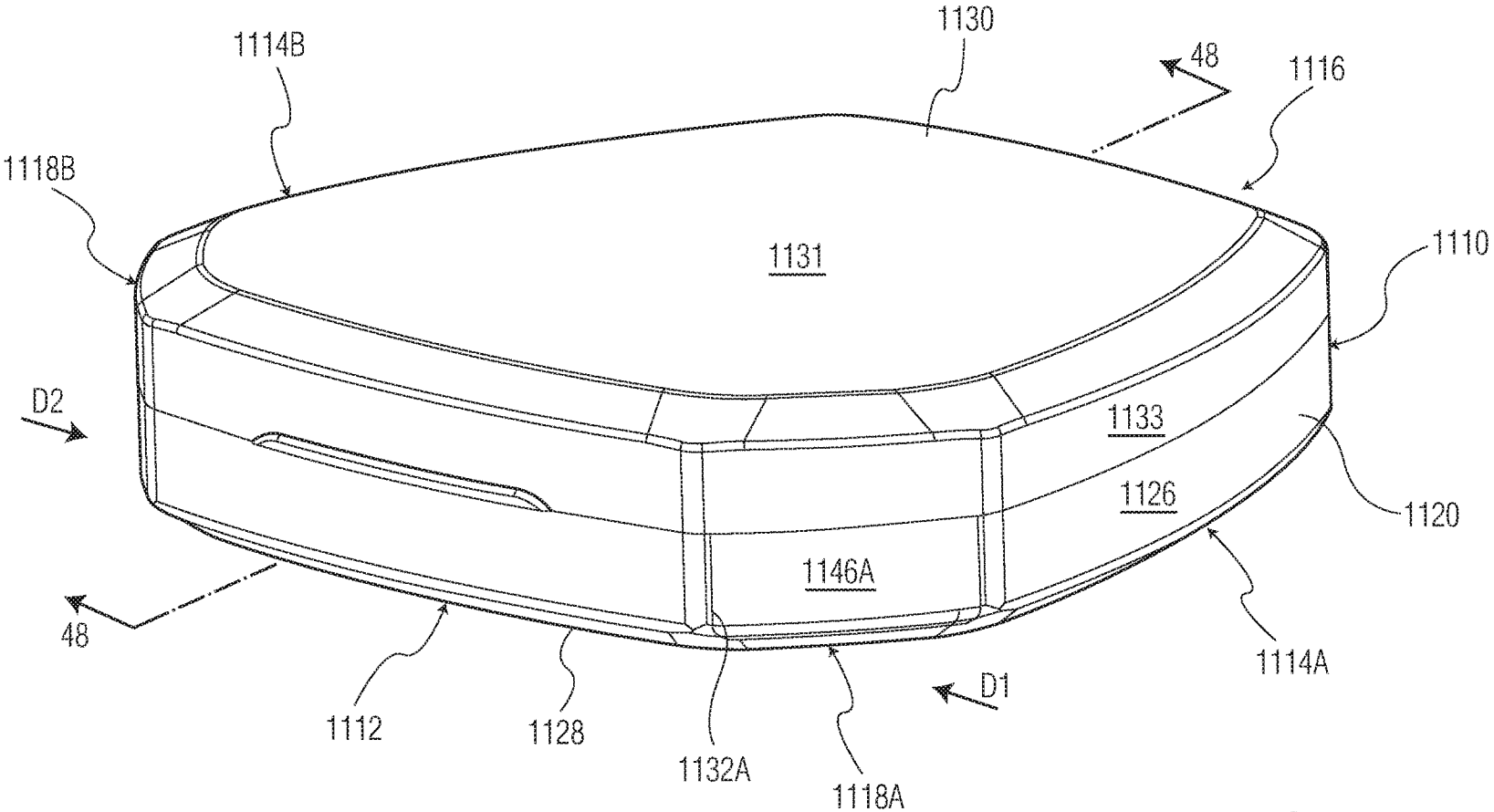
FIG. 47 is a front perspective view of another embodiment of a cap and container assembly according to the invention, in a closed position.
Figure 51:
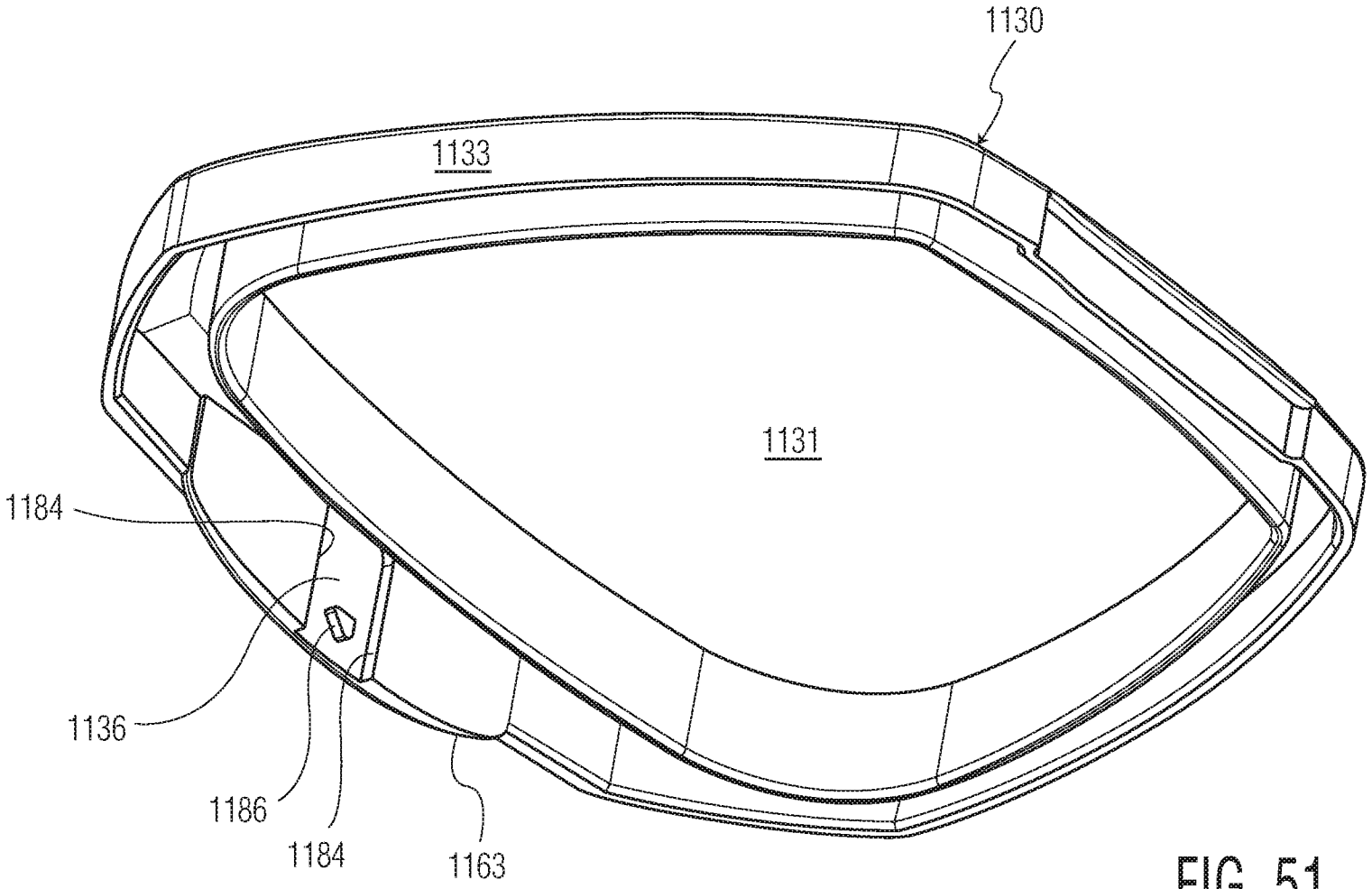
FIG. 51 is a bottom perspective view of the cap of the assembly of FIG. 47.

Referring to FIG. 51, an indentation 1184 is formed in an inner surface of the skirt 1133, located on the front side 1112 of the assembly 1110. Indentation 1184 extends upward from the bottom edge of skirt 1133. A projection 1186 extends inward from the inner surface of the skirt 1133 within the indentation 1184, forming a groove 1136. The groove 1136 is in alignment with the latch 1160 when the assembly 1110 is in the closed position, as shown in FIGS. 47 and 48. Protuberance 1164 is located within the groove 1136 when the assembly 1110 is in the closed and locked position.

In order to open the assembly 1110, the slider 1144 is slid from a centrally located, locked position, as shown in FIG. 47, in direction D1 or D2, to an unlocked position. To achieve this, a user can press on one of the actuation portions 1146 in direction D1 or D2, using a sufficient force to overcome the bias of spring 1168, in turn moving the entire slider in direction D1 or D2, to move the latch 1160 out from groove 1136, so that the assembly 1110 is in the unlocked position and the cap 1130 can be removed from the container 1120 to expose the opening 1122.

The inclusion of two actuation portions 1146A, 1146B having the configuration described above permits a user to open the assembly by, for example, holding the assembly in a first hand, and gripping the actuation portions 1146A, 1146B between the thumb and forefinger of a second hand, and sliding the second hand in direction D1 or D2. In some embodiments, the assembly 1110 could be dimensioned so as to permit gripping in this manner by a typical-sized hand of an adult user.

During sliding of the slider 1144 from the locked to the unlocked position, as described above, one of the springs 1168A, 1168B will undergo compression. Springs 1168A, 1168B each have ends 1170A, 1170B located on opposite sides of rail 1196. During sliding in direction D1, spring 1168A comes into abutment with rail 1196 and is compressed between rail 1196 and a first inner surface 1198A of indentation 1194. Likewise, during sliding in direction D2, springs 1168B comes into abutment with rail 1196 and is compressed between rail 1196 and a second inner surface 1198B of indentation 1184. This compression of springs 1168A, 1168B biases the slider 1144 to the locked position, and returns the slider 1144 to the locked position when the actuation portion(s) 1146A, 1146B are released by a user.

Referring to FIG. 48, all or part of the side wall 1126 and skirt 1133 may include interlocking steps that engage when the assembly 1110 is in the closed position. In the illustrated embodiment, such steps are formed on the front side 1112 of the assembly. The side wall 1126 of this embodiment includes an inwardly facing step 1162 that engages an outwardly facing step 1163 formed on the skirt 1133. An outwardly projecting tab 1135 may be included, to facilitate removal of the cap 1130 form the container 1120 during opening. In the illustrated embodiment, the tab 1135 projects forwardly from a bottom edge of the skirt 1133 at a location opposite the hinge 1140.

FIGS. 54-60 show another embodiment of a cap and container assembly 1210 according to the invention.

As shown, the assembly 1210 includes a container 1220 having a base 1228 and a tubular side wall 1226 extending upward from the base 1228. The side wall 1226 defines an opening 1222 at an upper edge thereof, and the opening 1222 leads to an interior 1227 of the container 1220.

The assembly 1210 has a front 1212, rear 1216 and opposite sides 1214A, 1214B.

Figure 54:
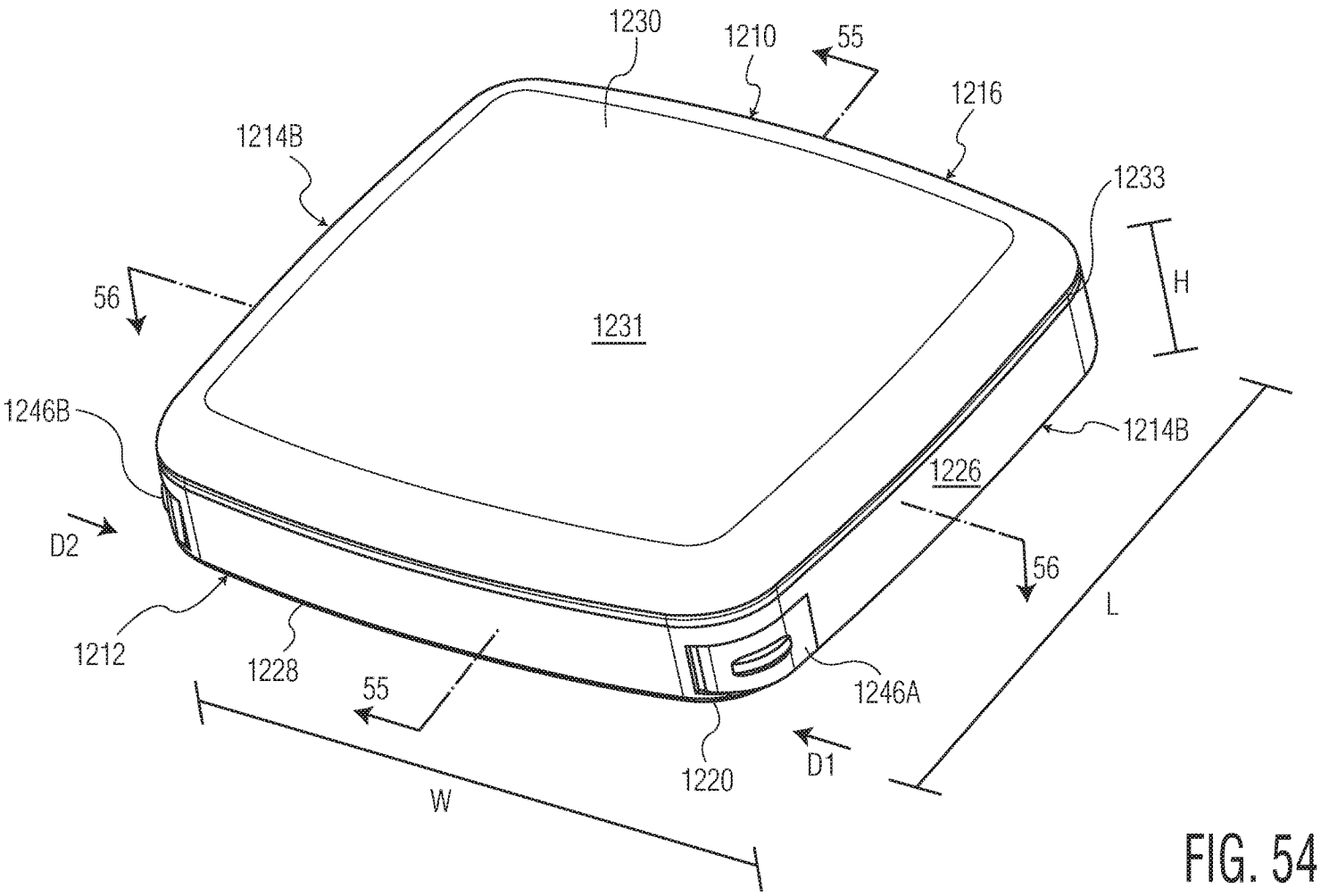
FIG. 54 is a front perspective view of another embodiment of a cap and container assembly according to the invention, in a closed position.
Figure 55:
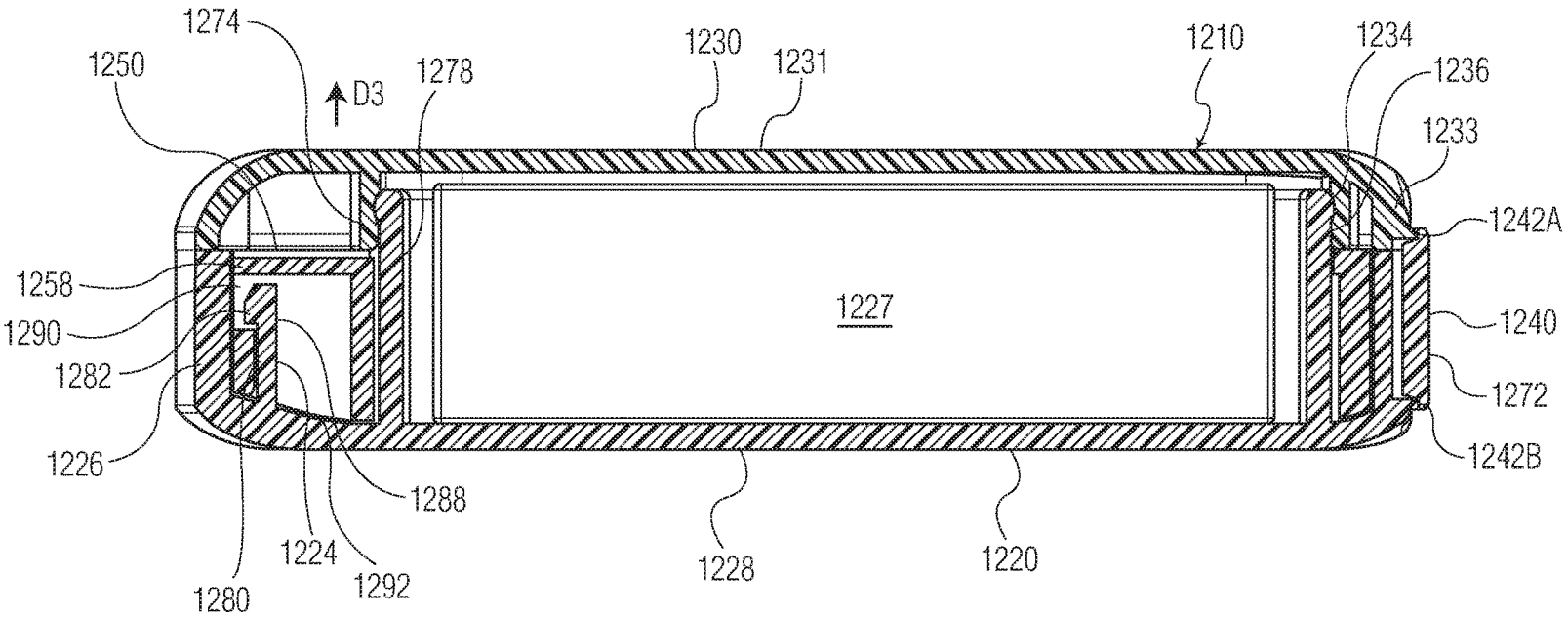
FIG. 55 is a cross section taken along line 55-55 of FIG. 54.
Figure 56:
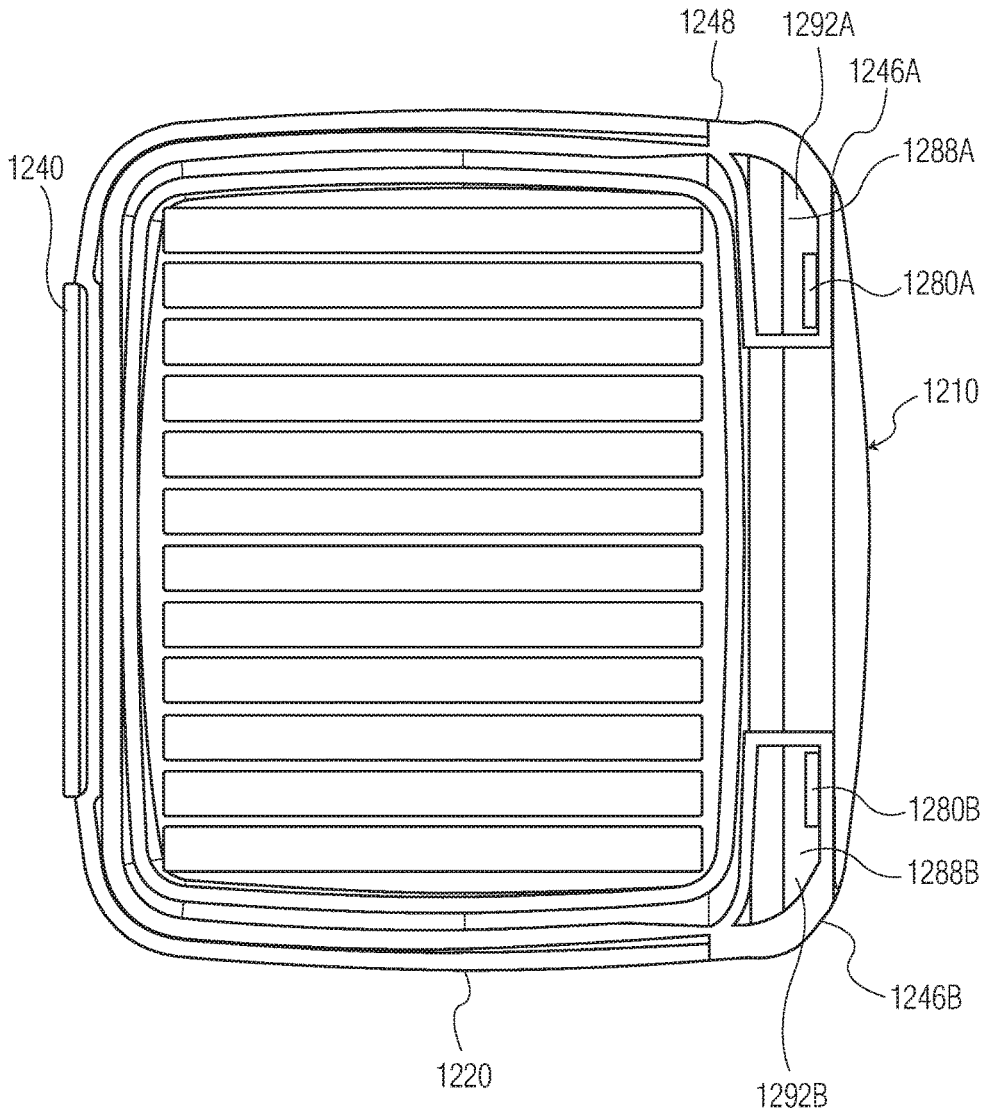
FIG. 56 is a cross section taken along line 56-56 of FIG. 54.
Figure 57:
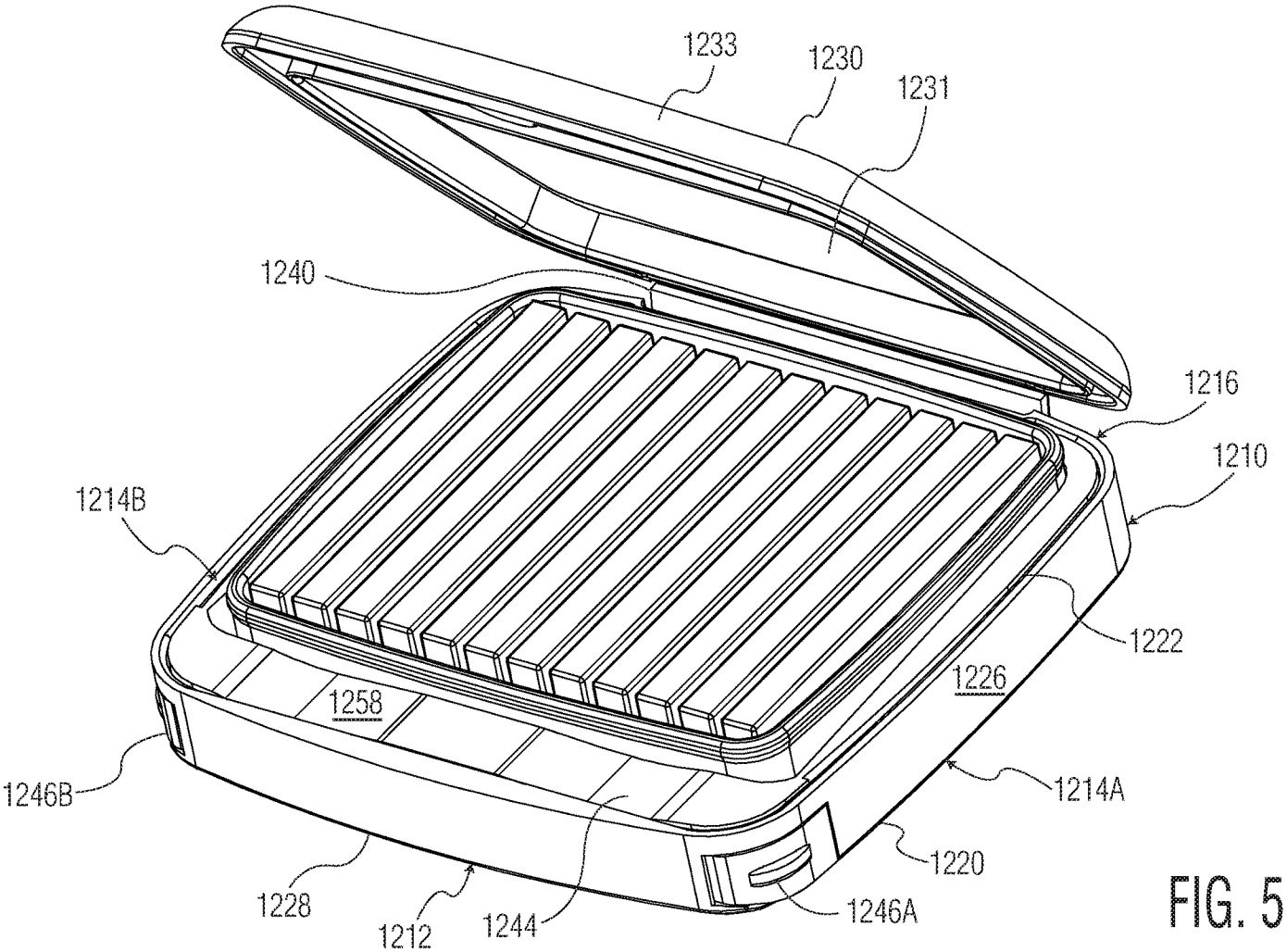
FIG. 57 is a front perspective view of the assembly of FIG. 54, in an opened position.

Still referring to FIGS. 54-60, the assembly 1210 of this embodiment further includes a cap 1230. The cap 1230 includes a top wall 1231 and a skirt 1233 that extends downward, substantially perpendicularly around the outer periphery of the top wall 1231. The cap 1230 moves between a closed position, in which the cap 1230 covers the opening 1222, as shown in FIGS. 54 and 55, and an opened position, in which the opening 1222 is exposed, as shown in FIG. 57. The cap 1230 of the illustrated embodiment is pivotally affixed to the container by a hinge 1240, located at the rear 1216 of the assembly 1210, which allows the cap 1230 to pivot between the opened and closed positions.

The assembly 1210 has a width W extending horizontally and generally parallel to the hinge 1240, a length L, extending horizontally and generally perpendicular to the hinge 1240, and a height H extending vertically and generally perpendicular to the hinge 1240. The assembly 1210 of the illustrated embodiment has a generally rectangular shape, with the height H having a smaller extension than the length L and width W, and the width W having a greater extension than both the length L and the height H. The assembly 1210 could be provided in any other suitable configuration known in the art or disclosed herein, taking on, for example, a cylindrical or square shape.

The cap 1230 of this embodiment includes an inner sealing ridge 1274 extending downward from a bottom surface of the top wall 1231 and located inward with respect to the skirt 1233. The container 1220 includes an inner lip 1278 extending upward from a bottom surface of the base 1228 and located inward with respect to the side wall 1226. The inner sealing ridge 1274 and the inner lip 1278 may engage to form a moisture-tight seal. As shown in FIG. 55, when the assembly 1210 is in the closed position, an inner surface of the inner sealing ridge 1274 abuts an outer surface of the inner lip 1278 to form a moisture-tight seal therebetween. The inner lip 1278 of this embodiment includes an outer projection 1234 at the upper edge and on an outer surface thereof, and the sealing ridge 1274 includes an inner projection 1276 at the upper edge and on an inner surface thereof. The outer projection 1234 and inner projection 1276 interlock to retain the assembly 1210 in the closed position, and may be used to form a moisture-tight seal between the cap 1220 and container 1230.

A bottom edge of the skirt 1233 contacts a top edge of the side wall 1226 when the assembly 1210 is in the closed position. As shown in FIGS. 54 and 55, the outer surfaces of the skirt 1233 and side wall 1226 are substantially flush when the assembly 1210 is in the closed position. Alternatively, the side wall 1226 could extend further out than the skirt 1233. In either embodiment, the bottom surface of the skirt 1233 is covered by the side wall 1226 and generally inaccessible to a user, preventing opening of the assembly 1210 unless unlocked using the method described below. In some embodiments, a moisture-tight seal may be formed between the skirt 1233 and the container side wall 1226, which can be an additional or alternative moisture-tight seal to that formed between inner sealing ridge 1274 and inner lip 1278 described above.

Figure 58:
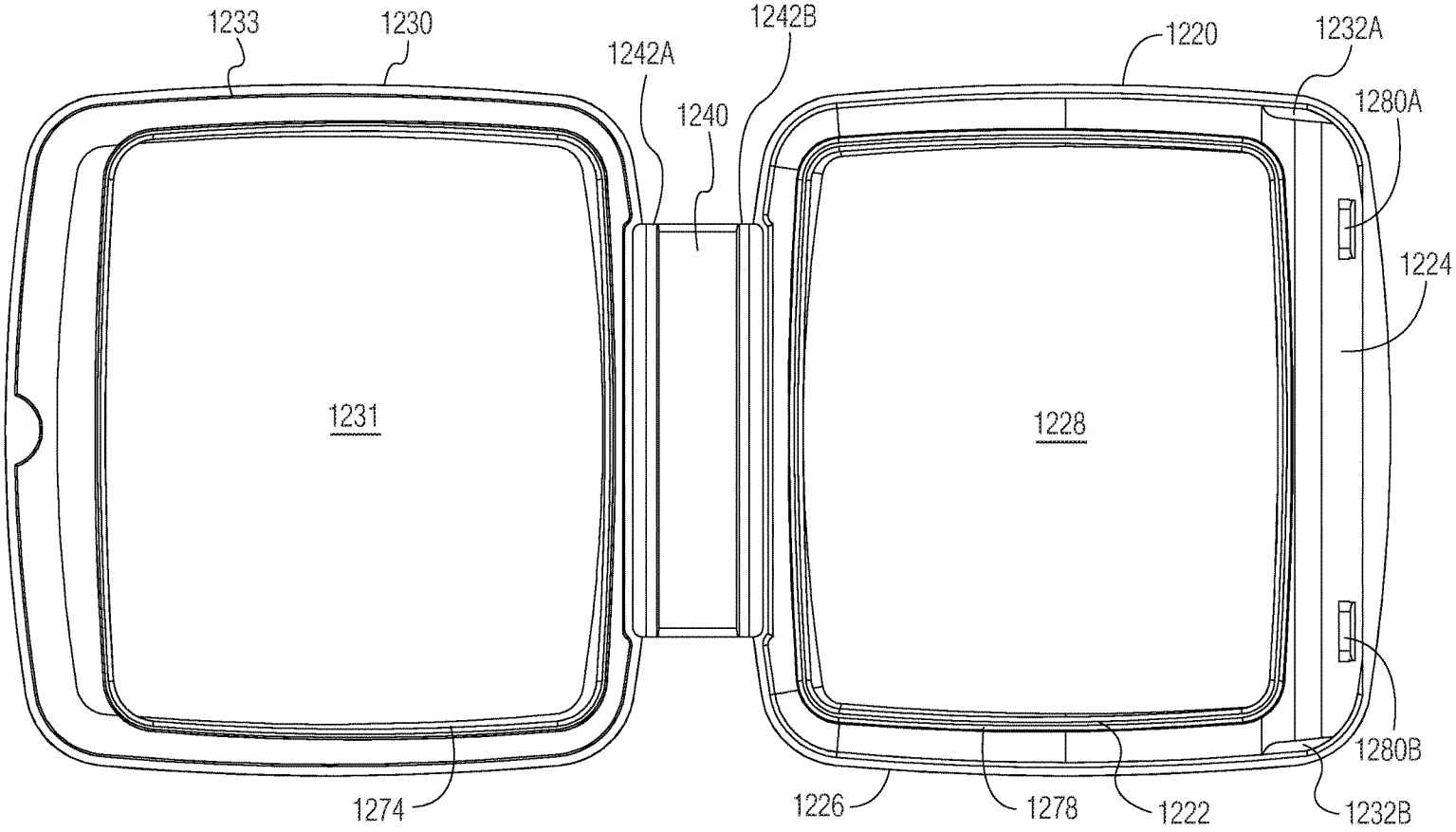
FIG. 58 is a top plan view of the assembly of FIG. 54, in an opened position and with the locking insert removed.

Referring in particular to FIGS. 55 and 58, the hinge 1240 of this embodiment is a double hinge. A hinge strip 1272 is formed between the cap 1230 and an upper edge of side wall 1226. Specifically, an upper edge of hinge strip 1272 joins with cap 1230 to form a first bending line 1242A, and a lower edge of hinge strip 1272 joins with side wall 1226 to form a second bending line 1242B. First bending line 1242A pivotally affixes the cap 1230 with the hinge strip 1272, and second bending line 1242B pivotally affixes the container 1220 with the hinge strip 1272. First and second bending lines 1242A, 1242B can be formed as recesses, such as the recess 42 in the embodiment of FIGS. 1-5. Alternatively, first and second bending lines 1242A, 1242B could be formed as mechanical hinges, or by other means of forming hinges known in the art. The inclusion of two bending lines between the cap 1230 and container 1220 allows for greater mobility in pivoting between the two elements.

The assembly of FIGS. 54-60 further includes a locking insert 1244. As shown, the locking insert 1244 sits within the container 1220, within a gap 1224 formed between the side wall 1226 and the inner lip 1278, completely surrounding the inner lip 1778 in the illustrated embodiment.

Figure 59:
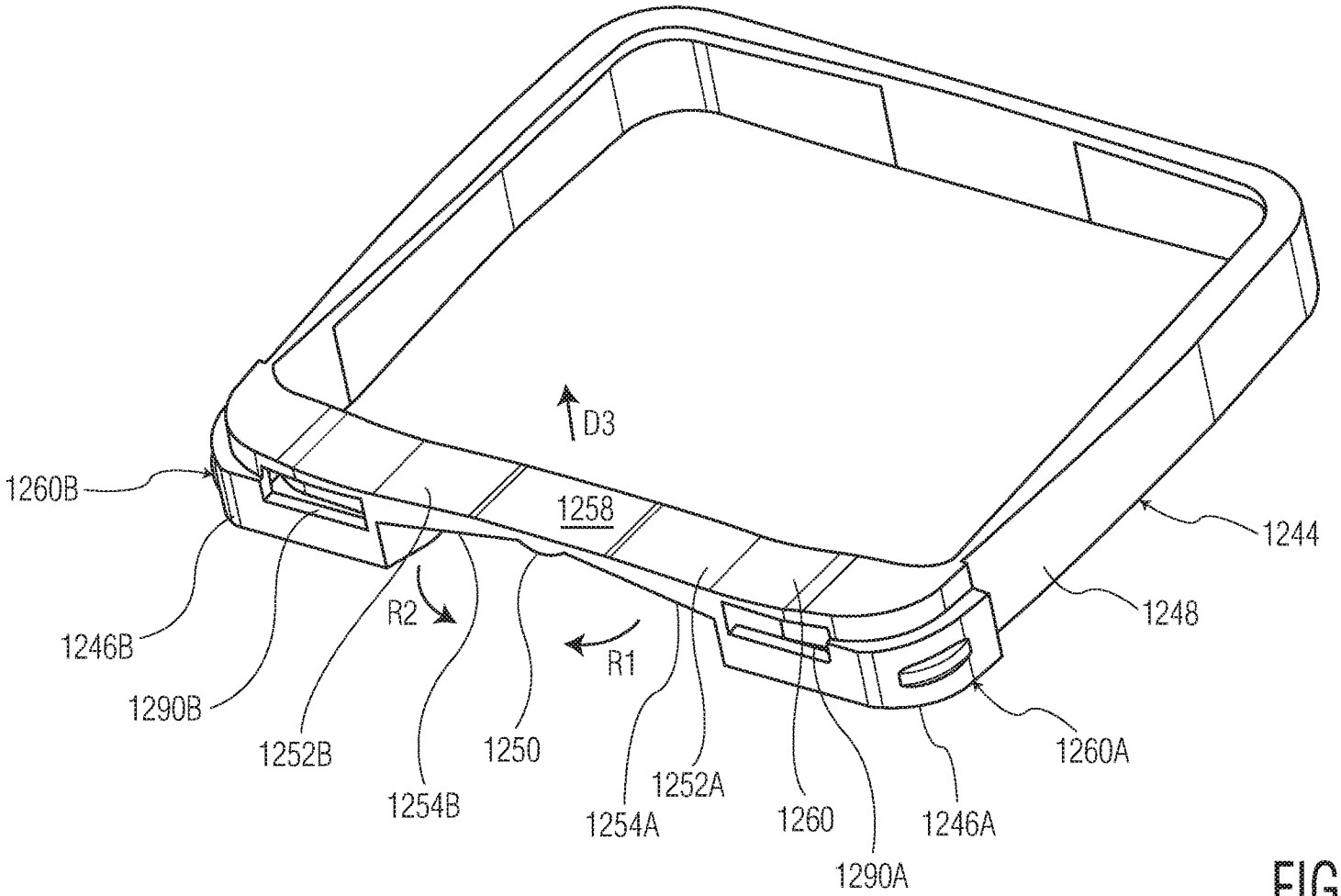
FIG. 59 is a front perspective view of the locking insert of the assembly of FIG. 54.
Figure 60:
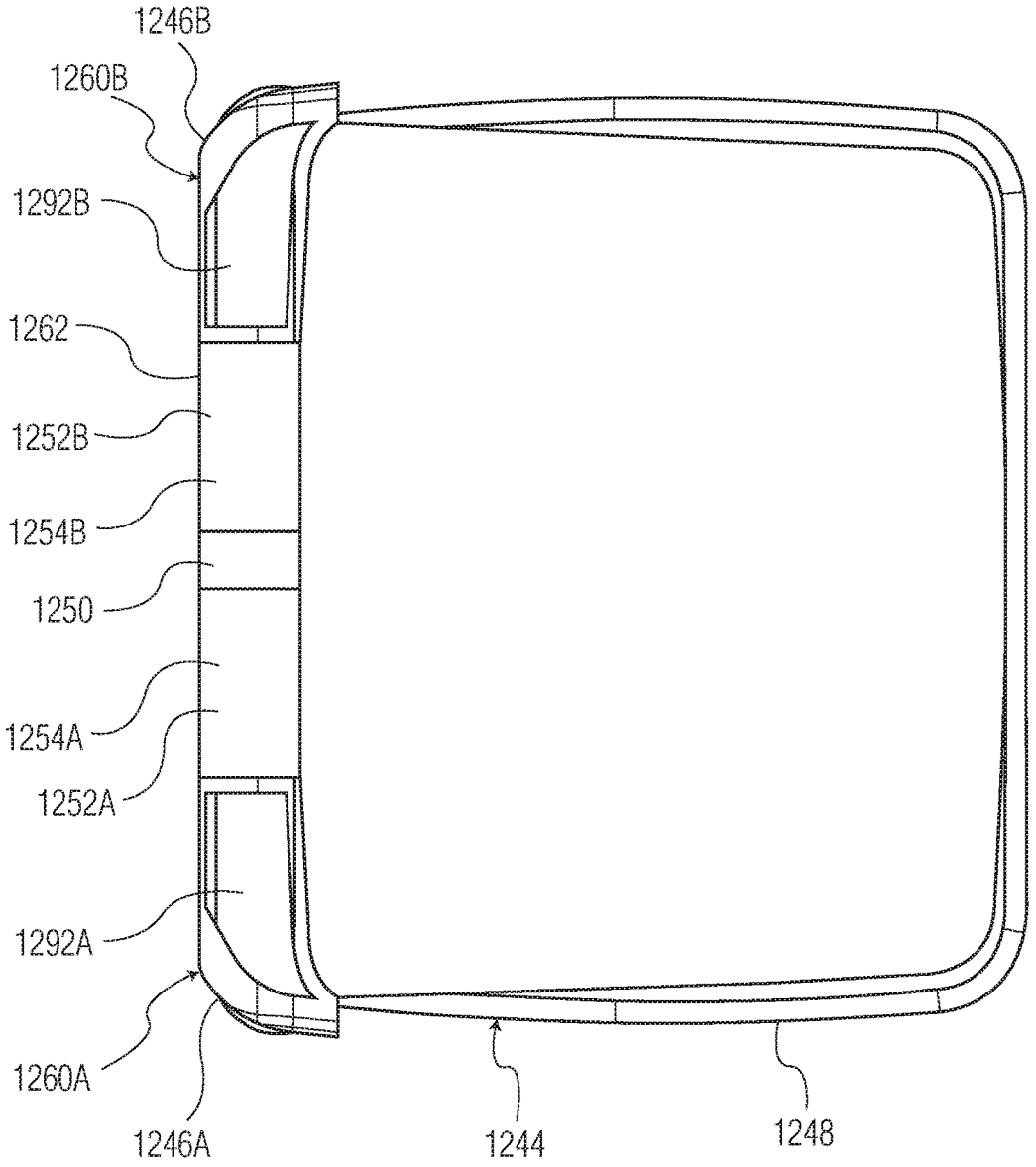
FIG. 60 is a bottom plan view of the locking insert of the assembly of FIG. 54.

Referring to FIGS. 59 and 60, the locking insert 1244 is shown in detail. As shown, the locking insert 1244 comprises a body 1248 that extends in a closed loop around the inner lip 1278. The body 1248 has a shape that generally conforms to that of the inner lip 1278, which is rectangular in the illustrated embodiment, but could take on other shapes in embodiments in which the assembly 1210 takes on other shapes. A portion of the body 1248 extending along the front side 1212 of the assembly 1210 forms a front body 1262 portion of the body 1248.

A top ledge 1258 extends across the top of front body 1262, and forms a top surface thereof. Actuation portions 1246A, 1246B project outwardly from corners 1260A, 1260B of locking insert 1244 located between the front 1212 and sides 1214A, 1214B of the assembly 1210. Two channels 1288A, 1288B having inverted "L" shapes extend between the front surface and the bottom surface of the front body 1262. Each channel 1288A, 1288B has a horizontal leg 1290 extending inward from the front surface of the front body 1262 and a vertical leg 1292 extending upward from a bottom surface of the front body 1262, to meet the horizontal leg 1290.

As shown in FIG. 59, the ledge 1258 includes a hinge axis 1250 at the center thereof, with first and second hinge legs 1252A, 1252B located on opposite sides of the hinge axis 1250, between actuation portions 1246A, 1246B. Hinge legs 1252A, 1252B each have bottom surfaces 1254A, 1254B that taper upwards as they extend away from actuation portions 1246A, 1246B and towards axis 1250.

Referring to FIGS. 54-58, the container 1220 includes openings 1232A, 1232B located at opposite corners between the front 1212 and sides 1214A, 1214B of the assembly 1210. Actuation portions 1246 of the locking insert 1244 project through openings 1232A, 1232B. The container further includes first and second dividers 1280A, 1280B extending in a width-wise direction of the assembly and projecting upward from a top surface of the container base 1228 within the gap 1224 and each projecting into an associated one of the vertical legs 1292A, 1292B of channels 1288A, 1288B. Each divider includes a forward projecting flange 1282A, 1282B extending into the associated horizontal leg 1290A, 1290B, to retain the locking insert 1244 in place within the container base 1228.

In order to open the assembly 1220, a user applies inward pressure in directions D1 and D2 to the actuation portions 1246A, 1246B, using a sufficient force so as to drive the actuation portions 1246A, 1246B inward, towards each other, causing pivoting of hinge legs 1252A, 1252B towards each other in directions R1 and R2, driving hinge axis 1250 upward in direction D3, as shown in FIG. 59. Hinge axis 1250 then contacts the bottom edge of cap inner sealing ridge 1274 and pushes it in an upward direction, driving the cap 1230 away from the container 1220 to move the assembly 1210 from the closed position to the opened position.

FIGS. 61-65 show another embodiment of a cap and container assembly 1310 according to the invention.

As shown, the assembly 1310 includes a container 1320 having a base 1328 and a tubular side wall 1326 extending upward from the base 1328. The side wall 1326 defines an opening 1322 at an upper edge thereof, and the opening 1322 leads to an interior 1327 of the container 1320.

The assembly 1310 has a front 1312, rear 1316 and opposite sides 1314A, 1314B.

Figure 61:
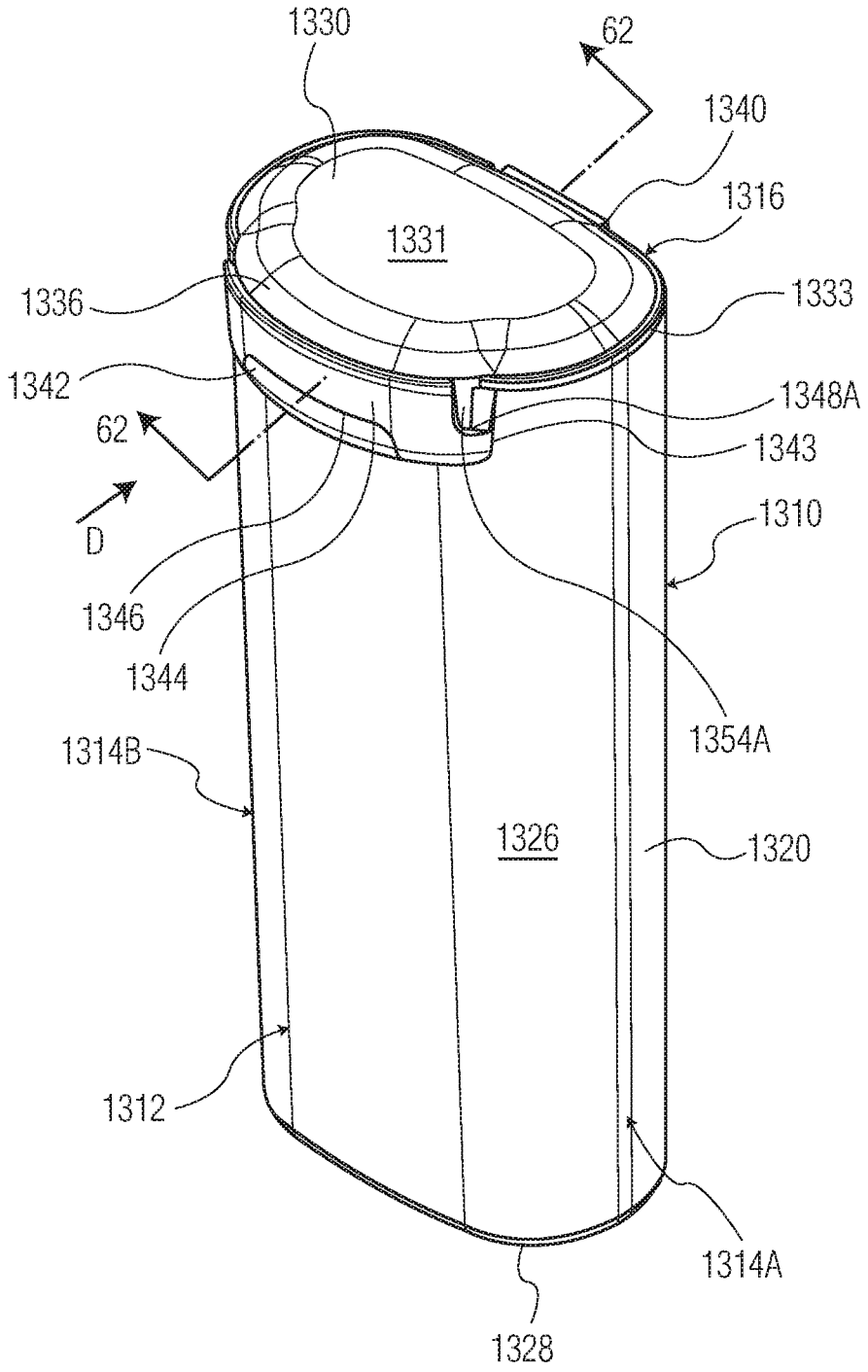
FIG. 61 is a front perspective view of another embodiment of a cap and container assembly according to the invention, in a closed position.
Figure 62:
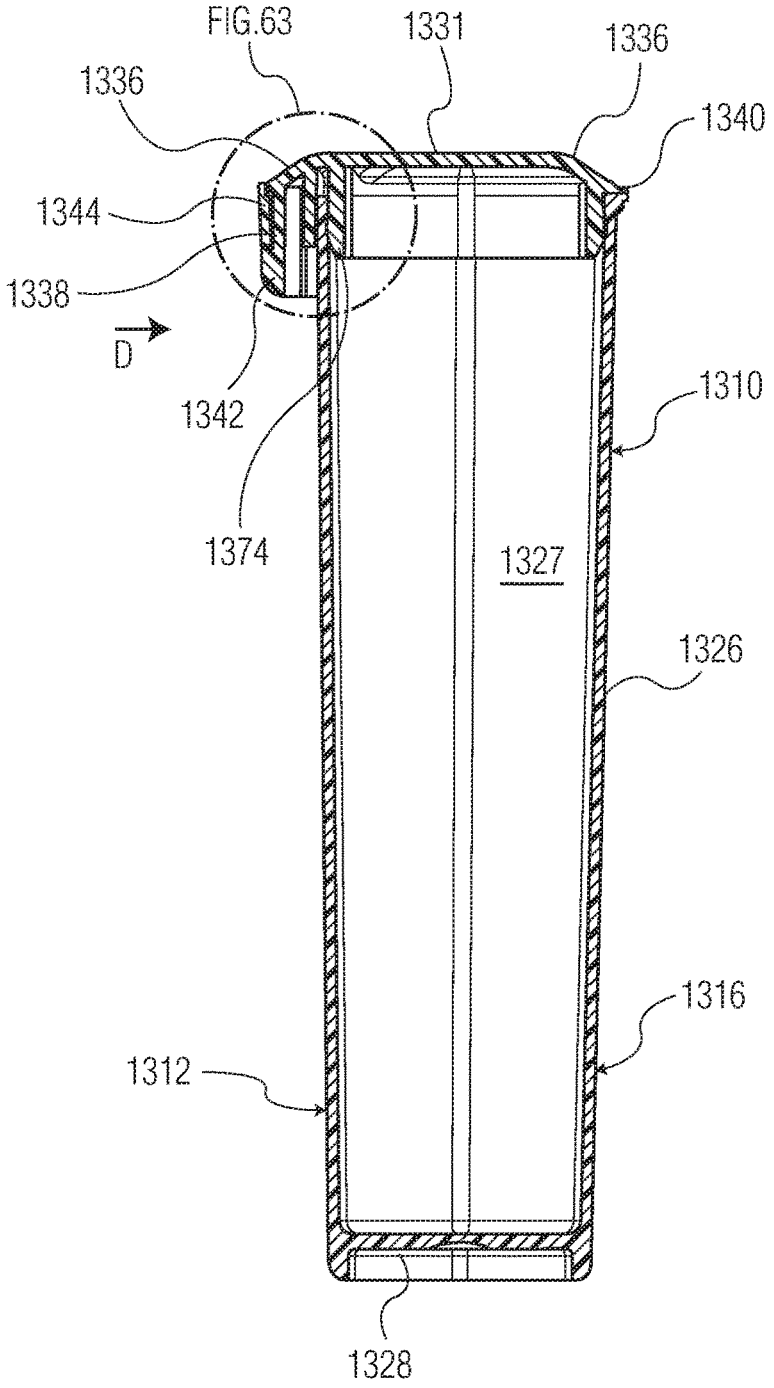
FIG. 62 is a cross section taken along line 62-62 of FIG. 61.
Figure 63:
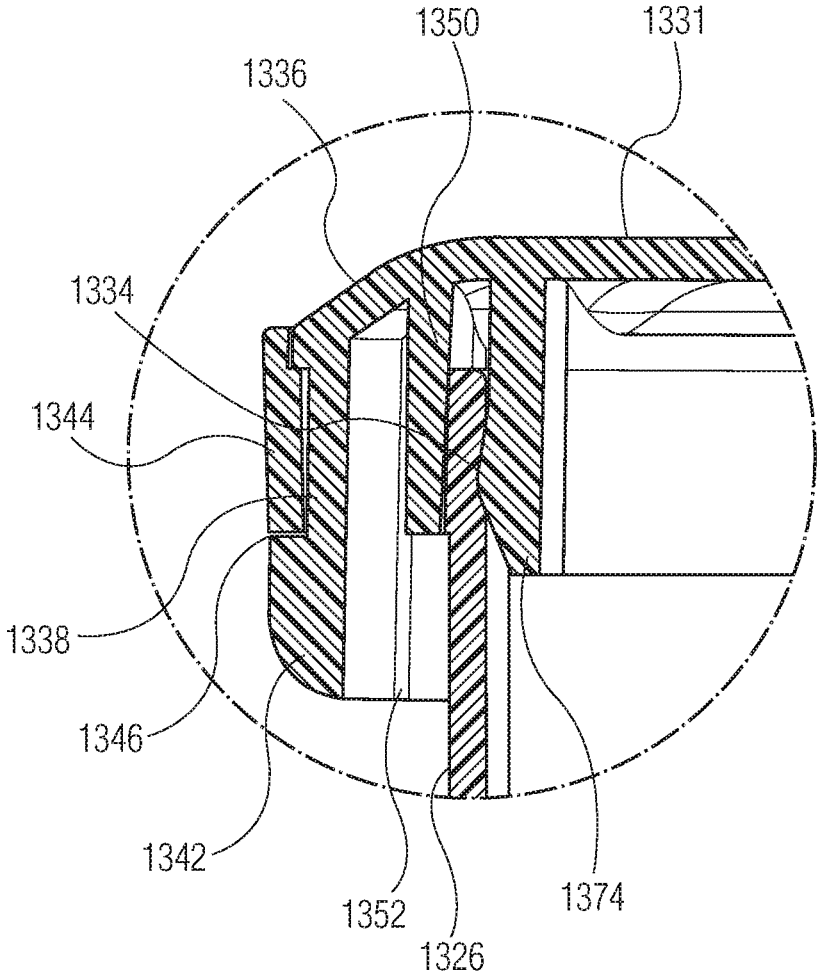
FIG. 63 is an enlarged detail of FIG. 62.
Figure 64:
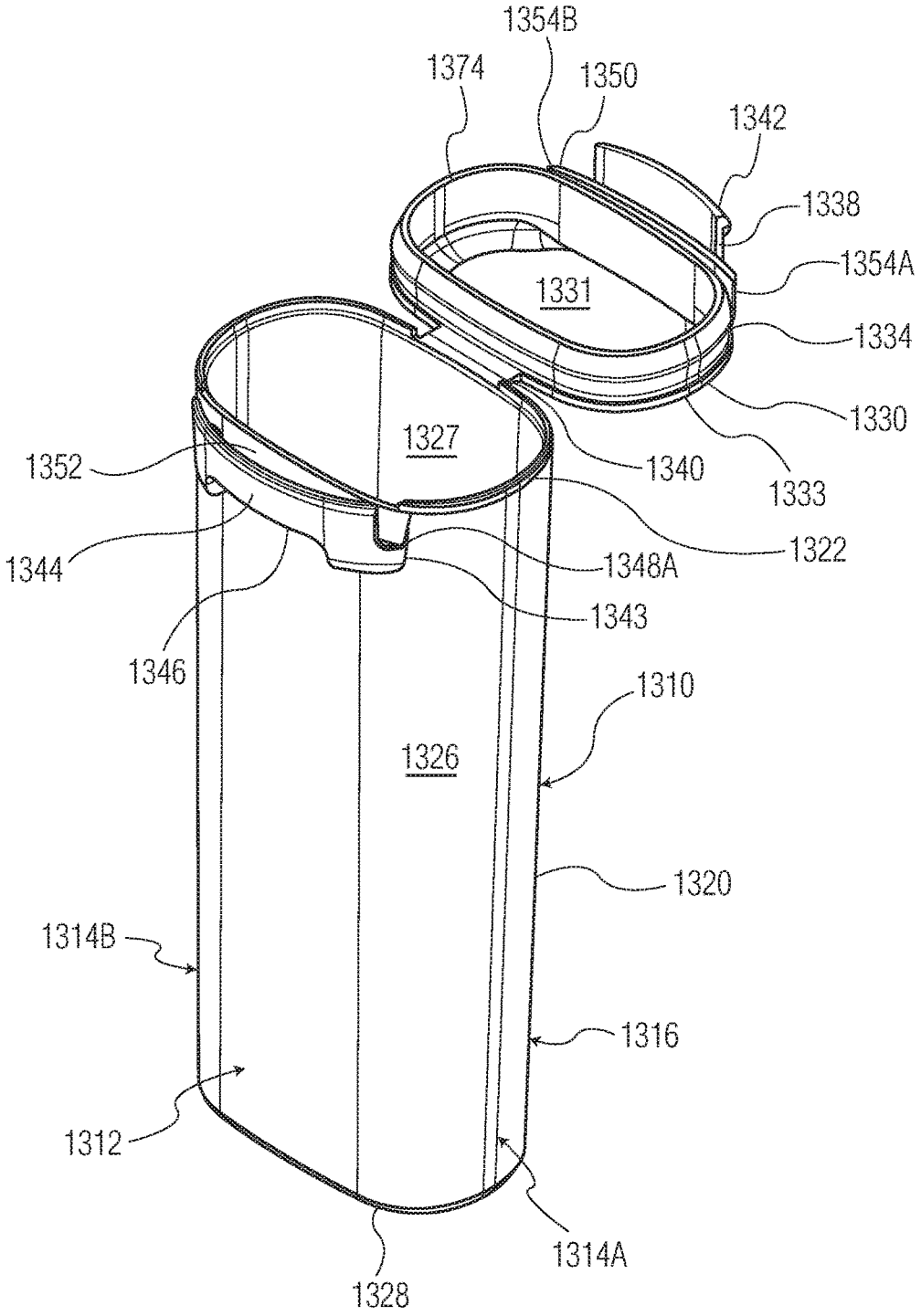
FIG. 64 is a font perspective view of the assembly of FIG. 61, in an opened position.

Still referring to FIGS. 61-65, the assembly 1310 of this embodiment further includes a cap 1330. The cap 1330 includes a top wall 1331 and moves between a closed position, in which the cap 1330 covers the opening 1322, as shown in FIG. 61, and an opened position, in which the opening 1322 is exposed, as shown in FIG. 64. The cap 1330 of the illustrated embodiment is pivotally affixed to the container by a hinge 1340, located at the rear 1316, which allows the cap 1330 to pivot between the opened and closed positions.

The assembly 1310 has a generally elliptical shaped cross section, with the side wall 1326 having a tubular configuration with an elliptical cross section, and the base 1328 and top wall 1331 being substantially flat. The assembly 1310 could be provided in any other suitable configuration known in the art or disclosed herein, taking on, for example, a square, rectangular or cylindrical shape such as those of any of the previously described embodiments.

The cap 1330 of this embodiment includes an inner sealing ridge 1374 extending downward from a bottom surface of the top wall 1331 and located inward with respect to the outer edge 1333 of the top wall 1331. The inner sealing ridge 1374 and the side wall 1326 may engage to form a moisture-tight seal. As shown in FIGS. 62 and 63, when the assembly 1310 is in the closed position, an inner surface of the side wall 1326 abuts an outer surface of the inner sealing ridge 1374 to form a moisture-tight seal therebetween. The inner sealing ridge 1374 of this embodiment includes an outer sealing projection 1334 at the lower edge and on an outer surface thereof. The outer sealing projection 1334 and inner surface of the side wall 1326 form a continuous annular abutment and interference fit to form a moisture-tight seal between the cap 1320 and container 1330.

The cap 1330 further includes a forwardly extending tab 1334, located on the front side 1312 of the assembly 1310, opposite the hinge 1340. The tab 1334 is formed as an extension of the cap top wall 1331 and extends over a spacer 1344 formed on the container 1320, as described in detail below.

An outer edge 1333 of cap top wall 1331 contacts a top edge of the side wall 1326 when the assembly 1310 is in the closed position. As shown in FIGS. 61-61, the outer edge of the cap 1330 and outer surface of side wall 1326 are substantially flush when the assembly 1310 is in the closed position. The outer edges of tab 1336 are flush with the outer surface of the spacer 1344. In other embodiments, the side wall 1326 could extend further out than the cap 1330. In any case, the bottom surface of the top wall 1331 and tab 1336 are covered by side wall 1326 and spacer 1344, and generally inaccessible to a user when the assembly 1310 is in the closed position, preventing opening of the assembly 1310 unless unlocked using the method described below. In some embodiments, the outer edge 1333 of cap top wall 1331 could contact the top edge of side wall 1326 all the way around the perimeter of top wall 1331 and a moisture-tight seal could be formed between the top wall 1331 and the container side wall 1326, which could be an additional or alternative moisture-tight seal to that formed between inner sealing ridge 1374 and side wall 1326, described above.

Figure 65:
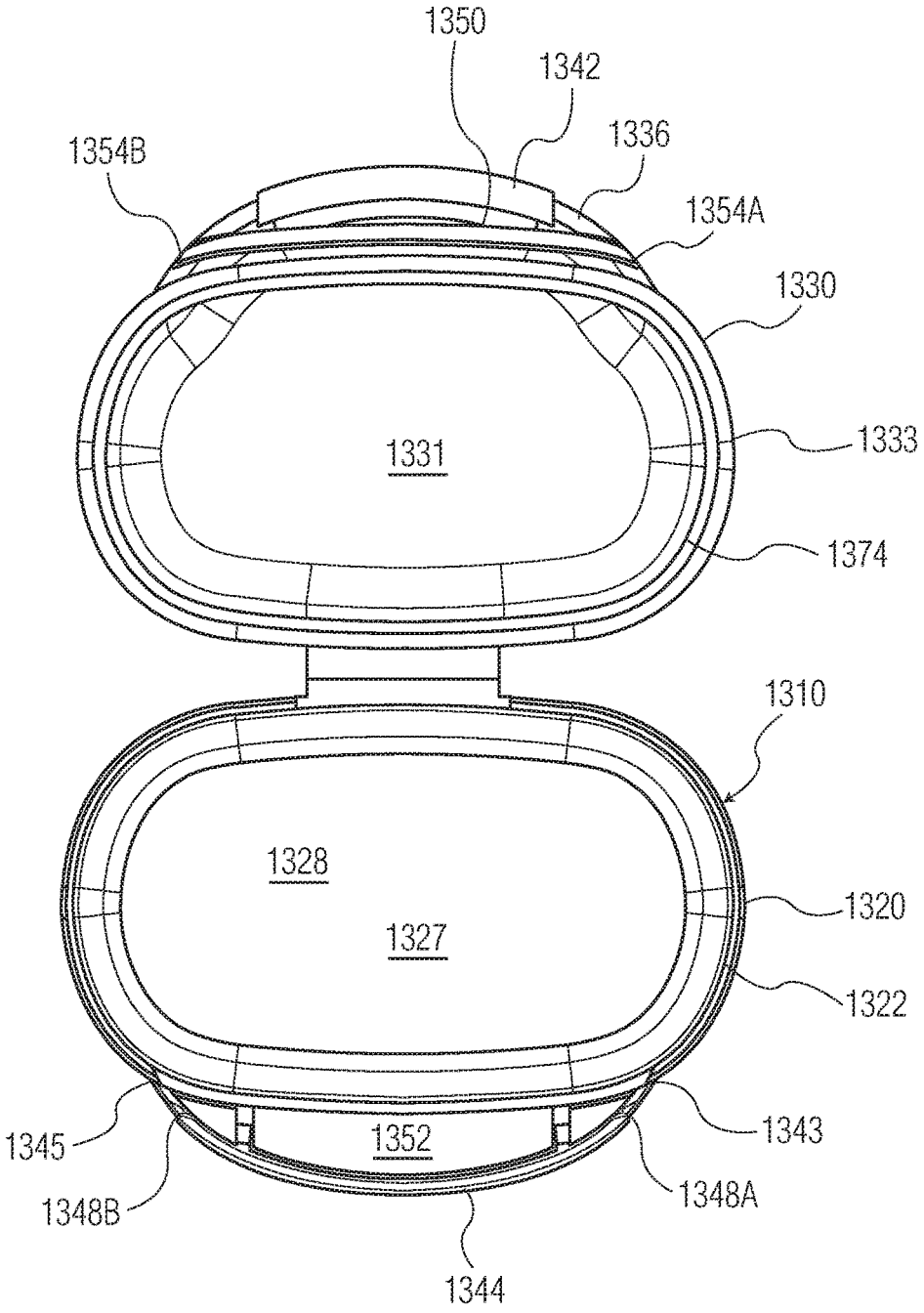
FIG. 65 is a top plan view of the assembly of FIG. 61.

The spacer 1344 is positioned on the container side wall 1326, near the opening 1322, such that an upper edge of the spacer 1344 thereof is level with an upper edge of side wall 1326. As shown, the spacer 1344 is formed as a strip that extends outward from the side wall 1326 and has a first end 1343 affixed to the side wall 1326 at a first position directly below the opening 1322 and a second end 1345 affixed to the side wall 1326 at a second position directly below the opening 1322. The spacer 1344 extends outward from the side wall 1326 in a path conforming to the shape of the outer edge of the tab 1336. An opening 1352 is formed between the spacer 1344 and the side wall 1326, as shown in FIGS. 64 and 65. A cutout 1346 is defined in a lower section of the spacer 1344, forming a portion of the bottom edge thereof. The cutout 1346 extends upward in a curved path and is configured to accommodate an actuation portion 1342 of a lock 1338 affixed to the cap 1330, as described in detail below. First and second notches 1348A, 1348B are cut into the spacer, between the upper surface and opposite ends 1343, 1345 thereof, and thus between the spacer ends 1343, 1345 and side wall 1326.

Referring to FIGS. 62-65, the cap 1330 includes a lock 1338. The lock 1338 is formed as a wall that extends downwardly from the front of tab 1336 and into the spacer opening 1352 when the assembly is in the closed position. An actuation portion 1342 is formed on a front surface of the lock 1338, at a bottom edge thereof. The actuation portion 1342 can be formed as any suitable forward projection, such as a button. When the assembly 1310 is in the closed position, the actuation portion 1342 projects outward from the cutout 1346 of the spacer 1344.

The cap 1330 of the illustrated embodiment further includes a strip 1350 that extends downwardly from a bottom surface of the tab 1336, at a location rearward of the lock 1338. The strip 1350 extends into the spacer opening 1352 when the assembly 1310 is in the closed position, and abuts an outer surface of the container side wall 1326 located rearward of spacer 1344. Opposite side edges 1354A, 1354B of the strip 1350 protrude out from the notches 1348 formed at the ends 1343, 1345 of spacer 1344. As shown in FIGS. 62 and 62, a portion of side wall 1326 is retained between strip 1350 and inner sealing ridge 1374 when the assembly 1310 is in the closed position.

When the assembly 1330 is in the closed and locked position, as shown in FIGS. 61-63, the spacer 1344, and in particular spacer cutout 1346, interferes with upward movement of the actuation portion 1342 of spacer 1344, which protrudes from beneath cutout 1346, and in turn prevents the cap 1330 from being moved away from the container 1320 to move the assembly 1310 into the opened position. In order to open the assembly 1310, actuation portion 1342 must be moved inward with respect to the assembly, by application of sufficient force in direction D. Once the actuation portion 1342 has been moved inward in direction D to a sufficient extent so as to clear the spacer cutout 1346, the assembly 1310 is in the unlocked position, and the lock 1338 can be moved through spacer opening 1352 as the cap 1330 moves in an upward direction, away from the container 1320.

During movement of the cap 1330 from the closed to the opened position, as described above, the user must also overcome any force retaining the cap 1330 on the container by way of the interference fit between inner sealing ridge 1374 and side wall 1326. Strip 1350 helps prevent any inadvertent disengagement between the inner sealing ridge 1374 and side wall 1326 during movement between the locked and unlocked position. Inward movement of the spacer 1344 in direction D could result in some bending of the tab 1336 and top wall 1331, resulting in rotation of the inner sealing ridge 1374 away from side wall 1326, breaking any moisture-tight seal therebetween, as well as the interference fit that helps to retain the cap 1330 on the container 1320. In embodiments including strip 1350, the strip 1350 rotates along with, and to a greater degree than inner sealing ridge 1374, due to its closer proximity to spacer 1344. During this rotation, strip 1350 pushes side wall 1326 inward, so that contact with inner sealing ridge 1374 may be maintained. According to such an embodiment, a user must first unlock the assembly as described above, and then move the cap 1330 away from the container 1320 before the moisture-tight seal is broken.

Each embodiment of the cap and container assembly described herein could be provided with a desiccant, which may be in the form of a desiccant plastic including a base polymer, channeling agent, and desiccant. Such materials are described in, for example U.S. Pat. Nos. 5,911,937; 6,214,255; 6,130,263; 6,080,350; 6,174,952; 6,124,006; and 6,221,446, all to Hekal, and which are incorporated herein by reference. The descant plastic could be provided as a liner, puck, or other type of insert.

Each of the cap and container assemblies described herein could be provided in various sizes as well as various shapes, including the square, rectangular and cylindrical shapes of the other assemblies described herein. The size and shape of any assembly according to the invention may depend on the intended use of the assembly, and the assemblies described herein should not be viewed as having the specific size and/or shape disclosed with respect to that particular embodiment of the assembly. Likewise, the features of each assembly described herein could be combined with the features of any other assembly described herein. An assembly having any combination of the features described herein shall be considered within the scope of the invention.

Any of the assemblies disclosed herein could be provided in a variety of materials, including polymeric materials such as polypropylene. Additionally, different components of any of the assemblies described herein could be formed of the same or different materials. For example, in an assembly having a cap and container with a sealing element, the cap and container could be formed of a rigid polymeric material such as polypropylene, and the sealing element could be formed of an elastomeric material such as rubber.

Any of the cap and container assemblies described herein could be used to house a variety of products including pharmaceuticals, food products, confections, supplements, tobacco products, and nicotine replacement products. The invention should not be viewed as limited to use with any particular type of product.

While the preferred embodiments of the invention have been described in detail above, the invention is not limited to the specific embodiments described, which should be considered as merely exemplary.

What is claimed is:

1. A cap and container assembly comprising:

a container having a base and a side wall extending upward from the base, the base and the side wall defining an interior, and the side wall defining an opening leading to the interior;

a cap pivotally affixed to the container by a hinge, the cap configured to pivot between an opened position in which the opening is exposed, and a closed position in which the cap covers the opening, the cap comprising a top wall, the cap including two cap portions located on opposite sides of the cap, each cap portion defining an aperture and having an abutting surface; and two spacers located on opposite sides of the container, each spacer being spaced outward from the side wall of the container and vertically aligned with at least a portion of one of the apertures when the cap is in the closed position, wherein each spacer includes a latch spaced from and positioned between the spacer and the sidewall of the container, each latch engaging at least a portion of one of the abutting surfaces to maintain the spacers in locked positions so as to retain the cap in the closed position, the spacers being configured to release the locked positions upon sufficient simultaneous inwardly directed forces applied to both spacers so as to disengage the respective latches from the respective abutting surfaces, thereby enabling a user to pivot the cap from the closed position to the opened position.

2. The cap and container assembly of claim 1, wherein the assembly has a height, a width and a length, and wherein the height is less than the width and the length.

3. The cap and container assembly of claim 1, wherein the assembly is made from polypropylene.

4. The cap and container assembly of claim 1, wherein the spacers are formed of a material having a sufficient degree of stiffness and resiliency so as to bias the spacers to the locked positions such that they can only be moved inwardly upon application of sufficient force.

5. The cap and container assembly of claim 1, further comprising springs between a respective spacer and the container side wall, wherein the springs bias the respective spacer in the locked position.

6. The cap and container assembly of claim 5, wherein the springs resist bending to a degree that requires application of a sufficient force in order to move the respective spacer inwardly, the springs being resilient enough to return the respective spacer to its original position upon removal of the sufficient force.

7. The cap and container assembly of claim 1, wherein a moisture-tight seal is formed between the container and cap when the cap is in the closed position, wherein the moisture-tight seal is formed by engagement between an inner sealing ridge extending downward from the cap and an inner lip extending upward from the container.

8. The cap and container assembly of claim 1, wherein each spacer has a first end affixed to the container side wall and a second end detached from the side wall.

9. The cap and container assembly of claim 1, wherein each spacer has a first end affixed to the container sidewall and a second end affixed to the container sidewall.

10. The cap and container assembly of claim 1, wherein one end of the hinge is integrally formed with the container and another end of the hinge is integrally formed with the cap.

11. The cap and container assembly of claim 1, wherein no portion of each spacer extends above the opening leading to the interior of the container.

12. A cap and container assembly comprising:

a container having a base and a side wall extending upward from the base, the base and the side wall defining an interior, and the side wall defining an opening leading to the interior;

a cap pivotally affixed to the container by a hinge, the cap configured to pivot between an opened position in which the opening is exposed, and a closed position in which the cap covers the opening, the cap comprising a top wall, the cap; and two spacers located on opposite sides of the container, each spacer being spaced outward from the side wall of the container to define a gap between the side wall of the container and the spacer, and being connected to the sidewall of the container by two springs and two segments, the two springs being located between the two segments, wherein side portions of the top wall of the cap are located above respective spacers when the cap is in the closed position, the side portions having respective lower surfaces which are blocked by respective spacers and which are generally inaccessible to a user when the spacers are in locked positions, wherein the spacers include respective latches and the cap side portions include respective catches that engage the respective latches to maintain the spacers in the locked positions so as to retain the cap in the closed position, the spacers being configured to release the locked positions upon sufficient simultaneous inwardly directed forces applied to both spacers so as to move at least slightly into the respective gap and disengage respective catches from respective latches, thereby enabling a user to pivot the cap from the closed position to the opened position.

13. The cap and container assembly of claim 12, wherein one end of the hinge is integrally formed with the container and another end of the hinge is integrally formed with the cap.

14. The cap and container assembly of claim 12, wherein no portion of each spacer extends above the opening leading to the interior of the container.

15. The cap and container assembly of claim 12, wherein each respective spacer has a first end affixed to the container side wall and a second end detached from the side wall.

16. The cap and container assembly of claim 12, wherein each respective spacer has a first end affixed to the container sidewall and a second end affixed to the container sidewall.

17. The cap and container assembly of claim 1, wherein each aperture is formed within an indented region in a top wall of the cap.

18. The cap and container assembly of claim 12, wherein each spring includes a spring hinge configured to permit bending of the spring during movement of the respective spacer.

19. A cap and container assembly comprising:

a container having a base, a side wall extending upward from the base, and an inner lip extending upward from the base, the side wall surrounding the inner lip and being spaced apart from the inner lip, two spacers being located on opposing sides of the container, each spacer being located exterior to the inner lip and interior to the side wall, each spacer including a latch; and a cap pivotally affixed to the container by a hinge, the cap being configured to pivot between an opened position and a closed position with respect to the container, the cap including a top wall, an outer wall extending downward from the top wall, and two spaced apart apertures extending through the cap, wherein each of the spacers is vertically aligned with at least a portion of one of the apertures when the cap is in the closed position, each latch being configured to extend through one of the apertures and engage at least a portion of the cap in a locked position to maintain the cap in the closed position, the spacers being configured to release the locked position upon sufficient simultaneous inwardly directed forces applied to both spacers so as to disengage the latches from cap, thereby enabling a user to pivot the cap from the closed position to the opened position.

20. The cap and container assembly of claim 19, wherein the cap further includes an inner sealing ridge, the outer wall of the cap surrounding the inner sealing edge and being spaced apart from the inner sealing ridge, at least a portion of the inner sealing ridge contacting a portion of the inner lip of the container when the cap is in the closed position.

* * * * *